US010679544B2

(12) United States Patent
Van Belle

(10) Patent No.: US 10,679,544 B2
(45) Date of Patent: Jun. 9, 2020

(54) DIGITAL IMAGE PROCESSING CHAIN AND PROCESSING BLOCKS AND A DISPLAY INCLUDING THE SAME

(71) Applicant: BARCO NV, Kortrijk (BE)

(72) Inventor: Ronny Van Belle, Lendelede (BE)

(73) Assignee: BARCO NV, Korrijk (BE)

( * ) Notice: Subject to any disclaimer, the term of this patent is extended or adjusted under 35 U.S.C. 154(b) by 0 days.

(21) Appl. No.: 16/072,226

(22) PCT Filed: Jan. 29, 2016

(86) PCT No.: PCT/EP2016/051994

§ 371 (c)(1),
(2) Date: Jul. 24, 2018

(87) PCT Pub. No.: WO2017/129265

PCT Pub. Date: Aug. 3, 2017

(65) Prior Publication Data

US 2019/0027082 A1 Jan. 24, 2019

(51) Int. Cl.

| | |
|---|---|
| ***G09G 3/20*** | (2006.01) |
| ***G09G 5/06*** | (2006.01) |
| ***G09G 5/10*** | (2006.01) |

(52) U.S. Cl.

CPC ..... *G09G 3/2003* (2013.01); *G09G 3/20* (2013.01); *G09G 5/06* (2013.01); *G09G 5/10* (2013.01); *G09G 2320/0242* (2013.01); *G09G 2320/0673* (2013.01); *G09G 2380/08* (2013.01)

(58) Field of Classification Search

CPC ..... G09G 3/2003; G09G 5/10; G09G 5/06; G09G 2320/0242; G09G 2380/08; G09G 2320/0673; G09G 3/20

See application file for complete search history.

(56) References Cited

U.S. PATENT DOCUMENTS

| | | | | |
|---|---|---|---|---|
| 2010/0128050 | A1* | 5/2010 | Chou | G09G 3/3607 345/589 |
| 2014/0363093 | A1 | 12/2014 | Miller | |
| 2017/0223328 | A1* | 8/2017 | Mochinaga | G11B 20/10 |
| 2017/0311034 | A1* | 10/2017 | Nishi | G06T 5/009 |
| 2018/0048845 | A1* | 2/2018 | Kozuka | H04N 5/20 |
| 2018/0352206 | A1* | 12/2018 | Uchimura | G11B 27/10 |

OTHER PUBLICATIONS

Pianykh, Oleg S.: "Digital Image Quality in Medicine", Springer, pp. 11-123 ISBN: 978-3-319-01759-4 (Year: 2014).*

(Continued)

*Primary Examiner* — Rodney Amadiz

(74) *Attorney, Agent, or Firm* — Bacon & Thomas, PLLC

(57) ABSTRACT

A method and system of perceptual quantization for providing a linear perceptual quantizing process of an Electro-Optical Transfer Function (EOTF) for converting received digital code words of a video signal into visible light having a luminosity emitted by a display, including a target contrast dependent exponential video coding providing quantized video levels, with which there is a fixed relative increment of luminosity per quantized video level, so that every quantized video level visibly has the same proportional luminosity variation.

17 Claims, 30 Drawing Sheets

(56) References Cited

OTHER PUBLICATIONS

International Search Report for PCT/EP2016/051994 dated Aug. 25, 2016.
Written Opinion for PCT/EP2016/051994 dated Aug. 25, 2016.
International Preliminary Report on Patentability for PCT/EP2016/051994 dated Apr. 25, 2018.
Pianykh, Oleg, "Digital Image Quality in Medicine," Springer, Cham Heidelberg New York Dordrecht London, ISBN: 978-3-319-01759-4, pp. 111-123 (2014).
http://www.barco.com/en/Products/Displays-monitors-workstations/Medical-displays/Diagnostic-displays (accessed Jul. 18, 2018).
https://en.wikipedia.org/wiki/Adobe_RGB_color_space (accessed Jul. 18, 2018).
Adobe® RGB (1998) Color Image Encoding Version May 2005 Specification of the Adobe® RGB (1998) color image encoding (May 2005).
Assessment of Display Performance for Medical Imaging Systems, American Association of Physicists in Medicine (AAPM), Task Group 18 (http://deckard.mc.duke.edu/~samei/tg18_files/tg18.pdf), pp. 80-81 (Apr. 2005).
Kimpe, T, Tuytschaever, T, "Increasing the Number of Gray Shades in Medical Display Systems—How Much is Enough?," Journal of Digital Imaging; 20(4):422-432. doi:10.1007/s10278-006-1052-3, (Dec. 2007).
Contrast Sensitivity of the Human Eye and Its Effects on Image Quality. Bellingham, WA: SPIE Press (Jan. 1999).
Barten PGJ. Physical model for contrast sensitivity of the human eye. Proc SPIE Int Soc Opt Eng. 1992;1666:57-72.

* cited by examiner

Fig. 7

| Exponent | Mantissa bits xxxxx and ignored bits zzzzzz |
|---|---|
| 15 | 1xxx.xxzz.zzzz.zzzz.zzzz |
| 14 | 01xx.xxxz.zzzz.zzzz.zzzz |
| 13 | 001x.xxxx.zzzz.zzzz.zzzz |
| 12 | 0001.xxxx.xzzz.zzzz.zzzz |
| 11 | 0000.1xxx.xxzz.zzzz.zzzz |
| 10 | 0000.01xx.xxxz.zzzz.zzzz |
| 9 | 0000.001x.xxxx.zzzz.zzzz |
| 8 | 0000.0001.xxxx.xzzz.zzzz |
| 7 | 0000.0000.1xxx.xxzz.zzzz |
| 6 | 0000.0000.01xx.xxxz.zzzz |
| 5 | 0000.0000.001x.xxxx.zzzz |
| 4 | 0000.0000.0001.xxxx.xzzz |
| 3 | 0000.0000.0000.1xxx.xxzz |
| 2 | 0000.0000.0000.01xx.xxxz |
| 1 | 0000.0000.0000.001x.xxxx |
| 0 | 0000.0000.0000.000x.xxxx |

Fig. 19

| white point | x | y | R drive (%) | G drive (%) | B drive (%) | Backlight (cd/m$^2$) |
|---|---|---|---|---|---|---|
| Native White | 0.277 | 0.296 | 100 | 100 | 100 | 1209 |
| Clearbase | 0.280 | 0.304 | 96,9 | 100 | 93,3 | 1227 |
| Bluebase | 0.250 | 0.305 | 43,6 | 100 | 90,3 | 1405 |
| D150 (15000K) | 0.261 | 0.270 | 76,7 | 80,6 | 100 | 1584 |
| D95 (9500K) | 0.282 | 0.296 | 100 | 91,1 | 91,9 | 1338 |
| D65 (6500K) | 0.313 | 0.329 | 100 | 75 | 56,4 | 1698 |
| D50 (5000K) | 0.346 | 0.359 | 100 | 62 | 34,6 | 2094 |

Fig. 25

| number of anchor points per dimension (P) | number of bits to represent exponent (E) | | | | |
|---|---|---|---|---|---|
| | 1 | 2 | 3 | 4 | 5 |
| 2 | 1 | 1 | 1 | 1 | 1 |
| 3 | 1 | 1 | 1 | 1 | 1 |
| 4 | 0,75 | 1 | 1 | 1 | 1 |
| 5 | 1 | 1 | 1 | 1 | 1 |
| 6 | 0,625 | 0,75 | 1 | 1 | 1 |
| 7 | 0,75 | 1 | 1 | 1 | 1 |
| 8 | 0,875 | 0,75 | 1 | 1 | 1 |
| 9 | 1 | 1 | 1 | 1 | 1 |
| 10 | 0,5625 | 0,625 | 0,75 | 1 | 1 |
| 11 | 0,625 | 0,75 | 1 | 1 | 1 |
| 12 | 0,6875 | 0,875 | 0,75 | 1 | 1 |
| 13 | 0,75 | 1 | 1 | 1 | 1 |
| 14 | 0,8125 | 0,625 | 0,75 | 1 | 1 |
| 15 | 0,875 | 0,75 | 1 | 1 | 1 |
| 16 | 0,9375 | 0,875 | 0,75 | 1 | 1 |
| 17 | 1 | 1 | 1 | 1 | 1 |
| 18 | 0,53125 | 0,5625 | 0,625 | 0,75 | 1 |
| 19 | 0,5625 | 0,625 | 0,75 | 1 | 1 |
| 20 | 0,59375 | 0,6875 | 0,875 | 0,75 | 1 |
| 21 | 0,625 | 0,75 | 1 | 1 | 1 |
| 22 | 0,65625 | 0,8125 | 0,625 | 0,75 | 1 |
| 23 | 0,6875 | 0,875 | 0,75 | 1 | 1 |
| 24 | 0,71875 | 0,9375 | 0,875 | 0,75 | 1 |
| 25 | 0,75 | 1 | 1 | 1 | 1 |

Fig. 26

| Input | Step 1 | Step 2 | Step 3 |
|---|---|---|---|
| 10-bit LUT Read Address | Target J-index | Target Luminosity | 17-bit LUT Read Data |
| 0 | 57,17302876 | 0,687920534 | 0 |
| 1 | 57,92360103 | 0,702540421 | 1 |
| 2 | 58,6741733 | 0,717346198 | 3 |
| 3 | 59,42474556 | 0,732338889 | 4 |
| 4 | 60,17531783 | 0,74751952 | 5 |
| 5 | 60,9258901 | 0,762889121 | 7 |
| 6 | 61,67646237 | 0,778448726 | 8 |
| 7 | 62,42703463 | 0,794199369 | 10 |
| 8 | 63,1776069 | 0,81014209 | 11 |
| 9 | 63,92817917 | 0,826277931 | 12 |
| 10 | 64,67875144 | 0,842607936 | 14 |
| ... | ... | ... | ... |
| 1020 | 822,7567416 | 1083,647053 | 96862 |
| 1021 | 823,5073138 | 1088,994866 | 97340 |
| 1022 | 824,2578861 | 1094,368585 | 97821 |
| 1023 | 825,0084584 | 1099,768336 | 98304 |

Fig. 27

| Input | Step 1 | Step 2 | Step 3 | Theoretical | Quantized | Relative |
|---|---|---|---|---|---|---|
| 10-bit LUT Read Address | Target J-index | Target Luminosity | 19-bit LUT Read Data | DL/L | DLq/Lq | Q-Error |
| 0 | 57,17302876 | 0,687920534 | 0 | na | na | na |
| 1 | 57,92360103 | 0,702540421 | 5 | 2 | 2 | 0,00% |
| 2 | 58,6741733 | 0,717346198 | 11 | 0,672293864 | 0,75 | 13,11% |
| 3 | 59,42474556 | 0,732338889 | 16 | 0,406063778 | 0,37037037 | 9,13% |
| 4 | 60,17531783 | 0,74751952 | 21 | 0,291886547 | 0,27027027 | 7,86% |
| 5 | 60,9258901 | 0,762889121 | 27 | 0,228429496 | 0,25 | 9,35% |
| 6 | 61,67646237 | 0,778448726 | 32 | 0,188035133 | 0,169491525 | 10,46% |
| 7 | 62,42703463 | 0,794199369 | 38 | 0,160061797 | 0,171428571 | 6,89% |
| 8 | 63,1776069 | 0,81014209 | 44 | 0,139542176 | 0,146341463 | 5,24% |
| 9 | 63,92817917 | 0,826277931 | 49 | 0,123846077 | 0,107526882 | 13,03% |
| 10 | 64,67875144 | 0,842607936 | 55 | 0,111450573 | 0,115384615 | 3,10% |
| ... | ... | ... | ... | ... | ... | ... |
| 1020 | 822,7567416 | 1083,647053 | 387448 | 0,004926447 | 0,004926312 | 1,16% |
| 1021 | 823,5073138 | 1088,994866 | 389362 | 0,004925986 | 0,004927846 | 1,63% |
| 1022 | 824,2578861 | 1094,368585 | 391284 | 0,004925527 | 0,004924127 | 1,55% |
| 1023 | 825,0084584 | 1099,768336 | 393216 | 0,00492507 | 0,00492543 | 1,24% |

Fig. 41

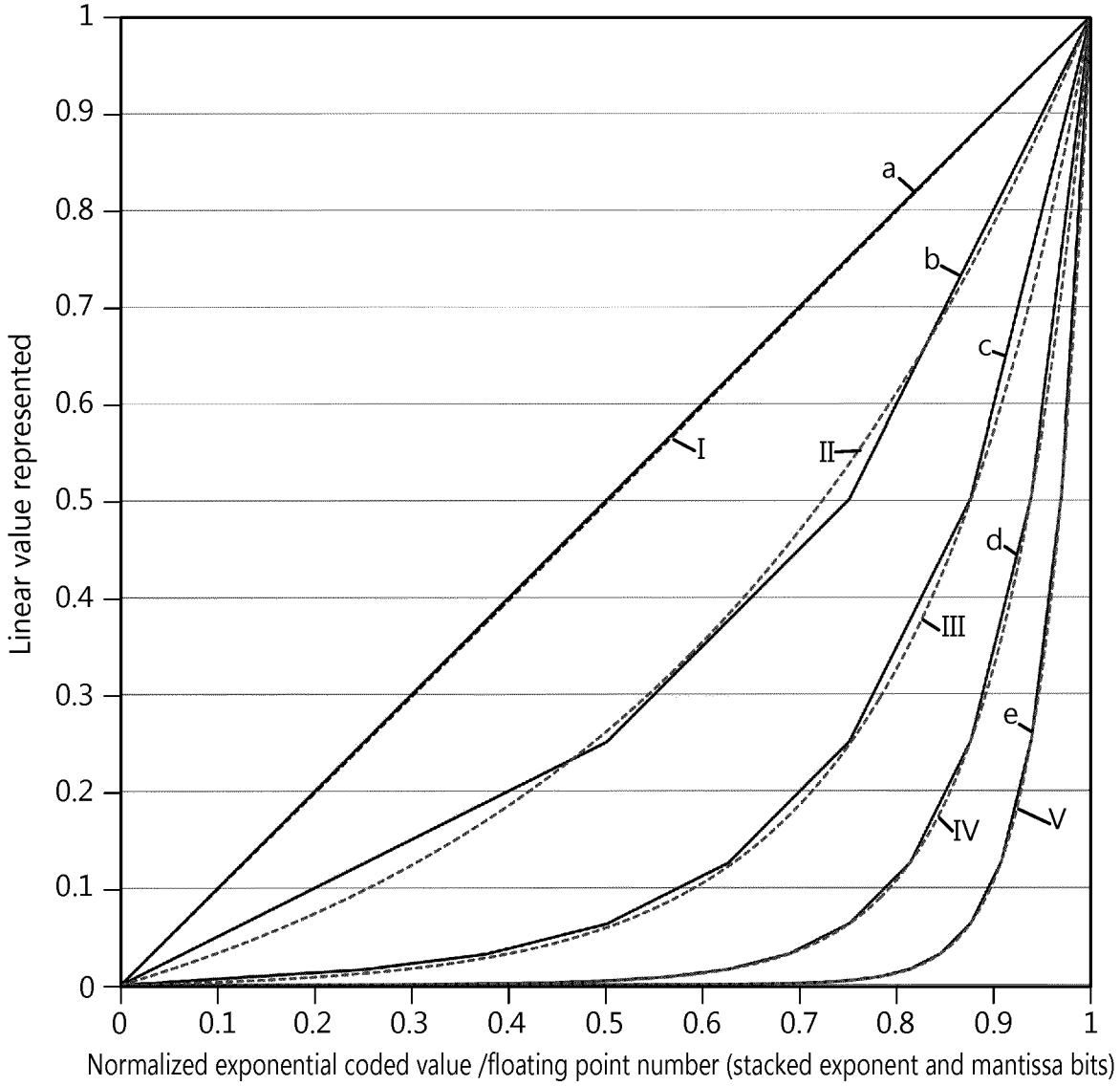

| | |
|---|---|
| a - FP encoding with 1-bit exponent | I - Exponential Function with contrast = 1:1 |
| b - FP encoding with 2-bit exponent | II - Exponential Function with contrast = 10:1 |
| c - FP encoding with 3-bit exponent | III - Exponential Function with contrast = 256:1 |
| d - FP encoding with 4-bit exponent | IV - Exponential Function with contrast = 64K:1 |
| e - FP encoding with 5-bit exponent | V - Exponential Function with contrast = 4G:1 |

DIGITAL IMAGE PROCESSING CHAIN AND PROCESSING BLOCKS AND A DISPLAY INCLUDING THE SAME

The present invention relates to an image processing chain of a display such as a fixed format display, as well as to a perceptual quantizer for providing an Electro-Optical Transfer Function (EOTF), as well as a display device implementing the processing chain and the EOTF, as well as hardware and software for implementing the EOTF and the processing chain.

BACKGROUND OF THE INVENTION

In an existing image processing chain of a display such as a fixed format display, one of the most desirable features can be the possibility to add functional blocks or features to the design without having to redesign or reconfigure the existing processing blocks features. There's an inherent difficulty associated to the concept of modularity, namely to preserve the system's specifications when features are added.

Simply adding features without reconfiguring or redimensioning existing blocks, while preserving system specifications, can lead to sub-optimal results.

In most cases it is more efficient to redesign or reconfigure one or more existing blocks in the signal data path. A straight forward method to remain within the system specifications when processing blocks are added to the video chain is by redimensioning each feature in order to obtain an individual performance better than the system specification divided by the number of processing blocks. This concept is not straight forward in image processing applications where multiple specifications need to be fulfilled on a system level. An image processing system might have a variety of specifications, such as: acceptable PSNR (peak signal to noise ratio), (perceptual) linearity of quantizing intervals, amount of distinguishable colors, grey tracking, color coordinates, MTF (modulation transfer function), dynamic range and contrast and/or similar. Therefore, an efficient low latency image processing system which sequentially performs multiple image processing steps in a streaming environment, for instance, in an image stream sent via a display port link to a healthcare monitor, must be capable of automatically configuring all functional blocks in the image processing path based on multiple system quality specifications, such as required for medical imaging such as for pathology for instance.

Compliancy with the DICOM standard for medical displays can be considered as a specialized case of a system level specification applied to grey tracking. A DICOM compliant display needs to convert the received electrical signal values, for instance a 10 bit value per color and per pixel stream received via a display port adapter, into linearized luminosities to enable further processing steps such as color gamut mapping which must be performed on linear tristimuli. In other words, some image processing blocks require linear luminosity values per color corresponding to linear XYZ data as can be measured by a colorimeter or a spectrometer compatible with the internationally standardized CIE 1931 colorimetric system.

However, the values which are received at the display port input can represent equidistantly 10-bit-quantized just noticeable difference values, known as J-index values. In case the display has a contrast of 1600:1 and a white luminance of 1000 Nit, the received 10-bit value of 0 represents a J-index of about 57, while the maximum received value of 1023 corresponds to a J-index of about 825. Practically, this means that every 10-bit input step of one bit, for instance an increment from 100 to 101, should correspond to about ¾ of a just noticeable difference of J-index increment. The human eye is capable of distinguishing about 825−57=768 brightness increments on a display conforming to the above mentioned specifications. Due to the contrast limitation, either caused by the display system or the ambient lighting conditions, the 57 darkest perceivable luminosity levels indicated by the first 57 J-index values are very difficult or impossible to perceive by the human eye with these displays and under these viewing conditions.

The received 10-bit linearly quantized J-index values are converted to linear luminosity values by using a look up table as can be created from the curve indicated in FIG. 1 which is an example of a electro-optical transfer function or DICOM curve stored in a look up table for a display of 100 Nit and a contrast of 1600:1.

FIG. 1 is an example of equation 1, for the given contrast and black level, for a 10-bit input, and for a normalized output.

As can be seen, the transfer function is very non-linear. The DICOM transfer function from J-index to linear light is approximated by the fraction of polynomial equations in the logarithmic domain as defined in Equation 1.

Luminosity calculated from *J*-index according to *DICOM* standard $$J = \log_{10}(J) \qquad \text{Equation 1}$$

$$l = \frac{-1.3011877 + 0.080242636 \cdot j + 0.13646699 \cdot j^2 - 0.025468404 \cdot j^3 + 0.0013635334 \cdot j^4}{1 - 0.025840191 \cdot j - 0.10320229 \cdot j^2 + 0.02874562 \cdot j^3 - 0.0031978977 \cdot j^4 + 0.00012992634 \cdot j^5}$$

$$L = 10^l = LfromJ(J)$$

The J index value is converted initially to its logarithmic value, represented as j. The value of j is converted to the logarithmic value of the luminosity, represented as 1, by using a fractional relation of two polynomial equations. Finally the luminosity L is calculated from its logarithmic representation 1 as a power of 10. The large variations in the curve steepness force the required output (read data) bit accuracy to be much higher than the input (read address) bit accuracy received via the display port link. Obviously, a high quality DICOM compliant display should preserve the distinction between all grey levels received by the input, even in the dark grey levels.

As the steepness of the transfer function is limited to about 1/200 an extra 8* bits are required to preserve all linearly quantized J-index increments as the binary logarithm of the minimal steepness indicates the amount of bits missing in the input accuracy to resolve grey level details in that area. *8=−ceiling ($\log_2$ (1/200))

In order to distinguish between all the input values a precision of at least 18 bit read data is required. This criterion is not always sufficient in diagnostic displays, for instance, as it doesn't indicate anything about the linearity of the quantizing intervals. The DICOM standard implemented in a preferred display has a tolerated non-linearity of relative luminosity increments (dL/L) of +−15% as indicated in FIG. 2. The Y axis is the error percent dL/L per JND, the X axis the JND index.

The allowed tolerance for the DICOM transfer function is standardized. It is impractical usually to verify the dL/L variation for each individual 10-bit input interval mainly due to the device used to capture each output, namely a camera sensor, which typically has so much noise that very long measurement times are required, especially to integrate the noise sufficiently for the dark grey levels. As shown in FIG. 2, in practice DICOM compliancy is verified by measuring a number of points, e.g. 17 points.

Although not always measurable, ideally the image processing system should be dimensioned to guarantee a dL/L tolerance to below 15% for every quantizing interval, as this will be required to pass the check as shown in FIG. 2. In order to preserve the distinction between all grey levels received by the input, in other words not to lose any received grey level detail, it is sufficient to design for a dL/L tolerance per interval below 100% and configure the look up table with at least an 18 bit read data bus.

In order to guarantee passing a DICOM compliancy test, regardless of which and how many input values are measured, it is necessary to configure the system to obtain a dL/L tolerance per interval below 15% and configure the look up table with at least a 20 bit read data bus, i.e. when targeting the same 1000-Nit display with a contrast ratio of 1600:1. Note that only 2 extra bits of linear accuracy are required to upgrade a basic color detail preserving system (no grey levels are lost at 18 bit luminosity values) to a full DICOM compliant system which requires at least 20 bits per color per pixel.

Most display systems are calibrated to have a gammatized electro-optical transfer function (EOTF). For instance the displayed luminosity offered by an LCD panel can be proportional to the electrical input value to the power of 2.4. While the above discussions about the DICOM compliancy requirements enable one to calculate the accuracy required by the input DICOM look up table, they don't elaborate on the accuracy required by the video processing system output.

The most recent generation of healthcare displays based on the FUN platform allow for mapping a certain color gamut to the native color gamut offered by the display system. See for example http://www.barco.com/en/Products/Displays-monitors-workstations/Medical-displays/Diagnostic-displays such as Barco Nio or Coronis displays.

This is determined mainly by the backlight illumination system, for instance the choice of LEDs and diffusers for the backlight, as well as the color filters attached to the LCD panel and the polarizing filters and other coating elements. Display devices can be made presently with wide gamut support, for instance close to the Adobe RGB 1998 standard See https://en.wikipedia.org/wiki/Adobe_RGB_color_space and Adobe® RGB (1998) Color Image Encoding Version 2005-05 Specification of the Adobe® RGB (1998) color image encoding, ADOBE SYSTEMS INCORPORATED Corporate Headquarters 345 Park Avenue San Jose, Calif. 95110-2704

However, the source data is usually not encoded with the same color gamut as the native display gamut. Often the sRGB color gamut (white triangle in FIG. 3) is preferred as this allows a camera to capture more light as more transparent color filters can be used in comparison to Adobe RGB (black line in FIG. 3) as illustrated in FIG. 3 with the D65 white point.

The color gamut mapping can be considered as a linear 3×3 matrix operator which is applied to the linearized tri-chromaticity values of the input signal (Ri, Gi, Bi) and the result is a set of linear luminosity values for each output color (Ro, Go, Bo) as illustrated in FIG. 4.

This illustrates how to implement a simple color gamut mapping feature. 3 steps are typically required:

1) 1D DICOM profile LUT: for a perceptual quantizer, the DICOM representation must be converted to a linear representation of light intensity.
2) A matrix transform defines a unique mix of linear light intensities for all 3 primary colors, based on all 3 input values.
3) Values from a LUT are used to compensate for the panel non-linearity The precision required by the output of the simple modular image processing path in FIG. 4 can be calculated from the overall transfer function required from input to output by cascading the two non-linear transfer functions: a) the conversion from linearly quantized J-index values to normalized linear luminosity values as specified by the DICOM standard and b) the conversion form linearly quantized normalized luminosity values to gammatized values which compensates for the display system's electro optical transfer function. FIG. 8 illustrates the overall system transfer function being a cascaded DICOM curve for a display at 1000 Nit with contrast of 1600:1 and gammatized with a gamma of 2.4.

When processing in the linear luminosity domain is not required, such as with previous generations of healthcare displays where color calibration was not required, the transfer function illustrated in FIG. 5 can be implemented in a single Look up Table (LUT) stored in hardware by successively applying the DICOM transfer function and the inverse gamma transfer function, thereby not only reducing the implementation cost but also eliminating the need to truncate the intermediate luminosity values. This is the main reason why a color graded DICOM compliant display requires far higher intermediate video processing accuracy compared to a display without any color calibration capabilities. The need for two separate look up tables is caused by features such as color gamut mapping which require a representation of linear luminosities.

FIG. 5 shows an overall system transfer function for 2.4-gammatized DICOM compliant display with 1000 Nits light output and contrast ratio of 1600:1 The transfer function in FIG. 5 does not show the extreme variations in gradient that were visible in FIG. 1. This is not surprising as a gammatization function with a gamma value of 2.4 can be considered as a basic attempt to approximate perceptually linear encoding. If the approximation were perfect, the steepness would be equal to 1 everywhere. In the illustrated system a 10 bit input requires 18 bit intermediate processing to avoid any grey detail loss, while only 12 bits are required for the output bus. Similarly, as illustrated in FIG. 7 a 10 bit input requires 20 bit intermediate processing accuracy to satisfy a dL/L variation per interval below 15%, while again only 16 bits are required for the output bus to preserve accurately equidistant quantizing intervals.

In reality there are a couple of problems with the simplified modular image processing path as presented in FIG. 4. While the 1D DICOM profile LUT having 1024 address entries is perfectly implementable in standard processing engines such as FPGA devices (or other accelerators), the S-LUT which compensates for the display's non-linearity needs 1048576 entries (2 to the power of 20) as the intermediate processing width is 20 bit. Although such a LUT is feasible to implement in a large processing engine such as an FPGA device, its expensiveness is such that a more efficient approach is preferred.

FIG. 6 shows the percentage gammatized output as the Y axis and the percentage luminosity input as the X axis for a content of a normalized LUT for a transfer function for gammatization with gamma=1/2.4. As can be seen the gammatization transfer function has a high and highly variable steepness in the dark grey levels while the steepness is almost constant near the white level. Therefore the bit accuracy which is required near the black level is much higher than near the white level.

SUMMARY OF THE INVENTION

The present invention relates to an image processing chain of a display such as a fixed format display, as well as to a perceptual quantizer for providing an Electro-Optical Transfer Function (EOTF), as well as a display device implementing the processing chain and the EOTF, as well as hardware and software for implementing the EOTF and the processing chain. The EOTF is suitable for use in a processing chain such as in a fixed format display, which allows addition of functional blocks or features to the design without having to redesign or reconfigure the existing processing blocks features while preserving the system's specifications when features are added.

The present invention provides in one aspect a perceptual quantizer for providing a linear perceptual quantizing process of an Electro-Optical Transfer Function (EOTF) for converting received digital code words of a video signal into visible light having a luminosity emitted by a display, the perceptual quantizer comprising:

a target contrast dependent exponential video coder comprising means for providing quantized video levels, with which there is a fixed relative increment of luminosity per quantized video level, so that every quantized video level visibly has the same proportional luminosity variation.

With reference to the feature "visibly has the same proportional luminosity variation" "visibly" can be understood from the Barten human vision model.

The processing makes use of a limit based transform of a gamma function in which gamma goes to infinity.

The perceptual quantizer can be implemented in a processing engine such as an FPGA in the form of a software algorithm, e.g. as part of an image display. The EOTF can be implemented as a processing pipeline from input to output, whereby the pipeline comprises a series of image processing blocks.

The EOTF of the complete display system is applied to signals received at a display port as input and determines the corresponding light output.

In embodiments of the present invention an interconnection between successive image processing blocks uses the representation for luminosity described above, by transmitting the value for v (whereby v or v=normalized video (0=black, 1=white)) from the first block to a second block, the representation of luminosity can be reconstructed fairly easily by calculations such as subtraction and multiplication.

Embodiments of the present invention, use the combination of floating point address encoding and piece wise linear data interpolation.

This allows embodiments of the invention to provide an efficient processing, as $L=(c^v-1)*K$ based on $c^v$ can be implemented in a single DSP block inside a processing engine such as an FPGA for instance, whereby v or v=normalized video (0=black, 1=white).

Most image processing steps, such as cross talk compensation, uniformity correction, white balance . . . require the linear light domain to be multiplied by certain coefficients or weights (w).

As $L=(c^v-1)*K$ represents the linear luminosity which can be derived with linear operators from $c^v$, that representation actually represents unnormalized linear luminosity.

As $w*c^v=c^{(v+p)}$ when $p=\log_c(w)$, it is not necessary to convert $c^v$ to v (sometimes represented by v) or vice versa in order to apply a "weight" w to the image or video signal.

There's no need for a linear representation of luminosity in order to perform most image processing steps which makes embodiments of the present invention very efficient in the use of image processing resources.

Embodiments of the present invention can avoid complicated transfer functions (e.g. with curve fitting) which cannot be converted back to a processable format without the usage of large look up tables. Instead embodiments of the present invention require only a simple linear operation.

Embodiments of the present invention provide image processing which is a tradeoff between cost-wise and quality-wise and avoids successive quantizing steps by multiple LUTs.

By using a combination of floating point address encoding and piecewise linear data interpolation a very accurate and smooth grey tracking implementation can be achieved in embodiments of the present invention.

In one implementation of this embodiment interpolation is performed by linear interpolation for 1-dimensional transfer functions.

In addition cross-talk between pixels are sub-pixels can be compensated. For example, a corrected value for each output sub-pixel can be calculated based on its original floating point encoded value combined with the original floating point encoded values of a number such as two of its neighbours.

The output gammatization LUT implemented by floating point addressing as a floating point representation of video data representing linear luminosities is extremely efficient when taking into account visual perception.

The Perceptual Quantizer in one embodiment can be described by this formula:

$$\lim_{\gamma\to\infty}\left[\frac{\left[\frac{1}{c^{1/\gamma}}+\left(1-\frac{1}{c^{1/\gamma}}\right)\cdot v\right]^{\gamma}-\frac{1}{c}}{1-\frac{1}{c}}\right]=\lim_{\gamma\to\infty}\left[\frac{c\cdot\left[\frac{1}{c^{1/\gamma}}+\left(1-\frac{1}{c^{1/\gamma}}\right)\cdot v\right]^{\gamma}-1}{c-1}\right]=$$

$$\frac{\lim_{\gamma\to\infty}\left[c\cdot\left[\frac{1}{c^{1/\gamma}}+\left(1-\frac{1}{c^{1/\gamma}}\right)\cdot v\right]^{\gamma}\right]-1}{c-1}=$$

$$\frac{\lim_{\gamma\to\infty}\cdot\left[\frac{c^{1/\gamma}}{c^{1/\gamma}}+\left(c^{1/\gamma}-\frac{c^{1/\gamma}}{c^{1/\gamma}}\right)\cdot v\right]^{\gamma}-1}{c-1}=\frac{\lim_{\gamma\to\infty}[1+(c^{1/\gamma}-1)\cdot v]^{\gamma}-1}{c-1}$$

$$\Downarrow e^{1/\gamma}=1+\frac{1}{\gamma}+\frac{1}{\gamma^2}+\frac{1}{\gamma^3}+\ldots\Rightarrow c^{1/\gamma}=1+\ln(c)\cdot\left(\frac{1}{\gamma}+\frac{1}{\gamma^2}+\frac{1}{\gamma^3}+\ldots\right)=$$

$$\frac{\lim_{\gamma\to\infty}\left[1+\left(1+\ln(c)\cdot\left(\frac{1}{\gamma}+\frac{1}{\gamma^2}+\frac{1}{\gamma^3}+\ldots\right)-1\right)\cdot v\right]^{\gamma}-1}{c-1}=$$

$$\frac{\lim_{\gamma\to\infty}\left[1+\left(1+\ln(c)\cdot\frac{1}{\gamma}-1\right)\cdot v\right]^{\gamma}-1}{c-1}=$$

$$\frac{\lim_{\gamma\to\infty}\left[1+\frac{\ln(c)\cdot v}{\gamma}\right]^{\gamma}-1}{c-1}$$

-continued $$\Downarrow \forall n \to 0: (1+n)^{\gamma} = 1 + n \cdot \gamma = \frac{\lim_{\gamma \to \infty}\left[1 + \frac{1}{\gamma}\right]^{\gamma \cdot \ln(c) \cdot v} - 1}{c-1} = \frac{\left[\lim_{\gamma \to \infty}\left[1 + \frac{1}{\gamma}\right]^{\gamma}\right]^{\ln(c) \cdot v} - 1}{c-1} = \frac{e^{\ln(c) \cdot v} - 1}{c-1} = \frac{[e^{\ln(c)}]^{v} - 1}{c-1} = \frac{c^{v} - 1}{c-1}$$

In which:

c="perceptual contrast", which is a measure for the target dynamic range v (or v)=normalized video (0=black, 1=white)

The result is luminosity.

Although the formula is derived from a limit based transform of a gamma function in which gamma goes to infinity, the result is a simple formula in which all elements are constants, except from the term c to the power of v (video): $c^{v}$.

The formula could be written as follows:

$$L=(c^{v}-1)*K$$

In which the constant K=1/(c−1).

There is no need to propagate any other values on top of v (video sometimes represented by v) throughout the image processing pipeline.

It is not necessary to pipeline constant values, as all taps within the pipeline would have the same value.

Further embodiments of the present invention are defined in the claims.

BRIEF DESCRIPTION OF THE DRAWINGS

FIG. 7 shows an example of a 20 bit linear natural value converted to a floating point number with 6 significant bits and 4 exponential bits.

FIG. 10.*b* shows a gammatization function approximated by linear interpolation between 20 non-equidistantly spread anchor points corresponding to a FP LUT-address.

FIG. 19 shows required display settings for various white points for one display unit according to any of the embodiments of the present invention.

FIG. 25 shows DICOM LUT data excursion scaling (epsilon) as function of P and E.

FIG. 26 shows a DICOM LUT data calculation example for 10 bit input and 17 bit output.

FIG. 27 shows DICOM LUT calculation and validation for 10 bit input, 19 bit output.

FIG. 41—Comparison of floating point number transfer function with best matching exponential video coding corresponding per exponent width.

DEFINITIONS

Figure 1:
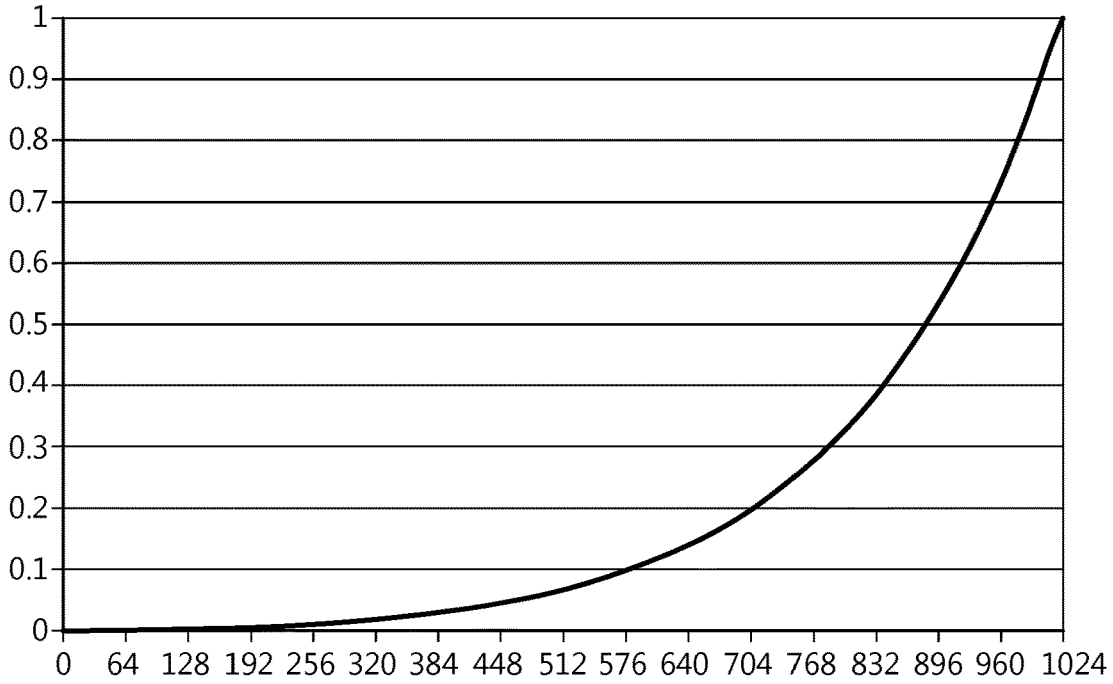
FIG. 1 shows an example of a DICOM transfer curve stored in a look up table brightness increments y axis is the luminosity level.

Electro-optical transfer function (EOTF) describes how to turn digital code words which are the input signal to a display into visible light using the displays electronic digital and/or analog components. Gamma correction has been based on CRT devices. Next generation devices can be much brighter and have much higher dynamic range and will use different technologies such as LCD displays, plasms displays, LED displays, OLEd displays hence there is a need to update the gamma functions now available.

Barten Model

In medical imaging the Barten model is frequently used and is generally accepted as valid. The Barten model is based on experimental data in which the eye is adapted to the luminance value of a uniform background, the state of so-called variable adaptation (see pp. 80-81 in Assessment of Display Performance for Medical Imaging Systems, American Association of Physicists in Medicine (AAPM), Task Group 18. Available at http://deckard.mc.duke.edu/~samei/tg18_files/tg18.pdf). The model contains all aspects of the threshold detection of sine wave targets surrounded by a luminance equal to the target average luminance. Barten's model of the human visual system considers neural noise, lateral inhibition, photon noise, external noise, limited integration capability, the optical modulation transfer function of the eye, and orientation and temporal filtering. Based on this model a unit called just noticeable difference (JND) was defined. A JND is the luminance difference of a given target under given viewing conditions that the average observer can just perceive. The JND is a statistical, rather than an exact quantity: The JND is the difference that a person notices on 50% of trials. In the context of medical displays, a JND means the smallest difference in luminance (between two gray levels) that the average observer can just perceive on the display system. If the luminance difference between two gray levels is larger than 1 JND then the average observer will be able to discriminate between these two gray levels. On the other hand, if the luminance difference between two gray levels is less than 1 JND, then the average observer will perceive these two gray levels as being only one level.

See further:

Increasing the Number of Gray Shades in Medical Display Systems—How Much is Enough? Kimpe T, Tuytschaever T. Increasing the Number of Gray Shades in Medical Display Systems—How Much is Enough?*Journal of Digital Imaging*. 2007; 20(4):422-432. doi:10.1007/s10278-006-1052-3.

6. Barten P G J. Physical model for contrast sensitivity of the human eye. Proc SPIE Int Soc Opt Eng. 1992; 1666:57-72.
7. Barten P G J. Contrast Sensitivity of the Human Eye and Its Effects on Image Quality. Bellingham, Wash.: SPIE Press; 1999.

Processing engines can be used in hardware implementations of the present invention. The processing engines can be used in one or more processing blocks in displays according to the present invention in order to implement a processing chain. One or more processing engines can execute processing steps A processing engine can be for example a microprocessor, a microcontroller or an FPGA, e.g. adapted to run software, i.e. computer programs for carrying out the functions as well as associated memory both random access and non-volatile memory as well as addressing, coding and decoding devices, busses and input and output ports. Processing engines may be used with input/output ports and/or network interface devices for input/output of data with networks or with a display unit.

Elements or parts of the described devices such as display systems may comprise logic encoded in media for performing any kind of information processing. Logic may comprise software encoded in a disk or other computer-readable medium and/or instructions encoded in an application specific integrated circuit (ASIC), field programmable gate array (FPGA), or other processor or hardware.

References to software can encompass any type of programs in any language executable directly or indirectly by a processor.

References to logic, hardware, processor, processing engine or circuitry can encompass any kind of logic or analog circuitry, integrated to any degree, and not limited to general purpose processors, digital signal processors, ASICs, FPGAs, discrete components or transistor logic gates and so on.

DETAILED DESCRIPTION OF THE INVENTION

The present invention will be described with respect to particular embodiments and with reference to certain drawings but the invention is not limited thereto but only by the claims. The drawings described are only schematic and are non-limiting.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein. The term "comprising", used in the claims, should not be interpreted as being restricted to the means listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B. Similarly, it is to be noticed that the term "coupled", also used in the description or claims, should not be interpreted as being restricted to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

Elements or parts of the described devices may comprise logic encoded in media for performing any kind of information processing. Logic may comprise software encoded in a disk or other computer-readable medium and/or instructions encoded in an application specific integrated circuit (ASIC), field programmable gate array (FPGA), or other processor or hardware.

References to software can encompass any type of programs in any language executable directly or indirectly by a processor.

References to logic, hardware, processor or circuitry can encompass any kind of logic or analog circuitry, integrated to any degree, and not limited to general purpose processors, digital signal processors, ASICs, FPGAs, discrete components or transistor logic gates and so on.

Floating Point Number Representations

Embodiments of the present invention allow a more efficient implementation for image processing for a display by using hardware optimized floating point representations instead of "brute force" linear integer coding which can reduce the read data bus width of the DICOM profile LUT and even more importantly the address width of the gammatization LUT or S-LUT. Such optimized intermediate luminosity representations preferably make use of 2 individual LUTs.

Referring again to FIG. 6, presenting the LUT addresses with a floating point format adds the desirable property that the smaller the number, the higher the absolute accuracy. The floating point number representation virtually keeps the relative accuracy constant as this is defined by the mantissa width, which is a near perfect match for an exponential function such as a gammatization.

A floating point is a representation that has a fixed number of significant digits (the "significand" or "mantissa") scaled using an "exponent" of a base. The base for the scaling can be two, ten, or sixteen, for example. Floating-point numbers can be represented (see IEEE 754) with three binary fields: one for a sign bit "s", one for an exponent field "e" and one for a fraction field "f" (N.B. in this representation the mantissa is in this case 1+f).

In processing engines such as an FPGA devices floating point number representations are not limited to, for example, the IEEE Standard for Floating-Point Arithmetic (IEEE 754) which defines fixed mantissa and exponent widths for single and double precision formats. In processing engine such as an FPGA based implementation according to embodiments of the present invention it is perfectly possible to define any arbitrary significand width and combine it with any arbitrary exponential width. A 20 bit linear number could, for instance, be converted to a floating point format preserving 6 significant bits and 4 exponential bits as illustrated in FIG. 7.

Note that the gammatization function, unlike the DICOM transfer function from J-index to luminosity, does not increase the amount of bits required from its input to its output. This is because of the minimal steepness which occurs in the transfer function. Hence, the purpose of this feature is not to preserve all potential color detail within the intermediate representation, but to accurately preserve the color gradations and grey levels which were already present as linearly quantized J-index values at the input of the system. Therefore, the minimal steepness of about 0.417, which occurs near the white level as the derivative of the gamma function (with gamma=1/2.4) near '1' as normalized white level, does not require 3* extra bits at the output to preserve all intermediate quantizing levels. *3=−ceiling ($\log_2(0.417)$)

Figure 6:
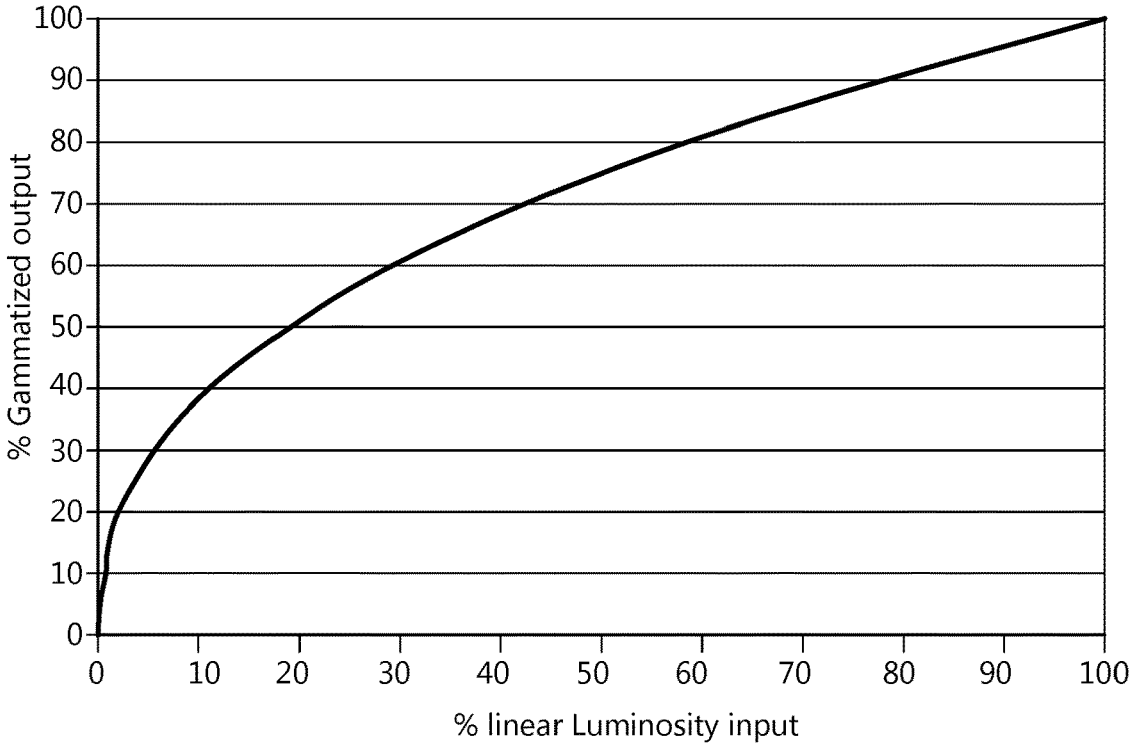
FIG. 6 shows a transfer function for gammatization with gamma=1/2.4

The position of the most significant '1' in the linear 20 bit number determines the value of the exponent and defines which bits are preserved (indicated as 'x') within the significand and which bits are ignored (indicated as 'z'). Note that the most significant bit is not preserved within the significand, as its position and value are already determined by the exponent. In the example in FIG. 8 the original 20 bit value i.e. representing linear luminosities, is reduced to only 9 bits (5 bits as part of the 6 bit mantissa+4 bits representing the exponent). In this case no sign bits are required as these are natural numbers. Although the corresponding gammatization-LUT only requires 512 entries (9 bit address) the first 64 values of the input are represented without any truncation. These are the values on the horizontal axis with highly variable steepness near the black level, as indicated by FIG. 6 before.

Embodiments of the present invention use a floating point representation with a linear number of "N" bits. The position of the most significant '1' in the linear bit number determines the value of the exponent and defines which bits "x" are preserved within the significand and which bits "z" are ignored. "z" can have a value of zero: In case of 4 exponential bits, up to 14 bits could be ignored, as FIG. 7 illustrates. In case of 3 exponential bits, up to 6 bits could be ignored.

The maximum number of ignored bits Zmax (for the highest exponent value) can be calculated as 2 to the power of E minus 2, in which E represents the number of exponential bits.

Note that the most significant bit need not be preserved within the significand, as its position and value are already determined by the exponent. No sign bits are required as these are natural numbers. An original floating point representation with a N bit value i.e. representing linear luminosities, can be reduced to:

When E=2=>Zmax=2
When E=3=>Zmax=6
When E=4=>Zmax=14
When E=5=>Zmax=30
. . .

For video signals, a useful range for E is 2<E<6 for example.

Embodiments of the present invention that use this type of floating point representation of a video signal are extremely efficient, especially in processing engines such as an FPGA devices, as it is a special form of exponential coding. This has a relationship to exponentially coding of linear luminosities which is also performed by the gammatization function as a better form of perceptually linear encoding of imagery pixel data values.

Figure 8:
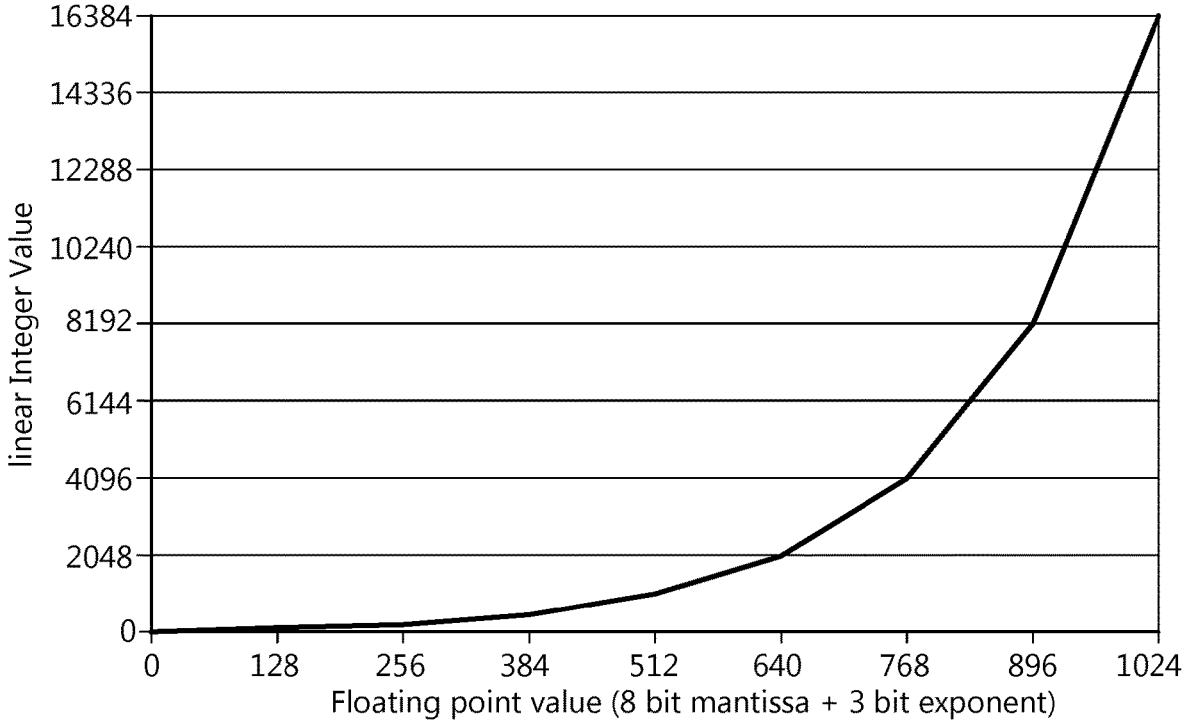
FIG. 8 shows a transfer function example of floating point number with 8 bit mantissa and a 3 bit exponent to integer number conversion.

The gamma-like transfer function performed by the floating point conversion is illustrated in FIG. 8 which illustrates a floating point to linear value conversion where a 10 bit floating point value representing an 8 bit mantissa and a 3 bit exponent is converted to its linear integer number.

Figure 9:
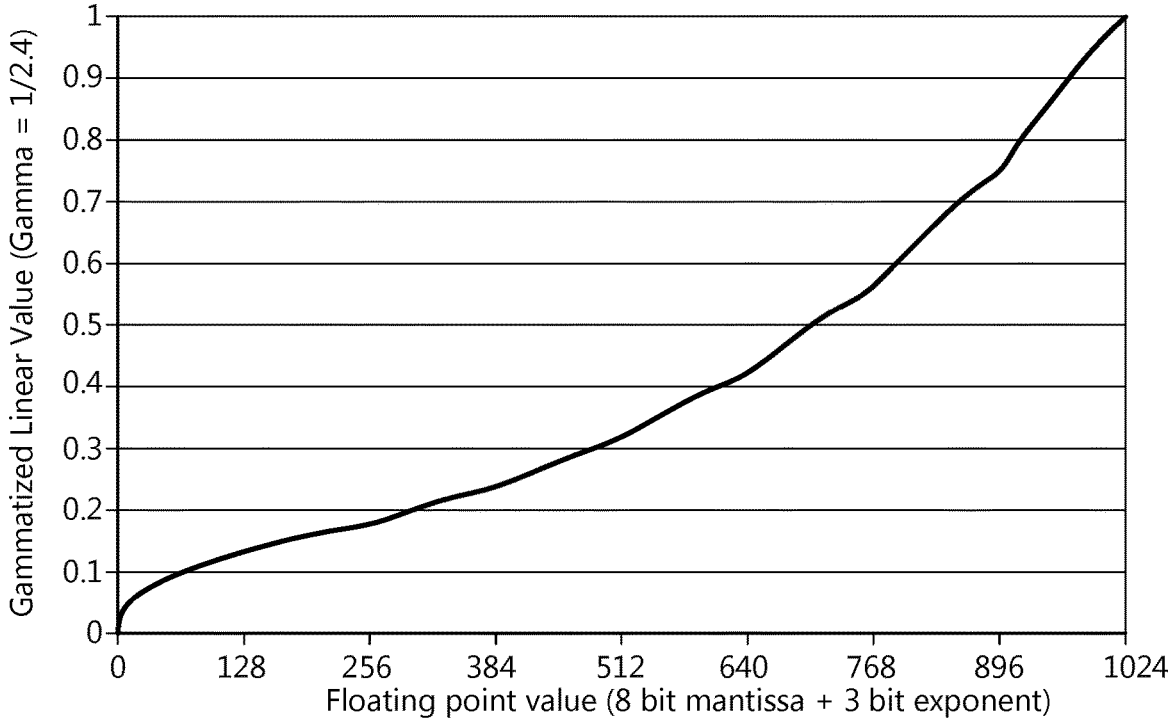
FIG. 9 shows a transfer function of floating point number with 8 bit mantissa and a 3 bit exponent to gammatized integer number (with gamma=1/2.4) conversion.

As the S-LUT is intended to gammatize the image processing system output in order to perform the inverse electro-optical transfer function (EOTF) performed by the display, the above described gamma-like response, which is inherent to the floating point conversion process, is advantageous as it helps to minimize steepness variations of the transfer function to be stored in the LUT as illustrated in FIG. 9.

While the second derivative of the obtained function is clearly discontinuous, the overall transfer function from linear luminosity to gammatized output is very smooth, like illustrated in FIG. 6. This is because the sudden variations in steepness compensate for the precision steps associated to the exponential values within the floating point conversion process. Every single increment (except the first special interval near zero) of the exponent corresponds to a doubled steepness in its transfer function.

The floating point conversion is a very good approximation of a gammatization with a given gamma value as the number of bits to store the exponent has to be a natural number. The higher its value is chosen, the more non-linear the transform becomes. Embodiments of the present invention make use of the advantage of floating point conversion while accepting that the steepness variation can never be eliminated completely within the S-LUT, regardless of the selected floating point number representation.

The floating point conversion provides the advantage of reducing the steepness variation. For example, a gamma transform (with gamma=1/2.4) as in FIG. 6 would have an initial steepness of about 3250 (with 20 bit input values) near the black level and a steepness of 0.417 near white, which is a very large variation. The floating point addressed gamma transform of a floating point to gammatized linear value conversion in FIG. 9 has an initial steepness of less than 18 (with 20 bit input values to the floating point converter) just above the black level and a steepness of 0.295 towards white, which results in a much more reasonable variation and represents a significant advantage.

This reduced steepness swing is also an advantage to ensure smooth grey tracking without adding a lot of DSP power (e.g. for interpolation between too widely spaced points) and block RAM (i.e. Random Access Memory to store LUT content). In other words the floating point encoding process is advantageous to keep the modular image processing system affordable.

Hence, the floating point representation provides the advantage of improving the accuracy and the smoothness of the system while reducing the resource cost and the power dissipation, thereby enabling the processing of higher resolution imagery within practical processing engines such as FPGA devices. The floating point representation also has an effect upon the construction of display devices which are thereby constructed to store and manipulate (address, code and decode) such floating point representations.

While the inexpensive and compact floating point number representation as illustrated in FIG. 7 is capable of perfectly preserving dark grey details near the black level, in an embodiment a smooth transfer function near the white level can be improved by reducing the width of the sampling positions on the horizontal axis.

For example, in one embodiment of the present invention, applying piece wise linear interpolation to pairs of successive read data values overcomes this limitation near the white level. Hence embodiments of the present invention, by using the combination of floating point address encoding and piece wise linear data interpolation an extremely accurate and smooth gray tracking implementation can be achieved. By making use of an image processing library, this embodiment has the ability to accurately preserve and correctly represent all color and grey level detail. This includes the knowledge of how to accurately preserve grey level details in the most affordable implementation. In one implementation of this embodiment interpolation is performed by linear interpolation for 1-dimensional transfer functions. This respects practical block RAM (random access memory) sizes in modern processing engines such as FPGA devices which provide enough storage space to store a sufficient number of points sampled from the transfer function to be performed, assuming a well selected spreading of the "anchor" point positions by an appropriate floating point notation.

Figure 10A:
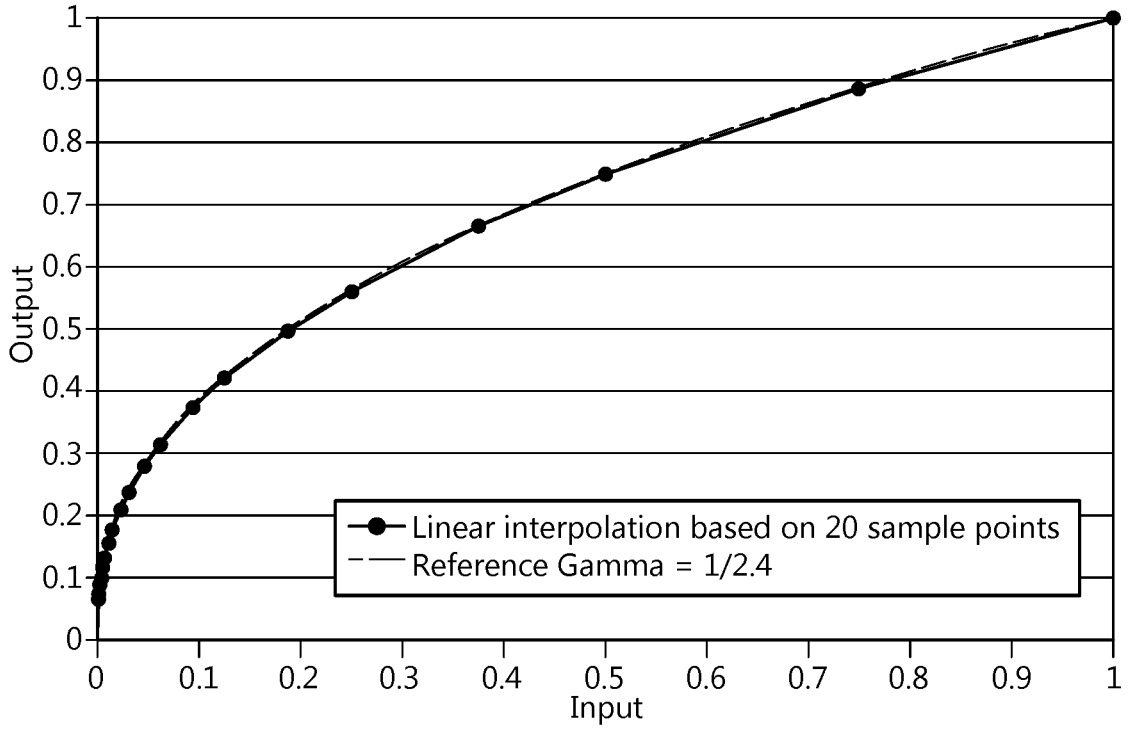
FIG. 10.*a* shows a gammatization function approximated by linear interpolation between 20 equidistantly spread anchor points corresponding to a linear LUT-address.
Figure 10B:
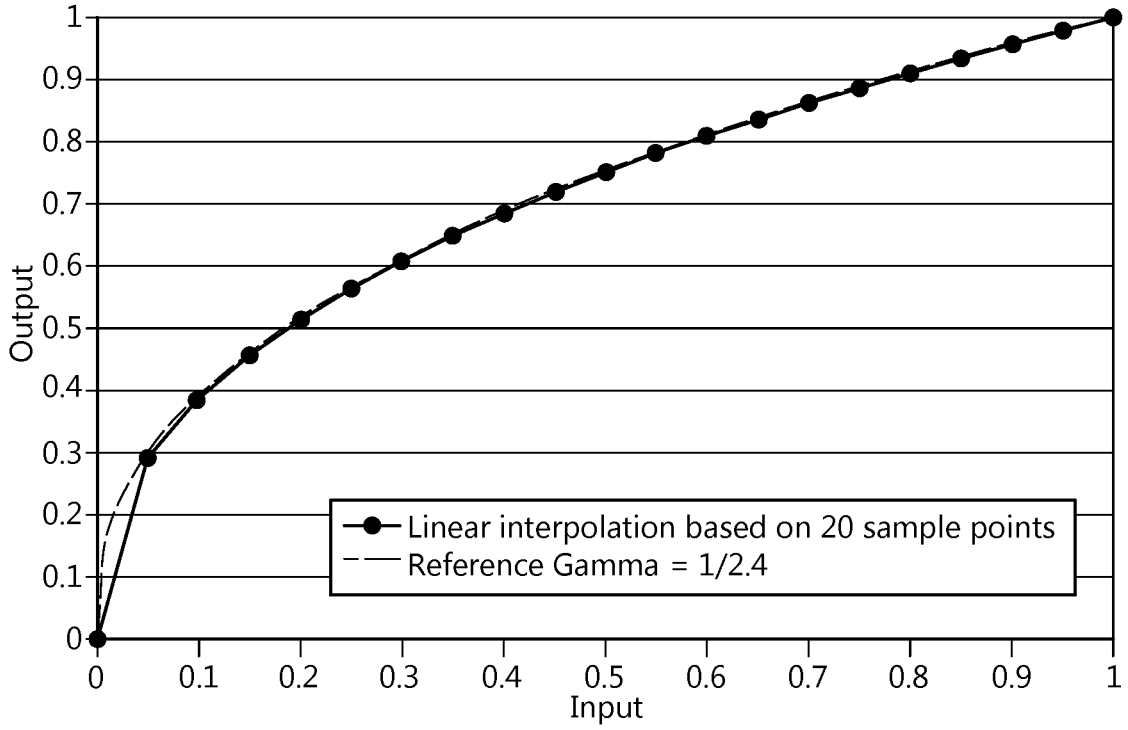

The importance of good anchor point position spreading is illustrated by FIGS. 10.*a* and 10.*b*. In these two examples a gammatization function (with gamma=1/2.4) is approximated by linear interpolation between 20 anchor points. In FIG. 10.*a* these anchor points are spread equidistantly corresponding to a linear read address encoding of the LUT. On the other hand in FIG. 10.*b* the anchor points are spread non-equidistantly corresponding to a floating point number (with 2 bit mantissa) read address encoding of the LUT in accordance with embodiments of the present invention.

As can be evaluated when comparing the 2 transfer function approximations in FIGS. 10.*a* and 10.*b*, the equidistantly spread set of samples of the gammatization function shown in FIG. 10.*a* allows for a good reconstruction (marked as the solid line) of the exact gammatization function (marked as the dotted line) in most parts of the curve, except near the black level, where the relative linear reconstruction error is as high as 61% at the dark grey level which corresponds to 1% luminosity.

Complementary to the non-equidistantly spread set of samples by converting the linear value to a floating point number with a 2-bit mantissa as used in embodiments of the present invention, the gammatization function shown in FIG. 10.*b* allows for a nearly as good reconstruction of the exact gammatization function in the brightest parts of the curve, but allows for a much better reconstruction near the black level where the relative linear reconstruction error is now virtually zero. The worst case relative linear reconstruction error occurs between the points sampled at the positions 0.5 and 0.75 where reconstruction error is still kept below 0.5%.

The numbers and examples chosen above are for illustrative purposes to highlight the influence of the number format and thus the anchor point spreading on the modular image processing system accuracy as used in embodiments of the present invention but relate to a selection of a specific implementation and are not limiting. With real world sized LUTs (for instance with 1024 addresses) the dark grey tracking can be improved dramatically by using a floating point number notation to address the LUT. In fact the amount of improvement is similar to the above illustrated reconstruction error reduction, but the dark grey area can be reduced. In other words the improvement is similar but for a smaller number of dark grey levels.

Figure 11:
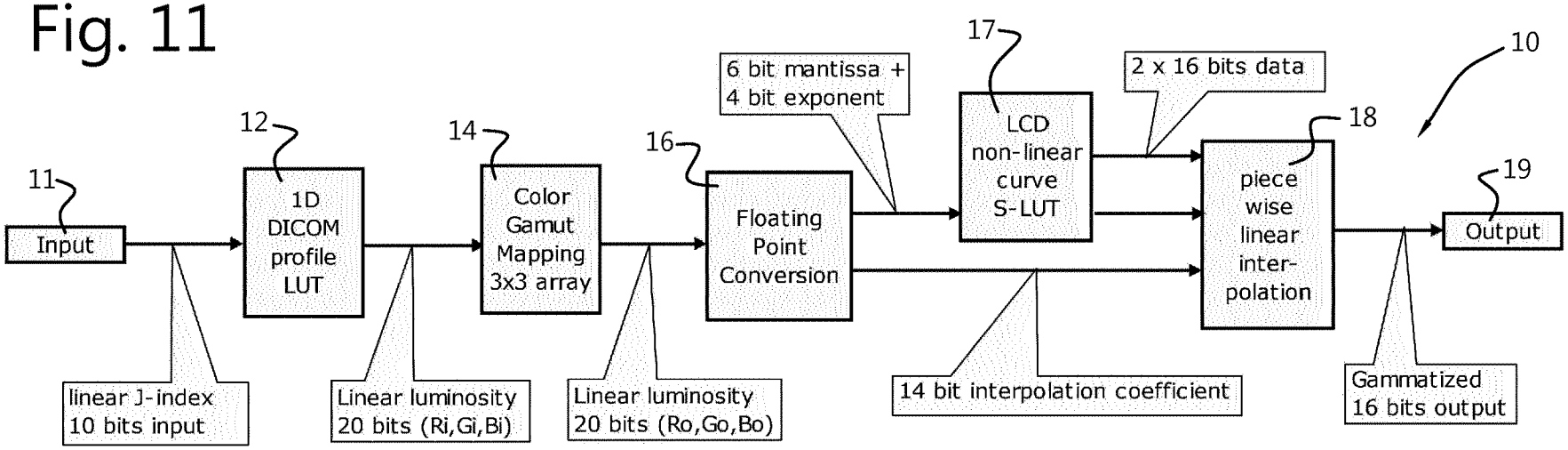
FIG. 11 shows an image processing path with floating point number representation.

In a further embodiment of the present invention, a hardware implementation 10 such as suitable for a processing engine such as an FPGA based hardware implementation with an accurate and smooth DICOM compliant transfer function is illustrated in FIG. 11. This hardware implementation can be in the form of one or more processing blocks, this processing block or blocks comprising, for example one or more processing engines such as FPGA's or microprocessors adapted to run software, i.e. computer programs for carrying out the functions as well as associated memory both random access and non-volatile memory as well as addressing, coding and decoding devices, busses and input and output ports.

The input of images or video stream, i.e. an N bit signal for example a 10 bit input signal 11 is processed by a 1D DICOM profile function (processing block), the relevant transfer function for which can be provided by a 1 dimensional LUT 12 in memory or arithmetic and/or algebraic processor. The processed output is linearized as to luminosity, e.g. an N+10 bit signal such as a 20 bit RGB signal. The RGB signal is an input for further processing using a processing block and a colour gamut mapping array 14, e.g. a 3×3 gamut array in memory. The output is an N+10 bit signal such as a 20 bit signal with linearized luminosity and tristimulus values ($R_O$, $G_O$, $B_O$). In a further processing step 16, a floating point conversion (processing block) is carried out.

One output is a floating point representation of N bits, e.g. with a 6 bit mantissa and a 4 bit exponent which is processed in a processing step 17 (processing block) using a non-linear S-LUT, the output being 2×N+6 bit e.g. a 2×16 bit data signals. These two outputs are supplied to a piece-wise linear interpolation step 18 (processing block). Another output of the floating point conversion step 16 uses an N+4 such as a 14 bit signal to supply interpolation coefficients to the piece-wise linear interpolation step 18. The final output 19 from the piece-wise linear interpolation processing block is a gammatized N+6, e.g. a 16 bit signal.

These numbers for the required accuracies were calculated in order to comply to the DICOM standard, in this case. In order for each quantizing interval to have a dL/L tolerance below 15%, 20 bits are required based on a 10-bit signal. For other standards other numbers may apply.

The embodiment in FIG. 11 implements a gammatization LUT 17 in memory with, for example 1024 entries (e.g. optionally same size as input DICOM LUT 12) by combining 6 mantissa bits (providing 7 bit total significand accuracy) and 4 exponential bits. Thanks to the piece wise linear interpolation 18 (processing block) no grey level detail is lost by the conversion process. The bits which were indicated as 'z' bits in FIG. 7 (i.e. "ignored") can be used for interpolation between the LUT read data.

Uniformity Compensation

Color dependent uniformity processing can be carried out even when displaying grey level imagery. Even when displaying black and white imagery on a color display, there can be the requirement to electronically compensate for the white point color. Often a display needs to match a correlated color temperature of a standard illuminant such as defined by a CIE standard. Examples are D93, D65 or D55 (9300, 6500 or 5500 Kelvin respectively). As all grey levels should have a constant color coordinate in (x, y) space, it is sufficient to define the (x, y) coordinate for the white level. For instance (x=0.2831, y=0.297) matches D93 while (x=0.3127, y=0.329) corresponds to D65, which is "standard daylight".

It is perfectly possible to compensate for the color coordinate, even per grey level individually, by defining the LUT-content (in memory) of the system transfer function for each color component individually. In other words: each color has its own unique LUT with its own unique LUT-content stored in memory that guarantees the measured Y (luminosity) and (x, y) values (correlated color temperature) match the target values for each grey level.

The target Y levels preferably correspond to the DICOM profile (J-index converted to luminosity) while the target (x, y) correlated color temperature is constant, for instance (x=0.3127, y=0.329) to match D65 for all grey levels, including white.

A practical display system does not need to have a constant native white color coordinate. In reality the (x, y) values can vary with the position on the screen due to a variety of causes such as display variations, e.g. a LCD's liquid crystal layer's thickness variations. Other variations can be slight variations in the color filter densities, imperfections within the polarizing filters, the light sources and the optical path including the diffuser within the backlight system . . . .

Due to the spatial variations in (x, y) coordinate, it is not always possible to accurately compensate for the color coordinate within the LUT. Embodiments of the present invention can make use of a separate image processing step requiring some form of non-uniformity compensation e.g. spatial variation compensation.

In accordance with an embodiment of the present invention a first order approach to non-uniformity compensation can be performed by creating a spatial two-dimensional surface per color and then multiplying its value with the video data. This can be done by storing a (e.g. optionally compressed) correction value per sub pixel (e.g. for each of the 12 megapixels individually) within an affordable DDR memory (Double data rate synchronous dynamic random-access memory (DDR SDRAM) and read the values along with the scanning of the video frame. Spatial interpolation techniques can be used as well in order to reduce the calibrated data set to be stored in DDR memory or even completely eliminate the need to add DDR memories and corresponding use of IO (input/output) bandwidth, as the data traffic needed on a processing engine such as on the pins of an FPGA can be a cost driving factor.

In accordance with an embodiment of the present invention an improved non-uniformity can be obtained by performing independent corrections for multiple grey levels. For example, a number of independent corrections such as 8 independent corrections can be defined at a number of grey levels such as 8 grey levels in a range from black to white so that the uniformity can be calibrated nearly perfectly on all grey levels, as piece wise linear interpolation is used in between the well-selected anchor levels. These anchor levels can be set, for example at a range of luminosity levels such as the following (non-limiting) luminosity levels: 0%, 3.125%, 6.25%, 12.5%, 25%, 50%, 75% and 100% of the white level. Embodiments of the present invention include that every sub-pixel has its own individual transfer-function-correction with a number such as 8 addresses corresponding to a number such as 8 non-equidistantly sampled grey levels combined with linear interpolation. The functionality is very similar to the already described embodiments of an OETF (opto-electric transfer function), but with limited content as the content is refreshed per sub-pixel. These non-uniformity-compensation LUTs (in memory) can be implemented per color, so the 3 contents must be refreshed per pixel, which for a 12M pixel display at a refresh rate of 60 Hz corresponds to a LUT refresh rate of 720 million refresh cycles per second.

LCD Cross-Talk Correction Per Sub Pixel

Embodiments of the present invention can be applied to fixed format displays or other display types that exhibit cross-talk between adjacent pixels or sub-pixels. For example, in medical displays of the LCD type, LCD cross-talk correction per sub pixel is preferred even on grey level imagery for two main reasons. Improved picture sharpness and enhanced local contrast are the most obvious effects of compensating the positive cross-talk caused by the spreading of electric fields between adjacent pixels. This is particularly visible on human or animal tissues which have relatively high frequency textures and fine details. A second less obvious, but almost equally important, purpose of cross-talk compensation is to improve the grey tracking accuracy and thus the DICOM compliancy, especially when the display is set to a white point other than its native white point, such as "Clearbase", "Bluebase", "D93" or "D65", but also in native white mode in areas outside the centre of the display that exhibit Cross-talk. This can occur with a display panel such as a LCD panel because the spatially dependent LCD transmission curve and backlight illumination require uniformity compensation, requiring different R, G and B driving stimuli.

In embodiments of the present invention, non-uniformity-compensation can be considered as a spatially modulated grey level dependent white balance. As a consequence the display that exhibits Cross-talk such as a LCD panel receives different stimuli, even for uncolored shades of grey corresponding to equal received R, G and B values. Due to the cross talk between the electrical fields within neighbouring sub pixels of the display such as a LCD panel, the applied color balances are disturbed.

For example the color measured (in XYZ) when the red sub pixel is driven separately does not simply add up with the color measured when only the green sub pixel is driven in order to obtain the color measured when both the red and green sub pixels are driven simultaneously. So even when the black level is subtracted from all measurements, yellow is not the sum of red and green, i.e. the electrical fields are different.

Figure 12:
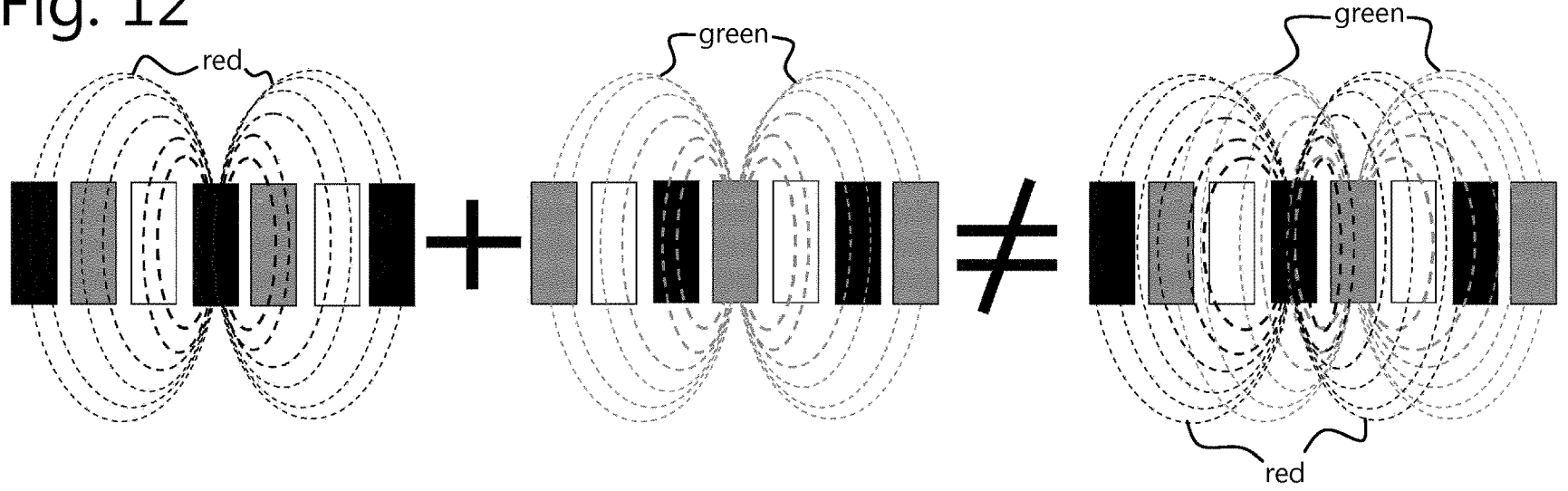
FIG. 12 shows Individual electrical fields of R+G sub pixels versus combined.

In FIG. 12 the red sub-pixels are black, the blue sub-pixels are white and the green sub-pixels are grey. With reference to FIG. 12, let us assume, in a first row segment of a color display, a single red sub pixel is illuminated, in the second row segment an isolated green pixel is illuminated while two adjacent sub pixels are activated in the segment to the right. The dotted lines in FIG. 12 represent the electrical fields, while their thickness represents the force or the density of the lines. Note the asymmetrical spreading of the fields associated with the two red and green sub pixels due to the two repelling adjacent fields.

Due to the physical complexity of the Cross-talk artefact caused by neighbouring non-homogeneous electrical fields slightly changing their shapes and slightly attracting or repelling each other (see FIG. 12) and thus altering the wave length dependent sub pixel apertures, a practical compensation system is a multidimensional LUT per sub pixel (in memory) including some piece wise interpolation in a processing block. The required number of dimensions depends on how large the neighbourhood of sub pixel is, in other words how widely spread the electrical fields are that need to be considered and allowed for.

Figure 13:
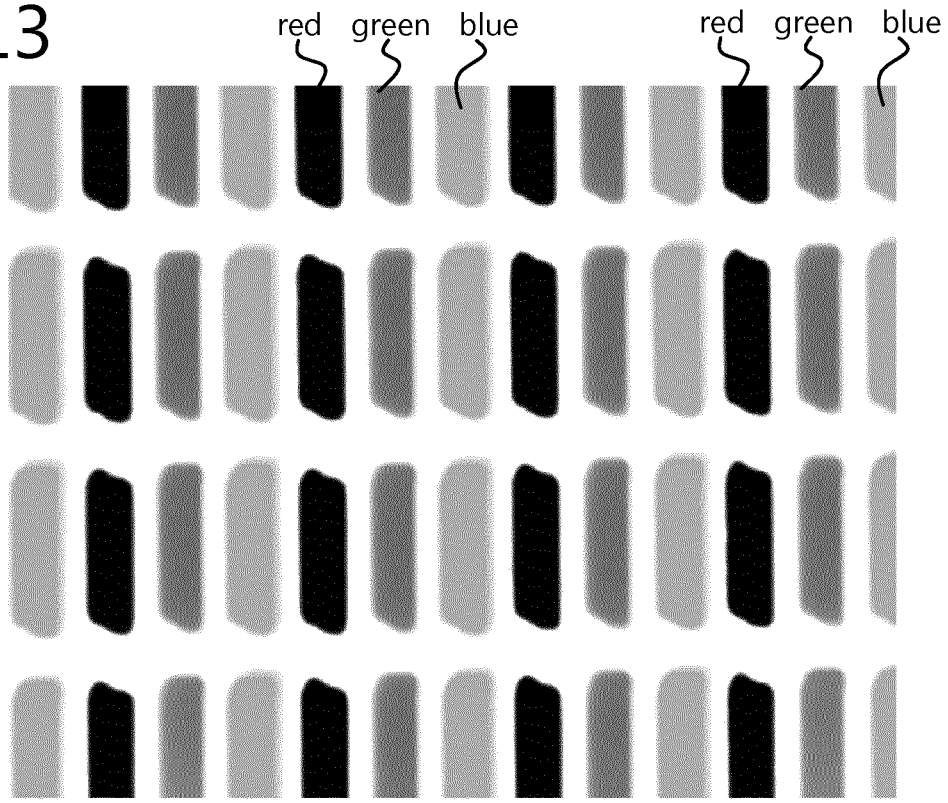
FIG. 13 shows a sub pixel arrangement of a typical twisted nematic LCD panel.

A first order approximation would require the information of all sub pixels in both dimensions adjacent to the sub pixel to be corrected: the sub pixels to the left, right, top and bottom combined with the sub pixel data to be processed. This would require a 5-dimensional LUT per output color. However, most practical LCD panels have a (sub) pixel arrangement similar to FIG. 13 which shows red sub-pixels as black, green sub-pixels as dark grey and blue sub-pixels as light grey.

As pixels usually have nearly square dimensions, and a pixel is made up of a number of sub-pixels such as red, green and blue sub-pixels alongside each other, the sub-pixel areas can be considered as being more rectangular that square (see FIG. 13) but they make a pixel that is more square (see FIG. 13) in the combination of the sub-pixels. Although this is often a rough approximation to describe the true sub pixel shapes, it is most often fair to say that sub pixels per color can better be considered as rectangular rather than square. Therefore, the distance between most of the electrical field lines of sub pixels adjacent in one direction such as the horizontal dimension is much smaller than the distance between the majority of electrical field lines in an orthogonal direction such as for vertically adjacent sub pixels. The space in between the sub pixels is also usually larger in one direction such as between the rows versus in an orthogonal direction such as the columns and on top of this the pixel edges which can interact are smaller vertically than horizontally. All this leads to the conclusion that sub pixel cross talk is mainly a phenomenon which occurs in one cross talk direction such as the horizontal dimension within the rows.

Adjacent pixels influence each other's fields the most. A first order approximation therefore requires only the information of sub pixels within one cross talk direction where appropriate one of either column or row, e.g. the row, which are adjacent to the sub pixel to be corrected: the sub pixels to the left and right combined with the sub pixel data to be processed. This requires only a 3-dimensional LUT per output color stored in memory.

Note that in embodiments of the present invention the corrected green sub pixel drive level can be calculated from R, G and B stimuli within a single pixel. However, in order to calculate the corrected red sub pixel drive level, the B stimulus of the pixel located one step in the cross talk direction, e.g. to the left should be considered together with the R and G stimuli of the currently processed pixel. Similarly, in order to calculate the corrected blue sub pixel drive level, the R stimulus of the pixel one step in the cross talk direction, e.g. to the right needs to be combined with the G and B stimuli of the currently processed pixel. In other words the 3-dimensional LUT per output color effectively acts as a non-linear 3-taps filter per color of which the filter kernel associated to the tap positions is shifted per sub pixel.

The larger the kernel size is selected, or equivalently the more dimensions are fed to the LUT (in memory), the smaller the details which can be represented perfectly. For smaller or lower resolution or lower quality displays, it can be beneficial to increase the Cross-talk filter kernel.

Figure 14:
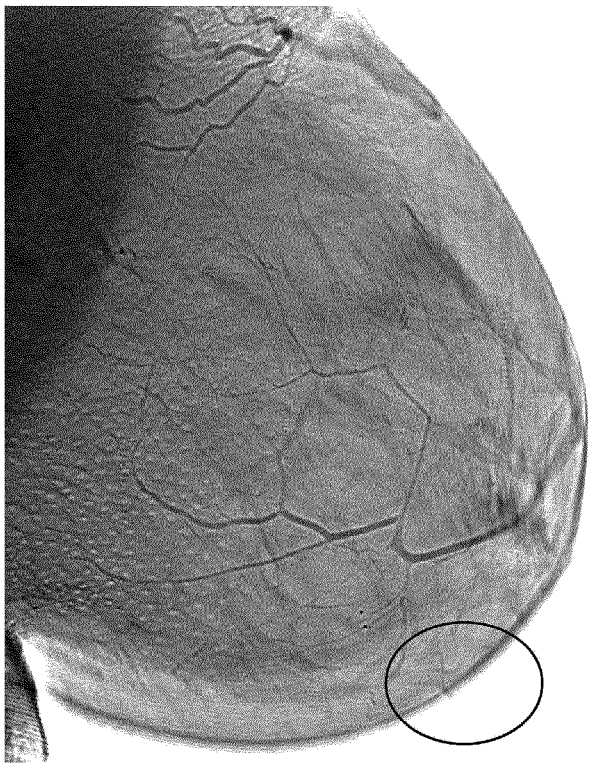
FIG. 14 shows micro-calcifications in breast pathology (in circle).

A display for medical use is preferably based on a high quality display panel such as a high quality LCD panel so that even the tiniest features are represented by implementing a 3-dimensional LUT, providing a well selected distribution of a sufficient number of anchor points and assuming a virtually lossless dithering algorithm in order to map the highly precise grey scale levels to the LCD panel. For instance in mammography, searching for typically sized micro-calcifications with diameters ranging from 4 to 7 pixels requires the display to accurately represent these grey level details as illustrated in FIG. 14.

Figure 15:
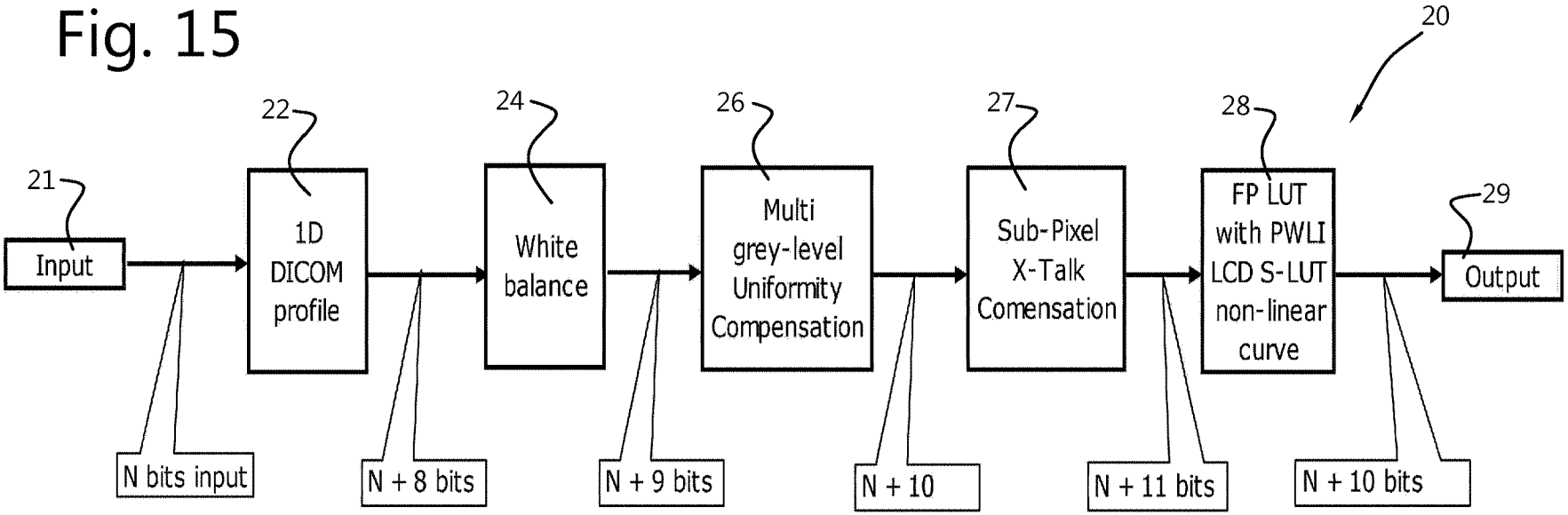
FIG. 15 shows an image processing path to ensure smooth and accurate grey tracking.

It has been shown that such micro-calcifications can be detected more reliably when the grey scale representations of these tiny details are on target according to the DICOM standard, which can only be achieved when some or preferably all earlier described image processing steps are performed, even when the display is built on a high quality (10 bit) LCD panel, as illustrated in FIG. 15. This hardware implementation can be in the form of one or more processing blocks, this processing block or blocks comprising, for example one or more processing engines such as FPGA's or microprocessors adapted to run software, i.e. computer programs for carrying out the functions as well as associated memory both random access and non-volatile memory as well as addressing, coding and decoding devices, busses and input and output ports.

Referring to FIG. 15, the input of images or video stream, e.g. a N bit input signal 21 of a panel 20 is processed by a 1D DICOM profile function 22 (processing block). The processed output is e.g. an N+8 bit signal. This signal is then input for a white balancing step 24 (processing block). The output is an N+9 bit signal supplied for a multi-grey-level uniformity compensation in a further processing step 26 (processing block). The output of step 26 is an N+10 bit signal that is supplied to sub-pixel Cross-talk compensation step 27 (processing block). Output of this step is an N+11 bit signal which is processed in a further step 28 (processing block) with a LUT (in memory) with PWLI LCD S-LUT (in memory) storing discrete values of a non-linear curve. The output 29 is an N+10 bits signal.

An aspect of embodiments of the present invention is an accurate and smooth representation of all grey levels associated with the input J-index values, everywhere on the display statically. The display processing steps (processing blocks) of FIG. 15 guarantee a good static representation of all grey level details in all areas on the screen, assuming the typically required extra precision of a number of bits such as 10 bits (depending on brightness and contrast) can be represented perfectly on the display panel such as an LCD panel. As will be explained below, further embodiments of the present invention provide dithering algorithms (processing block) based on compressed sensing. These can be provided in addition to the display calibration processing such as grey tracking, non-uniformity compensation and Cross-talk compensation.

3D Color Space Calibration and Grey Tracking for all Types of White

The above described first order cross-talk approximation is as effective in accurately reproducing all colors than any system with a higher number of dimensions, for instance with a 5×5 kernel, given a constant color within a large enough area. Indeed, if all pixels within the large kernel have the same R, G and B values, then it is sufficient to apply a single sub pixel of each input color to the multi-dimensional LUT (in memory).

Therefore a 3D LUT per sub pixel (in memory) allows for good color calibration of a display and thus enables good grey tracking for all possible types of grey, such as D93 or D65. In fact, under the right circumstances virtually every color can be considered as grey, depending on the ambient lighting conditions, for instance. In reality a light source's spectrum needs to be "reasonably close" to the so-called Planckian locus in order to be able to refer to a so-called correlated color temperature or "CCT".

Some examples of light sources illustrate the concept of the CCT:

- a clear blue poleward sky has a CCT between 15000 and 27000 K
- daylight has about 6500 Kelvin (notated as D65)
- an electronic flash is around 5700K
- moonlight is about 4125K
- incandescent lamps are around 3000K
- candle light has a CCT around 1850K.

Figure 16:
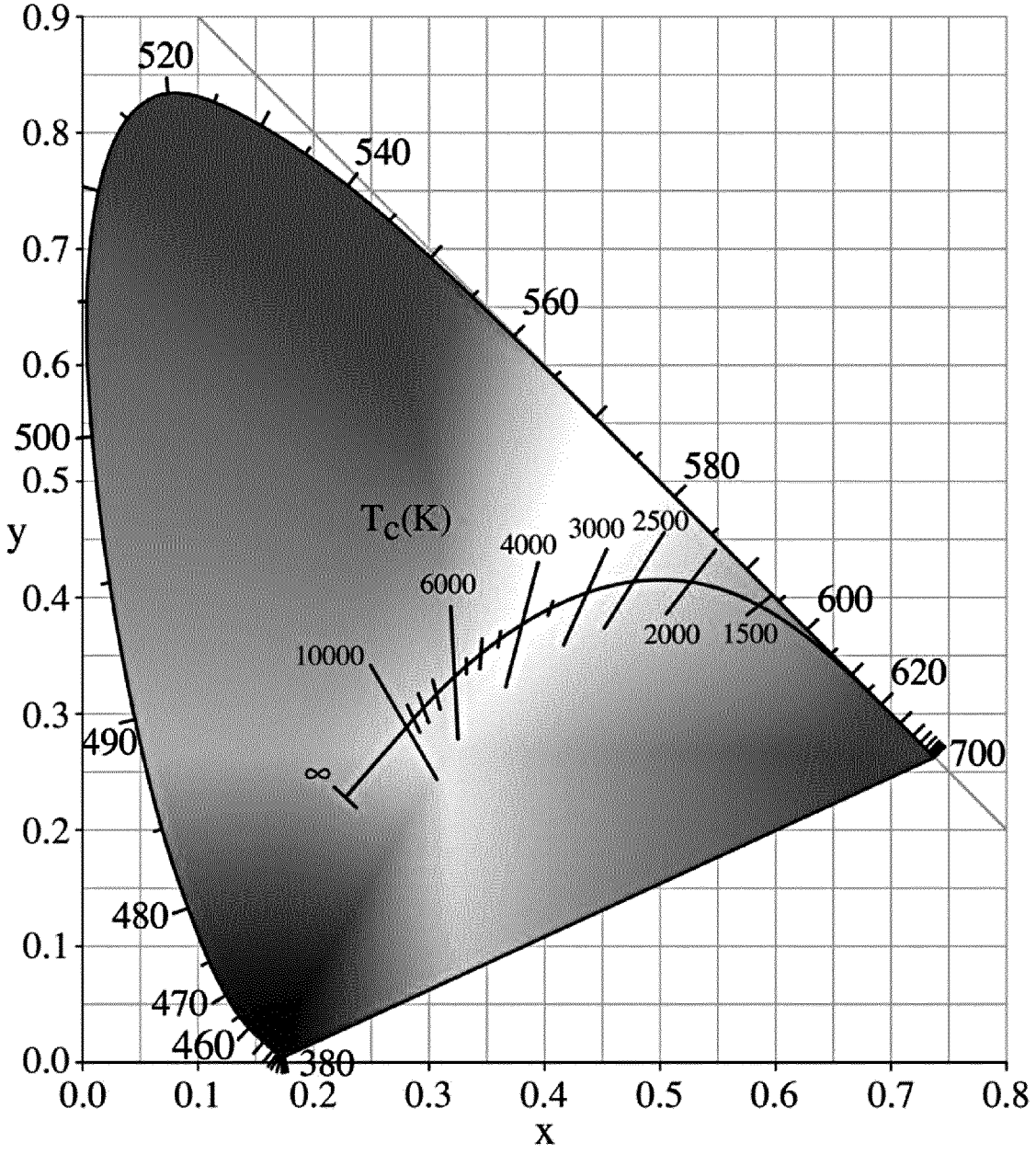
FIG. 16 shows chromaticity of black-body light sources of various temperatures as well as lines of constant CCT shown in Standardized CIE 1931 (x, y) chromaticity space.

All these light sources have a spectrum which is similar enough to the spectrum of an ideal black body radiator with a certain temperature as indicated by the Planckian locus, which is the curve connecting the (x, y) coordinates corresponding to black-body light sources for various temperatures expressed in Kelvin as shown in FIG. 16. All these sources (x, y) coordinates are in the region where lines of constant CCT (also indicated in FIG. 16) can be meaningfully defined.

A fully calibrated display, in which all colors match their target XYZ stimuli, is therefore equivalent to a display system in which all possible types of white match their target (x, y) color and in which all corresponding grey levels are the correct fraction of that white luminosity, according to the desired transfer function.

In the case of a DICOM compliant display the above statement translates to: for every input value representing a quantized J-index, given a white and black level, the luminosity must correspond to the DICOM transfer function (as expressed in Equation 1) while the (x, y) color coordinate must remain constant and match the white point, for instance D65. This calibration concept is illustrated in FIG. 17.

Figure 17:
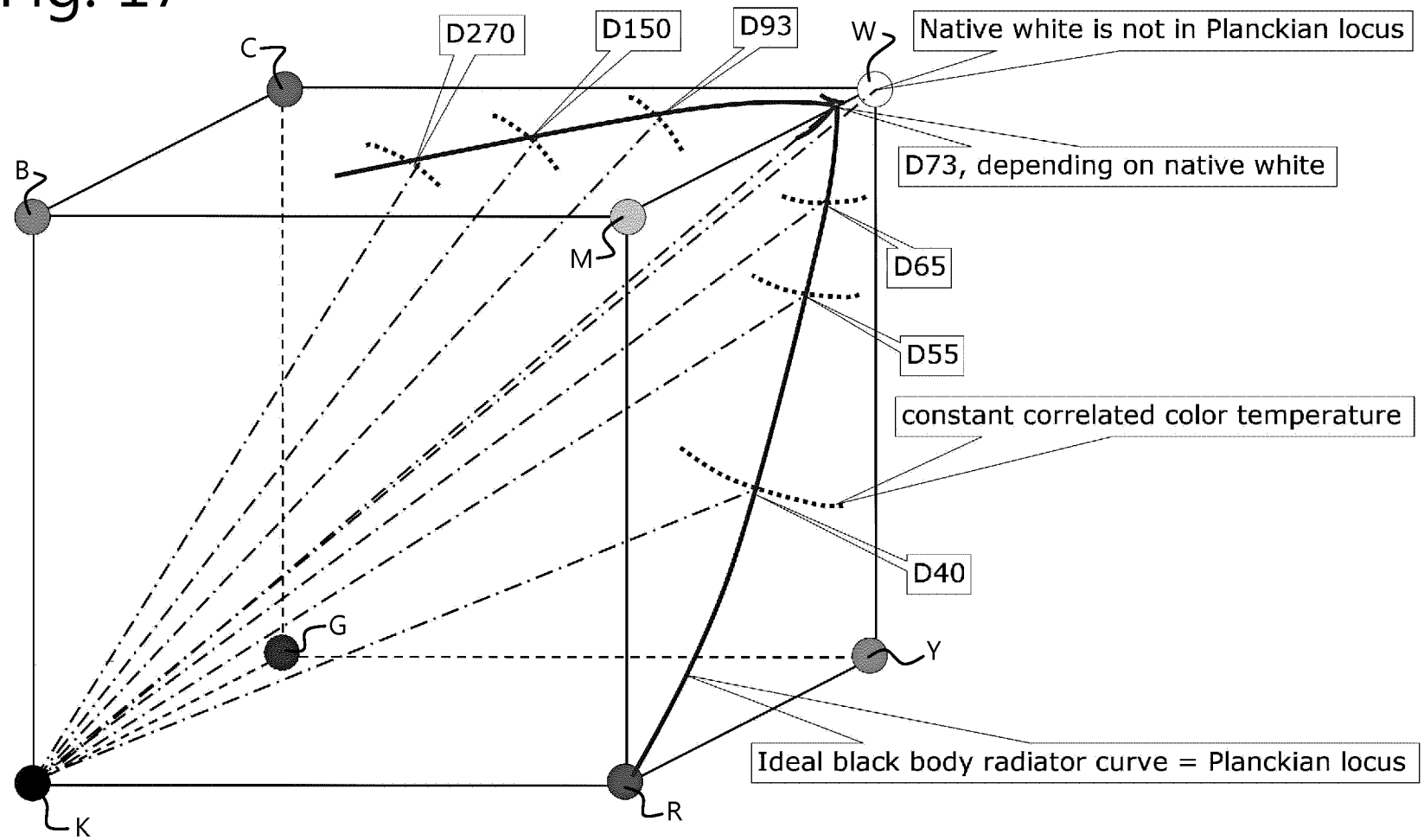
FIG. 17 shows perfect grey tracking for various types of white.

FIG. 17 illustrates grey tracking for various types of white in accordance with an embodiment of the present invention. The coordinates corresponding to the different color temperatures are approximated to fit well in the drawing. Values for a practical example are provided in the table of FIG. 19 for one production unit of a display.

Ideally for every grey input value located on the dashed lines connecting the black point (k-point) with the target white points (e.g. D40, D55, D65, D73, native white) in FIG. 17, the (x, y) color coordinate equals the chromaticity of the selected white point. These white points are all located on the surface of the RGB color cube (R=red, G=green, B=blue, C=cyan, M=magenta, Y=yellow, K=black, W=white) shown in FIG. 17 as the drive levels can be normalized when applying the correct backlight luminosity.

Dark Grey Chromaticity Tracking

Near the black level the (x, y) coordinate changes towards the native black color when native black and white chromaticities don't match. Depending on the use case one of the following types of solutions is preferable with respect to embodiments of the present invention:

- The black color is adjusted to match the white chromaticity. This involves raising the black level and thus results in loss of display contrast, which is not preferred.
- The grey tracking is perfect starting from a certain luminosity level, for instance 5% relative to white. In this range the (x, y) value remains constant. Between black and 5% some interpolation is used, but the luminosity steps remain on target.
- Grey tracking is defined as a linear interpolation (according to the transfer function) between the black XYZ and the white XYZ. This means each grey level has a unique chromaticity, but it changes smoothly with the grey level (see FIG. 18).

A linear interpolation between the XYZ tristimuli values of the black and white points does not correspond to a linear evolution of the (x, y) chromaticity coordinate throughout the luminosity scale. As the white level is much brighter, its contribution to the (x, y) coordinate quickly becomes more significant compared to the black level. Practically, in a high contrast display the chromaticity of the white point is nearly perfectly achieved at a luminosity level as low as 1% of the white level, as illustrated in the chromaticity tracking plot in FIG. 18 which shows dark grey chromaticity tracking (x, y) obtained by linear mixing of black and white. Note that only the darkest 5% levels are plotted to reveal the curves from the black chromaticity to the brighter luminosities.

Figure 18:
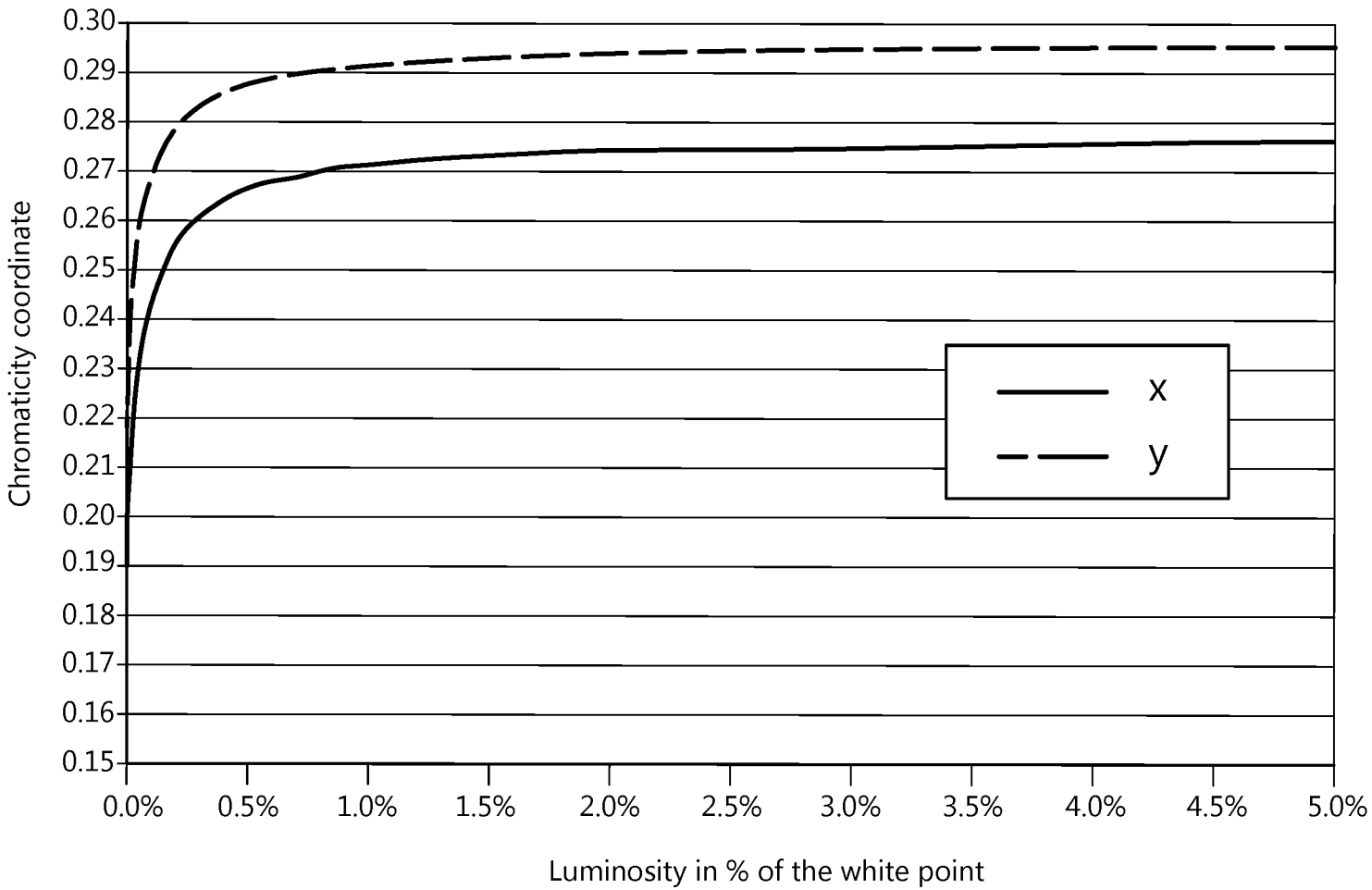
FIG. 18 shows dark grey chromaticity tracking by linearly mixing black and white.

In FIG. 18, the dark grey chromaticity tracking starts at the black point, which was measured for a practical production unit at (x=0.197, y=0.232) with a luminosity of 0.61087 Nit. The x- and y-curves quickly and asymptotically transition to the measured native white chromaticity (x=0.277, y=0.296) with a luminosity of 1000 Nit at 100% drive level. Most of the transition happens within the darkest 1%. In the example illustrated here, chromaticity is visibly different at luminosity levels below about 3 Nit. Above 3 Nit an observer will not be able to see the difference in chromaticity with the full white level.

A perceivable (dark) grey tracking requires sufficient precision within the image processing blocks, which can be achieved by the floating point representations described earlier, and embodiments of the present invention require no further specific attention in addition.

White Balance on Linear Luminosities

A high precision is preferred for the white balance processing step 24 (processing block) of FIG. 15 based on linear luminosities in order to preserve perfect grey tracking. A display with a back light such an LCD display includes a backlight and this backlight can be based on white LEDs. Accordingly, the correlated color temperature is preferably adjusted, e.g. by modulating the white balance, equivalent to balancing the red, green and blue drive levels representing the corresponding linear luminosities.

Each type of white corresponds to a certain (x, y) color coordinate which can be obtained by mixing (e.g. equivalent to interpolating between) the native red, green and blue (x, y) color coordinates.

Note that every desired white point can be achieved by driving at least one color at 100% of its maximal luminosity, effectively leaving the dynamic range for that color component unaffected. The corresponding normalized set of R, G and B drive levels is possible because the backlight luminosity can be controlled, as indicated in the right column of FIG. 19. For this type of backlight technology, this technique guarantees an optimized display contrast for each white point.

Native chromaticity of displays in accordance with embodiments of the present invention can be close to the so-called "clearbase" standard, which means all 3 native colors can be driven close to 100%: 96.9%, 100% and 93.3% for R, G and B respectively. In such a case, the LCD backlight needs to output 1227 Nit in order to obtain 1000 Nit of measured luminosity. This extra backlight luminosity is mainly required in order to compensate for the LCD panel's non uniformity and only partially in order to compensate for the reduced "drive levels" of the red and green sub pixels.

When the display is set to a color temperature of 5000 Kelvin, the red channel is driven at 100%, but the green channel drive is reduced to 62% and the blue channel drive is only 34.6%. As the average drive levels are much more reduced in such a case, the backlight preferably provides much extra light (e.g. 2094 Nit) to achieve 1000 Nit again. As increasing the luminosity level of the backlight proportionally increases the quantizing intervals of the grey level representation within the image processing, doubling the backlight light output roughly requires an extra bit to represent the luminosities of the R, G and B stimuli to preserve the accuracy and the smoothness of the grey tracking, assuming the doubled black level does not correspond to too many J-index values.

An image processing path (processing blocks) of a panel in accordance with an embodiment of the present invention designed to ensure smooth and accurate grey tracking, as illustrated in FIG. 15, should therefore preferably add at least 1 bit of precision when performing a white balance, in order to guarantee the same quality standards for different selected white points, such as Bluebase or D65.

As non-uniformity compensation (processing block) can be considered as a grey level dependent, spatially modulated white balance, the same statement holds here: some extra precision is preferably added. By characterizing the spatial luminosity fluctuations, it is possible to calculate the amount of extra bits required. However, in reality these fluctuations are typically in a range of 70% to 100% for a high quality LCD panel illuminated by a reasonable backlight design. For example, the grey tracking can be preserved by adding 1 additional bit of accuracy in the video signal path, as indicated in FIG. 15.

A similar reasoning can be used for defining the required accuracy by the cross-talk compensation processing step and block 27 in FIG. 15. By characterizing the color aberrations caused by unequal driving voltages (and corresponding electrical fields), it is possible to calculate the amount of extra bits required to perform the non-linear (3D) transform within the multi-dimensional LUT and during the piece wise interpolation processing step (processing block) 18 of FIG. 11. Practically, the grey tracking can be preserved by adding 1 additional bit of accuracy, assuming that the used interpolation method is well defined and a sufficient number of anchor points are well spread in the multi-dimensional space.

These combined processing steps (processing blocks) ensure that a chromaticity tracking similar to the curves illustrated in FIG. 18 can be achieved for all white points (dotted lines marked D40, D55, D65, D73) corresponding to the dotted grey tracking lines in FIG. 17 everywhere on the display.

Precision Required by the DICOM Calibration Processing Step

The largest number of bits added by any modular processing block in the image processing chain illustrated in FIG. 15 is associated to the 1D DICOM profile because of the low steepness in some parts of the transfer function as illustrated in FIG. 1

For example, in accordance with an embodiment of the present invention the content of the DICOM LUT (in memory) can be calculated based on the 3 conversion steps as defined in Equation 2:

Step 1: First the normalized integer multibit, e.g. 10-bit input (the read address) is converted to a real (non-integer) J-index value by taking into account the J-index values for the black and white levels. The first step (processing block) can be considered as a de-normalizing process compensating the luminosity and the contrast.

Step 2: Secondly the DICOM transfer function converts (processing block) J-index values into luminosity values, using the formula defined in Equation 1.

Step 3: Finally the real (non-integer) luminosity is converted (processing block) to a normalized N-bit integer value (the read data value) by considering the luminosity levels for the black and white levels.

*1D DICOM* Transfer function illustrated for 10-bit input, *N* bit output $$J = JfromI(\text{Input}) = J_{black} + (J_{white} - J_{black}) \cdot \frac{\text{Input}}{2^{10} - 1} \qquad \text{Equation 2}$$

$$J = LfromJ(J)$$

$$\text{Output} = OfromL(L) = \frac{L - L_{black}}{L_{white} - L_{black}} \cdot O_{white}(N)$$

By combining the 3 steps in Equation 2, a conversion (processing block) from an integer to an integer value is obtained. The number of output bits N can be calculated based on the quantizing interval linearity tolerance specification. In case the DICOM LUT (in memory) is configured as a stand-alone module without considering further image processing blocks then the normalizing process can be easily defined by applying the result of Equation 3 to Equation 2.

$$O_{white}(N) = 2^N - 1$$

Equation 3—sub-optimized DICOM LUT data normalization based on white level

Figure 2:
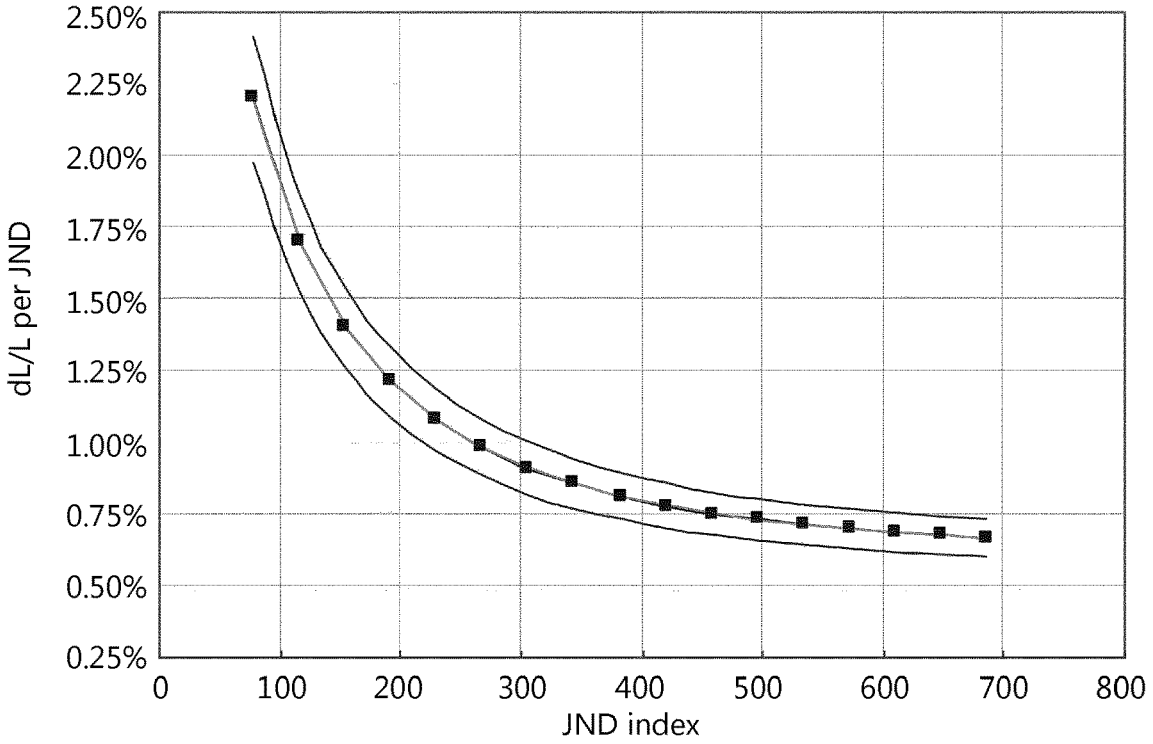
FIG. 2 shows a DICOM Gray Scale Standard Function Compliance Check Example.
Figure 3:
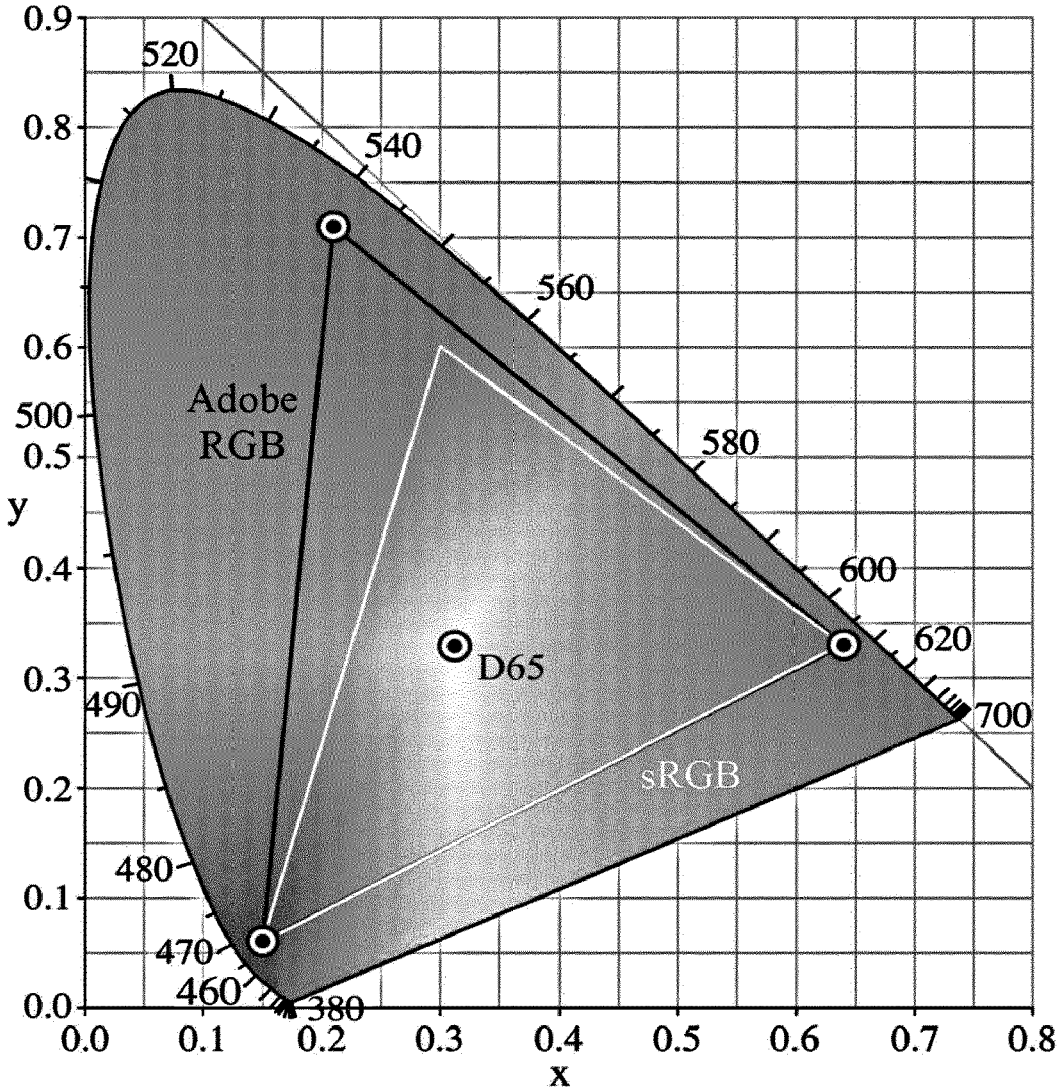
FIG. 3 shows sRGB (camera source) versus Adobe RGB (display) color gamut and D65 white point.
Figure 4:
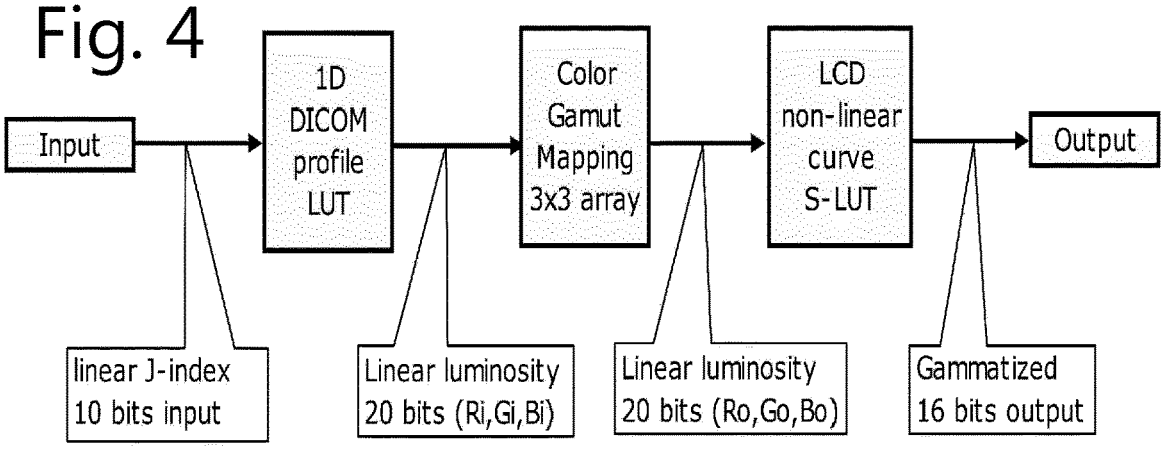
FIG. 4 shows a simple modular image processing path.

In order to preserve the dL/L metric as illustrated in FIG. 2 for the full modular image path, this straight-forward approach to calculate the integer read data value corresponding to white is insufficient to achieve the DICOM specification requirements for the full image processing path. Equation 3 leads to a less preferred, e.g. sub-optimized module and not to an optimized system because the associated excursion would need to be remapped to accommodate the excursion available at the input of processing blocks located further in the image processing path.

Each remapping process modifies the integer number representing the white level. The white level is not always represented by an N-bit value in which all bits are equal to '1', as Equation 3 suggests. While this might be true for the "normalized" display input value, where a 10-bit value of 1023 (for red, green and blue inputs) corresponds to full white, regardless of the target luminosity and chromaticity, such is not the case for look up table functions that include piece wise (linear) interpolation.

To illustrate this embodiment, consider the image processing path in FIG. 15 again and apply 2 assumptions to the schematic flow:

1) It is descried to preserve grey tracking as perfectly as possible when the display is set to its native white point. Therefore the white balance processing block 24, which is the next block in the chain after the DICOM profiling block 22, should not alter the significant video data in this case. This block multiplies the value by two, as it needs to add 1 bit of precision to preserve grey tracking in other cases. This means the white balance feature does not impact the (calculation of) excursion in Equation 3, indicated as $O_{white}$.
2) Non-uniformity compensation (block 26 in FIG. 15) does not impact the white level in the darkest area of the display, because all other brighter areas are processed to match the "nearly" darkest area, depending on the uniformity target specs. This means the non-uniformity compensation feature (block 26 in FIG. 15) does not impact the excursion calculation ($O_{white}$) because the unaffected areas correspond to the highest video levels representing white. This processing block 26 also multiplies the unaffected values by two to preserve precision, but the significant bits remain unaffected.

This means the input excursion of the cross-talk compensation (as this is the next block 27 in the processing chain of FIG. 15) must be taken into account to calculate the value of $O_{white}$. As described before, the cross-talk compensation (block 27 in FIG. 15) can be implemented by using a 3D LUT per output sub-pixel (in memory), the embodiment as illustrated in FIG. 20.

Figure 20:
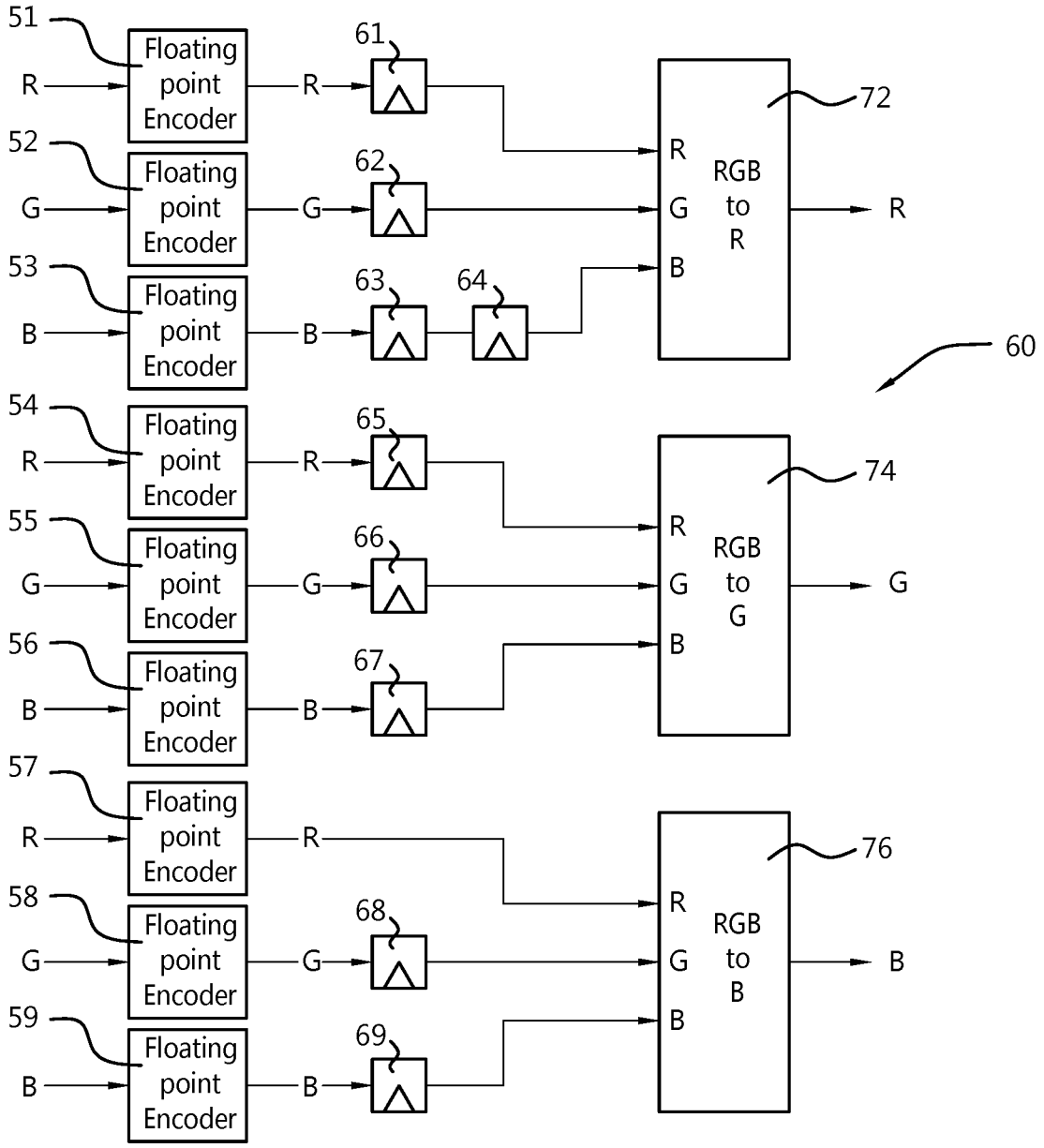
FIG. 20 shows cross-talk compensation per sub-pixel based on 3 successive sub-pixels.

FIG. 20 represent a circuit 60 for RGB sub pixel processing of a video source It assumes the video images are scanned in a traditional way from left top to the right bottom. It also assumes that 1 pixel is received (and processed) every clock cycle. This means every clock cycle a new pixel is received which is located to the right of the previously received pixel, the only exception being the first column of pixels, which is not considered here for cross-talk compensation. So when a pixel is received "somewhat in the middle" of the image, then the next clock cycle the neighbouring pixel to the right is received.

In a first step all 3 color components per input pixel are converted (processing blocks 51 to 59) to a floating point representation, for instance having a 3 bit exponent value. In a second phase, the sub pixels are aligned with their closest neighbours as these mainly determine the X-talk artifacts, as illustrated in FIG. 12, due to the neighbouring electrical fields.

As for a given pixel, the red subpixel is located closest to the green subpixel within the same pixel (to the right side) and the blue subpixel of the previous pixel (to the left), the blue sub pixel component must be delayed (register 64) 1 clock cycle extra, compared to the 2 other sub pixel components. This is reflected in the upper part of the scheme by the fact that 2 registers (63, 64) are inserted in the blue color component path, while only 1 register (61, 62) pipelines the red and green sub pixel components.

Similarly, for a given pixel, the green subpixel is located closest to the blue subpixel within the same pixel (to the right side) and the red subpixel of same pixel (to the left), all sub pixel components must be delayed equally. This is reflected in the center part of the scheme by the fact that only 1 register (65-67) are inserted in all color component paths.

Complementary, for a given pixel, the blue subpixel is located closest to the red subpixel of the next pixel (to the right side) and the green subpixel of the same pixel (to the left), the red sub pixel component must be delayed 1 clock cycle less, compared to the 2 other sub pixel components. This is reflected in the lower part of the scheme by the fact that no register is inserted in the red color component path (path 57 to 76), while 1 register (68, 69) pipelines the blue and green sub pixel components.

In a final step each color component, together with its closest neighbouring sub pixel components, is applied to a 3D function (processing blocks 72, 74, 76), usually implemented in a 3D LUT with piece wise interpolation, such as tetrahedral interpolation. The content of this LUT is determined by the cross-talk calibration process.

Figure 21:
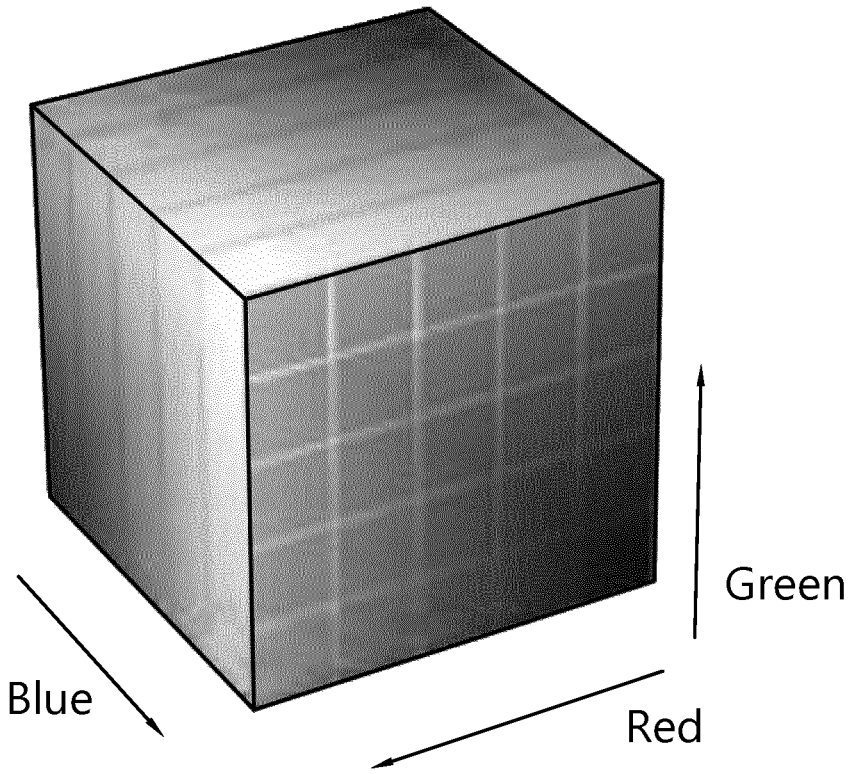
FIG. 21 shows an RGB color cube subdivided into smaller cubes between the anchor points where local interpolation is applied.

As to be understood from FIG. 20, a corrected value for each output sub-pixel is calculated based on its original floating point encoded value combined with the original floating point encoded values of its two neighbours. As the LUT input is 3-dimensional, the number of anchor points is preferably constrained to fit inside a practical (e.g. FPGA) processing engine. The color cube is preferably subdivided into smaller local cubes with their corners defined by the 3D LUT anchor points as illustrated in FIG. 21.

Figure 22:
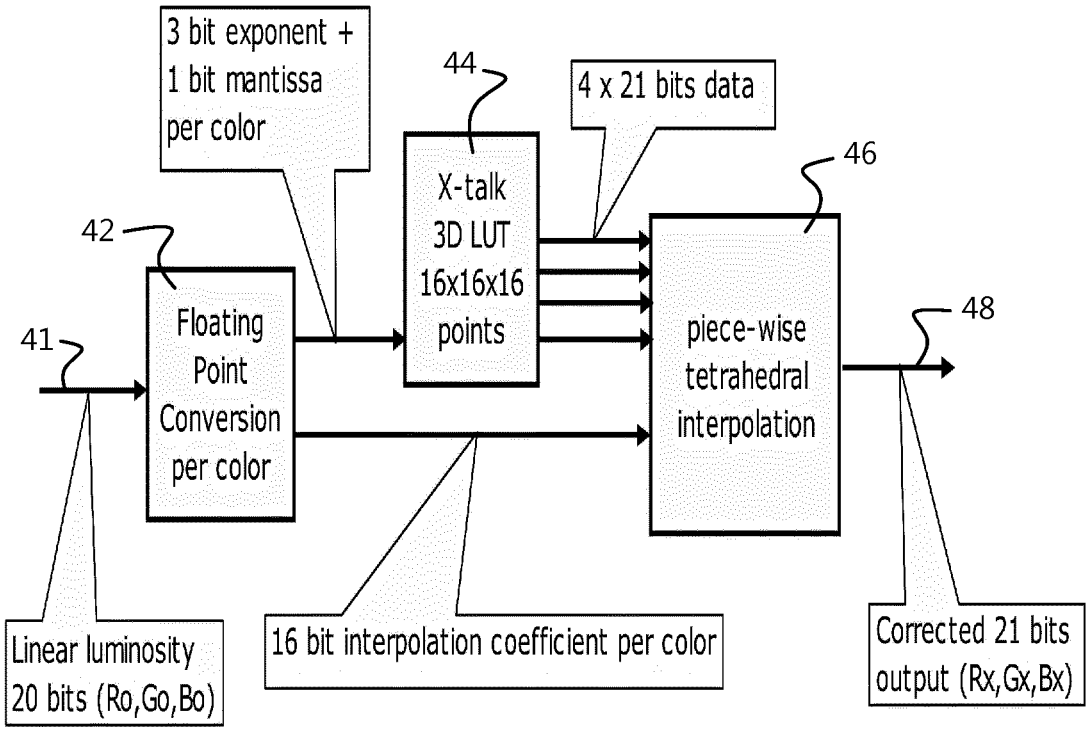
FIG. 22 shows Cross-talk compensation per sub-pixel using interpolated 3D LUT per color.

Thanks to the floating point representation (e.g. using a 3-bit exponent) only a limited number such as 16 anchor point values need to be stored per color dimension to achieve excellent grey tracking calibration results for all white points as indicated in FIG. 22.

FIG. 22 illustrates FIG. 20 in more detail and is preferably included in FIG. 20 by reference. This hardware implementation can be in the form of one or more processing blocks, this processing block or blocks comprising, for example one or more processing engines such as FPGA's or microprocessors adapted to run software, i.e. computer programs for carrying out the functions as well as associated memory both random access and non-volatile memory as well as addressing, coding and decoding devices, busses and input and output ports.

The input is a linear luminosity signal Ro, Go, Bo, with for example 20 bits. This is converted to a floating point representation per colour in processing block 42. The final step is represented by tetrahedral interpolation (block 46 providing output 48) between 4 output color coordinates (per sub pixel) from the cross-talk 3D LUT processing block 44. Each color component represented as a floating point number, together with its closest neighbouring sub pixel components, is applied to a 3D LUT (in memory) with tetrahedral interpolation (processing block 46). As tetrahedral interpolation requires 4 "anchor" points to be read from the LUT (in memory), this is visualized in the FIG. 22 by the 4 individual arrows, connecting the 3D LUT with the tetrahedral interpolator (processing block 46). Interpolation coefficients per color are transmitted from the floating point conversion per color processing block 42, e.g. derived from the ignored z bits.

Influence of 3D Interpolation Method on Precision Required by the DICOM LUT

Figure 5:
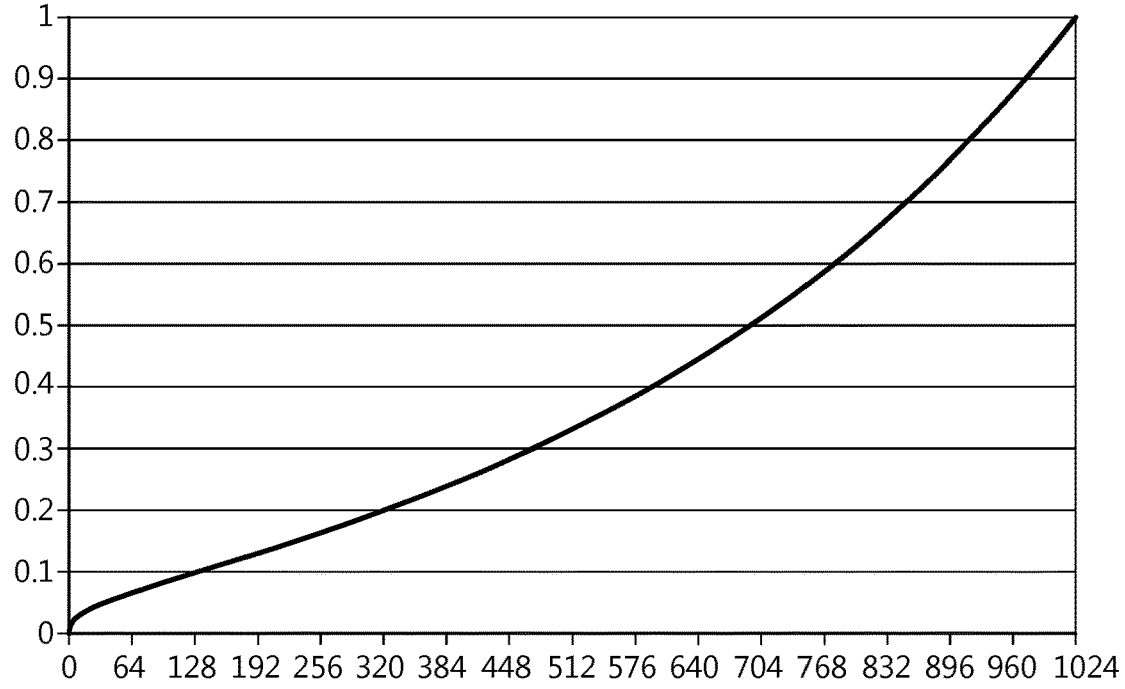
FIG. 5 shows an overall system transfer function for 2.4-gammatized DICOM compliant display with 1000 Nits light output and contrast ratio of 1600:1.

As the axis connecting the native black and white points can be already precisely calibrated by the S-LUT, (see FIG. 5, for instance, and processing block 17 of FIG. 11) based on a high number of measurements translated into a high number (960) of well-spread anchor points, the cross-talk compensation should not affect any native grey levels located on this line. As in reality even the white points near the native white point need a small correction, the grey tracking near the main diagonal in the color cube (the line connecting native black and white points) is affected. This means that the colors located at the anchor point positions near the main diagonal are affected. The main diagonal would be affected if tri-linear interpolation would be used between the anchor points. This is because each corner point affects the whole color cube between the 2×2×2 anchor points. A required (small) correction applied to the anchor points near the main diagonal would disturb the grey tracking. Splitting every color cube into 6 tetrahedrons as illustrated in FIG. 23 overcomes this problem.

Figure 23:
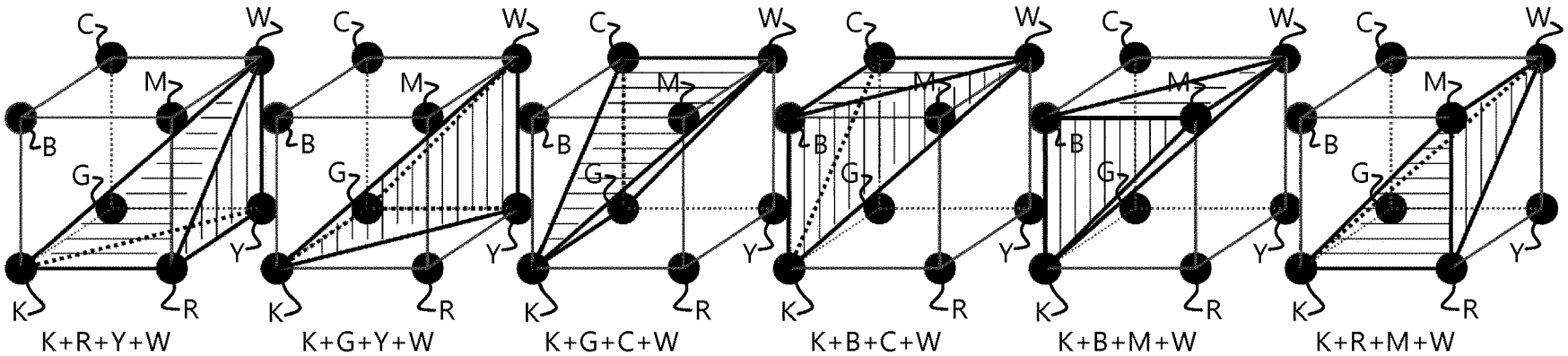
FIG. 23 shows splitting a (local) 3D RGB color cube into 6 tetrahedrons.

In FIG. 23, K represents black, W white, C cyan, B blue, G green, R red, M magenta, Y yellow and the first image on the left shows a tetrahedron with apices K+R+Y+W, and the following images show respectively, tetrahedrons K+G+Y+W K+G+C+W K+B+C+W K+B+M+W K+R+M+W.

Each tetrahedron is identified by a unique combination of black (K), white (W), a single primary color (RGB) and a single secondary color (CMY).

Figure 24:
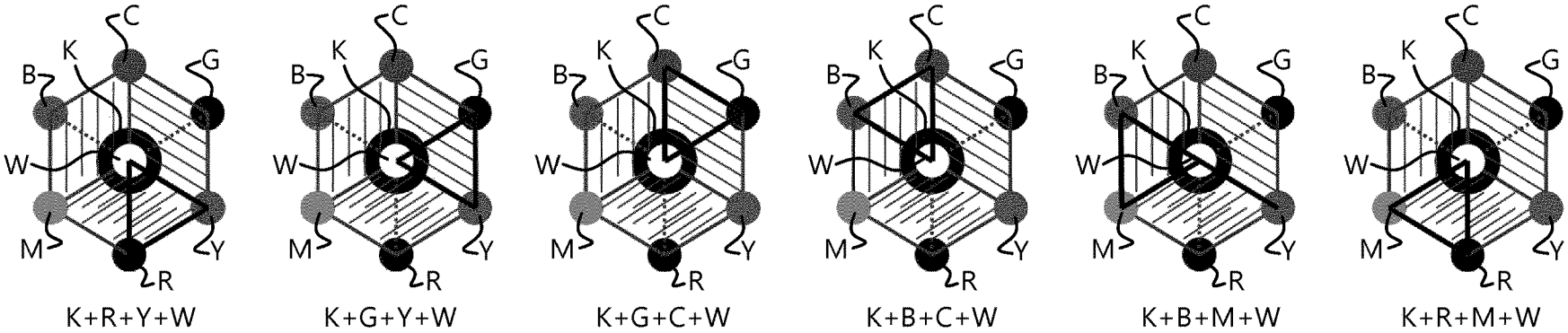
FIG. 24 shows an alternative perspective of an RGB color cube split into 6 tetrahedrons.

Every tetrahedron in FIG. 23 has 4 corner points (alternative perspective in FIG. 24). Two of them are always the locally blackest point (K) and the locally whitest point (W). One other point is the locally most primary color point (R when most reddish, G when most greenish or B when most bluish) and the last corner is associated to the locally most secondary color point (Y when most yellowish, M when most magentaish or C when most cyanish).

There are 3 secondary colors in a color cube; each of these consists of or comprises two primary colors. This leads to the already illustrated (see FIG. 23) 6 tetrahedrons, which can be visualized alternatively by looking "through" the black to white main diagonal (along with the axis direction).

For each sub-pixel the correction for each color (C) is calculated based on 4 anchor points: the locally blackest point K, the locally whitest point W, the most primary point P and finally the most secondary color point S. The contributions (k, w, p, and s) for each of these anchor points are given by Equation 4 based on the so-called Rhombic tetrahedron geometry.

$$k=1-\text{Maximum}(r,g,b)$$

$$p=\text{Maximum}(r,g,b)-\text{Median}(r,g,b)$$

$$s=\text{Median}(r,g,b)-\text{Minimum}(r,g,b)$$

$$w=\text{Minimum}(r,g,b)$$

$$O(r,g,b)=k\cdot K+p\cdot P+s\cdot S+w\cdot W$$

Equation4—Color correction values per sub-pixel based on tetrahedral interpolated 3D anchor points stored in LUT Equation 4 indicates that the contribution (p) of the most primary color (P) depends on the difference between the maximum and the median value of R, G and B. The correction represented by P corresponds to the correction in the most reddish, greenish or bluish corner point (R, G or B), depending on which color has the highest local weight (r, g or b). The local weights (r, g and b) correspond to the projected 3D input location coordinates within the local color cube to be split. When r is the highest coordinate value, then P=R, when g is the highest coordinate value, then P=G and when b is the highest coordinate value, then P=B.

Similarly the contribution (s) of the most secondary color (S) depends on the difference between the median and the minimum value of R, G and B. The correction S corresponds to the correction in the most yellowish, magentaish or cyanish corner point (Y, M or C), depending on which color has the smallest local weight (r, g or b). When r is the smallest coordinate value, then S=C, when g is the smallest coordinate value, then S=M and when b is the smallest coordinate value, then S=Y.

As the maximum value of r, g and b determines the primary point P to be selected and the minimum value determines the secondary point S to be selected, the sorting process of r, g and b values determines the selected tetrahedron. Indeed there are only 6 outcomes possible (assuming for now that the r, g and b values are all unique) of this sorting operation, each leading to one unique corresponding tetrahedron.

The 6 possible outcomes of the sorting process of the r, g and b values match the following tetrahedrons (matching the order of the illustrations in FIG. 24):

When r>g>b=>Tetrahedron corners are K+R+Y+W
When g>r>b=>Tetrahedron corners are K+G+Y+W
When g>b>r=>Tetrahedron corners are K+G+C+W
When b>g>r=>Tetrahedron corners are K+B+C+W
When b>r>g=>Tetrahedron corners are K+B+M+W
When r>b>g=>Tetrahedron corners are K+R+M+W The symbol '>' may be interpreted as "larger" or here optionally also as "larger than or equal to", as will be demonstrated below to indicate what happens when two local input coordinates are equal. As an example, assume that r=g while both of them are larger than b, then the first 2 sets of conditions listed above are both true. In this particular case the interpolation within the first two tetrahedrons (K+R+Y+W and K+G+Y+W) produce the same result. This can be evaluated from Equation 5, which is the same as Equation 4, but split into the 6 discrete cases corresponding to the 6 possible sorting outcomes.

$$1)\forall r\geq g\geq b\Rightarrow O(r,g,b)=K\cdot(1-r)+R\cdot(r-g)+Y\cdot(g-b)+W\cdot b$$

$$2)\forall g\geq r\geq b\Rightarrow O(r,g,b)=K\cdot(1-g)+G\cdot(g-r)+Y\cdot(r-b)+W\cdot b$$

$$3)\forall g\geq b\geq r\Rightarrow O(r,g,b)=K\cdot(1-g)+G\cdot(g-b)+C\cdot(b-r)+W\cdot r$$

$$4)\forall b\geq g\geq r\Rightarrow O(r,g,b)=K\cdot(1-b)+B\cdot(b-g)+C\cdot(g-r)+W\cdot r$$

$$5)\forall b\geq r\geq g\Rightarrow O(r,g,b)=K\cdot(1-b)+B\cdot(b-r)+M\cdot(r-g)+W\cdot g$$

$$6)\forall r\geq b\geq g\Rightarrow O(r,g,b)=K\cdot(1-r)+R\cdot(r-b)+M\cdot(b-g)+W\cdot g$$

Equation 5—Interpolated color correction equations for the 6 tetrahedrons

When the coordinates r and g are equal while both of them are larger than b, the first two partial interpolation equations indeed produce the same result O(r, g, b). These two tetrahedrons share 3 corner points, but the most primary point is different: R and G respectively. However the contribution of that primary point is zero as it is equal to the difference between two equal terms, when r and g coordinates are equal. In other words, color coordinates which are located on the boundary surface separating two neighbouring tetrahedrons lead to a triangular interpolation between the most black corner point K, the most secondary corner point S and the most white corner point W. Regardless of the selected tetrahedron, the output result will be the same, as the result is obtained by a triangular interpolation between the 3 common corner points. The 3 common triangular boundaries defined by two equal largest coordinate values are illustrated in Equation 6.

$$1)\forall r=g\geq b\Rightarrow O(r,b)=K\cdot(1-r)+Y\cdot(r-b)+W\cdot b$$

$$2)\forall g=b\geq r\Rightarrow O(r,g)=K\cdot(1-g)+C\cdot(g-r)+W\cdot r$$

$$3)\forall b=r\geq g\Rightarrow O(g,b)=K\cdot(1-b)+M\cdot(b-g)+W\cdot g$$

Equation 6—Triangular interpolation equations with equal 2 largest coordinates

Similarly, when the coordinates r and g are equal while both of them are smaller than b, the fourth and fifth partial interpolation equations produce the same result. These two tetrahedrons share 3 corner points, but the most secondary point is different: C and M respectively. However the contribution of that secondary point is zero as it is equal to the difference between two equal terms, when r and g coordinates are equal. This example leads to a triangular interpolation between the most black corner point K, the most primary corner point P and the most white corner point W. The 3 common triangular boundaries defined by two equal smallest coordinate values are illustrated in Equation 7.

$$1)\forall r\geq g=b\Rightarrow O(r,g)=K\cdot(1-r)+R\cdot(r-g)+W\cdot g$$

$$2)\forall g\geq b=r\Rightarrow O(g,b)=K\cdot(1-g)+G\cdot(g-b)+W\cdot b$$

$$3)\forall b\geq r=g\Rightarrow O(r,b)=K\cdot(1-b)+B\cdot(b-r)+W\cdot r$$

Equation 7—Triangular interpolation equations with equal 2 smallest coordinates

A similar reasoning is possible when r=g=b. In case all 3 coordinates are equal, all 6 partial equations of Equation 5 produce the same result. There is no contribution of the most secondary and the most primary corner point and the obtained result corresponds to a linear interpolation between the most black and white points K and W. All triangles and their corresponding equations lead to the same equation when r, g and b are equal. The line connecting the most black and most white points is the only line shared by the 3 triangles and the corresponding interpolation is given by Equation 8.

$$\forall r=g=b\Rightarrow O(g)=K\cdot(1-g)+W\cdot g$$

Equation 8—Linear interpolation between K and W with 3 equal coordinates

As the line connecting the native black and white points is already precisely calibrated, the interpolation process within the cross-talk compensation should not affect any native grey levels located on this line, even when (small) corrections are necessary for the anchor points surrounding the main diagonal. Equation 8 illustrates that splitting a cube into 6 tetrahedrons leads to a common equation for all: a linear interpolation between anchor points distributed across the main diagonal. As this line always corresponds to the local line from K to W, this interpolation technique does not disturb the earlier calibrated panel non-linearity leading to the S-LUT. This is the most important reason to select an interpolation method based on tetrahedrons.

The different cases defined by equations 5 to 8 produce a continuous function for the output stimulus per sub-pixel O(r, g, b). In other words slight changes in input color coordinate which can lead to a different selected tetrahedron don't introduce discontinuities in color reproduction, which means the decision process of selecting the right tetrahedron is insensitive to image noise.

It can be verified easily for all these equations 5 to 8 that the sum of the weights for the selected corner points is always equal to 1. The interpolation within tetrahedrons, triangles or the line K-W is always normalized. The precision required to guarantee a constant sum of weights is equal to the precision required in 1 dimension, as all terms representing weights are a linear combination of coordinates. This is another important advantage of tetrahedron based interpolation versus cube based tri-linear interpolation which is illustrated in Equation 9.

Color correction values per sub-pixel based on tri-linear interpolated 3D anchor points stored in *LUT*

$$\begin{aligned}O(r,g,b)=&K\cdot(1-r)\cdot(1-g)\cdot(1-b)+\\&R\cdot r\cdot(1-g)\cdot(1-b)+G\cdot(1-r)\cdot g\cdot(1-b)+\\&B\cdot(1-r)\cdot(1-g)\cdot b+Y\cdot r\cdot g\cdot(1-b)+\\&C\cdot(1-r)\cdot g\cdot b+M\cdot r\cdot(1-g)\cdot b+W\cdot r\cdot g\cdot b\end{aligned}$$

Equation 9

The tri-linear interpolation has simultaneous contributions for all corner points of the local color cube: the blackest point (first line), all 3 most primary points (second line), all 3 most secondary points (third line) and finally the whitest point (last line). For each corner the weight is obtained by the products of 3 terms. The weight per corner is always a function of all 3 coordinates. In order to preserve a normalized sum of corner weights the interpolation weights must be calculated with higher precision when using tri-linear interpolation than when using the earlier described tetrahedral interpolation.

The illustrated schematic in FIG. 22 implements a 16×16×16 LUT (in memory). The 4 most significant bits of the floating point video values per color from block 42 are used to address the "anchor" points within the 3D LUT 44 in memory. These 4 bits correspond to the 3 bit exponent, combined with the most significant bit of the mantissa. In that example, the 16 least significant bits of the mantissa are used for interpolation, which corresponds to the values of r, g and b in equations 4 to 8.

If tri-linear interpolation were used, then the "weights" for the anchor point data would need an intermediate precision of 3 times 16 bits; a total of 48 bits. The values r, g and b represent normalized numbers between 0 and 1. Any of the products in Equation 9, such as r×g×b, requires a numerator of 48 bits to be divided by a constant denominator: 2 to the power of 48.

In case tetrahedral interpolation is used, then the weights for the anchor point data need the same intermediate precision of 16 bits, as all weights are obtained by a subtraction with common denominators: 2 to the power of 16, referring to Equation 5.

The adaptively selected Rhombic tetrahedron based interpolation technique when implemented in a display does not require extra accuracy and associated excursion range for the DICOM processing block, as indicated in the last step in Equation 2, yet another significant advantage of the implemented interpolation technique in embodiments of the present invention.

Influence of Floating Point Address Coding on the Precision Required by the DICOM LUT The output excursion and thus the corresponding white level depends only on the amount of anchor points per dimension stored within the Cross-talk LUT (e.g. block 44 in FIGS. 22 and 37 of FIG. 28) and the floating point encoding exponent parameter, combined with the number of data bits stored in the DICOM LUT (e.g. processing blocks 12, 22, of FIGS. 11 and 15 and block 32 of FIG. 28), which is illustrated in Equation 10. This finally provides the missing factor $O_{white}$ which occurred in Equation 2.

*DICOM LUT* white level output depending on cross-talk compensation $$\Phi = 2^{(\lceil \log_2(P) \rceil - E) \vee 0} \qquad \text{Equation 10}$$

$$\Psi = P - 1 - \left\lfloor \frac{P-1}{\Phi} \right\rfloor \cdot \Phi + \Phi$$

$$\varepsilon = \frac{\Psi}{2^{\lceil \log_2(\Psi) \rceil}}$$

$$O_{white}(N, E, P) = 2^N \cdot \varepsilon$$

The embodiment of Equation 10 reflects how the white level of the DICOM LUT read data output depends on the cross-talk compensation configuration. Parameters P represents the number of anchor points per dimension stored within the 3D LUT, while parameter E indicates the amount of bits used to represent the exponent value as part of the floating point number representation. The number of bits used to encode the DICOM data (N) must be calculated to achieve compliancy with the DICOM spec. Once the value of $O_{white}$ is determined, the quantizing intervals of the linear luminosity depend on N uniquely.

The first step to determine $O_{white}$ as illustrated in Equation 10 subtracts the number of bits to represent the floating point exponent E from the upper rounded (ceiling) binary logarithm of P (the number of anchor points per dimension). The maximum value of this result and 0 is then expressed as a power of two to represent phi.

The second step divides the amount of anchor points per dimension P minus 1 (the last anchor point index per dimension) by the value of phi and multiplies the lower rounded (floor) result with phi again and subtracts this result from P−1. This is equivalent to a so-called modulo operation: P−1 modulo phi. Phi is added to that result to obtain the value of psi.

The third step normalizes psi by dividing its value by the smallest power of two larger than or equal to psi. The result, represented as epsilon, can be considered as a real value which scales the output excursion of the DICOM data.

The value of $O_{white}$ which represents the quantized white level corresponding to the linear luminosity for white is obtained by the final step in Equation 10. Its value depends on epsilon, which ultimately depends on P and E. In this particular case, this leads to an equation very different from the result suggested in Equation 3.

The behaviour of the value of epsilon depending on the parameters P and N is illustrated in FIG. 25 for the first 24 possible values of P and the first 5 possible values of E. Note that the number of anchor points per dimension P must be at least 2 in order to define a variable function.

The excursion scaling is not necessary for small values of P, as the maximum range needs to be multiplied by 1. In this special case, the output white level is constraint to the value indicated by Equation 3. In all other cases, Equation 10 provides the quantized white level.

Now that the value of epsilon is solved in Equation 10 and $O_{white}$ depends only on the selected data width, the DICOM LUT read data output values can be calculated for a selected read address width, referring back to the 3 calculation steps in Equation 2, as all quantizing processes are known. This is illustrated in FIG. 26.

Obviously the values calculated during the first step depend on the number of addresses available corresponding to the input bit depth: for instance 1024 values for a 10-bit input. Each of these values represents a normalized target J-index value. A value of 0 corresponds to a J-index value which matches the absolute black level (in this case J=57.17302876) while a value of 1023 corresponds to a J-index value which matches the absolute white level (in this case J=825.0084584). All other target J-index values are obtained by linear interpolation between these 2 levels, in other words all quantizing intervals are perceptually equal. This de-normalizing step matches a display with a contrast of 1600:1 and a white luminosity of 1000 Nit.

The second step calculates the target luminosity values (expressed in Nit) per listed J-index. Note that the maximum target luminosity value does not equal 1000 Nit, but about 10% more. This margin corresponds to the headroom which is required by the non-uniformity correction as the centre of display must be attenuated a little in order to achieve uniform luminosity levels across the display.

Figure 28:
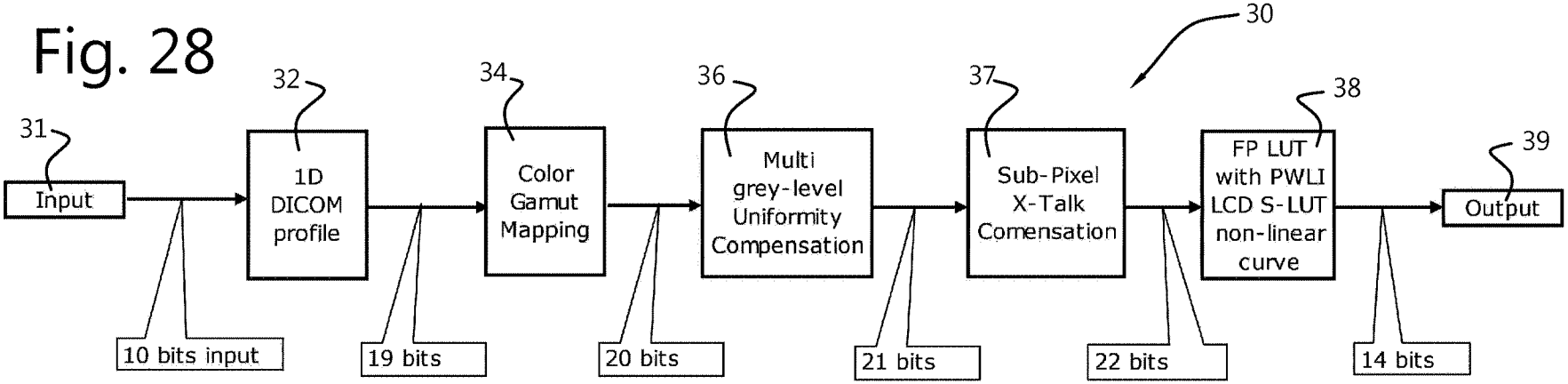
FIG. 28 shows an image processing path to ensure DICOM compliancy for 10 bit input.

The third step normalizes the target luminosity values based on the value of $O_{white}$ which depends on the value epsilon, indicated in FIG. 28. In case 16 anchor points are stored per dimension and a 3-bit exponent is used, a value of 0.75 is obtained. The 17-bit white level output value is then determined by multiplying the $17^{th}$ power of 2 by the value of epsilon: $O_{white}$=131072×0.75=98304.

The read data width as illustrated in FIG. 26 was not chosen by coincidence. Many of the first few read data increments are equal to 1, which is the smallest possible integer increment which can be associated with a read data increment. This means the read data width is equal to the minimum possible value without introducing a loss of colors. In the case of a medical grade monitor, this is a minimum quality spec for most use cases, but it does not necessarily involve a full DICOM compliancy.

DICOM Validation Methods and their Impact on Required LUT Data Bit Depth

It is clear that with the read data precision illustrated in FIG. 26 some quantizing intervals are twice as large as others. For instance the first increment from 0 to 1 corresponds to only half of the next increment from 1 to 3. This introduces strongly non-linear quantizing intervals, which are at least not desirable. In order to achieve the DICOM standard, this read data width is insufficient, as DICOM compliancy requires a non-linearity of relative luminosity increments (dL/L) below +−15% as illustrated in FIG. 2.

As already mentioned before, it is rather impractical to verify the dL/L variation for each individual 10-bit input interval because of the camera sensor noise which causes long measurement times, especially in order to integrate the noise sufficiently in the dark grey levels. The problem is that fluctuations in the backlight luminosity or temperature variations inside the display will disturb the measurement samples acquired during a too long period and cause the data to be inconsistent. Therefore usually in practice DICOM compliancy is verified roughly and quickly by measuring some tens such as 17 equidistantly spread grey levels, as illustrated in FIG. 2.

However, it is technically possible to sample multiple grey levels near each other and apply a sweep from black to white with non-equidistantly distributed grey levels.

Assuming that the transmission levels corresponding to successive digital driving grey levels are "bounded" by some physical laws and the corresponding transmission curve and its first few derivatives show significant continuities, embodiments of the present invention could use sparse sampling techniques for instance by measuring all grey levels which are a multiple of 32 or 33. In case of a 10-bit input the applicable multiples of 32 are 0, 32, 64, 96 . . . , 928, 960 and 992, while the applicable multiples of 33 are 0, 33, 66, 99 . . . , 928, 960 and 992. Combining these 2 series leads to this series of grey values: 0, 32, 33, 64, 66, 96, 99, 128, 132 . . . , 891, 896, 924, 928, 957, 960, 990, 992 and 1023.

When combined with modern mathematical techniques, this type of sparse sampling distribution can provide excellent function reconstruction properties. The reason for this is that neither of both individual equidistantly spread series can capture all nuances of the full display transmission function, because not all data is sampled. When the sub sampled data of one individual equidistantly spread series is used to reconstruct the full display transmission function which is the relation between the input level and the luminosity in front of the display such as an LCD, then interpolation artefacts are introduced, even when advanced (high order) interpolation methods are applied.

When applying a sharp interpolation filtering technique capable of reconstruction small local tendencies (with fast varying but still continuous transfer function derivatives) within the transmission curve, it is impossible to avoid so-called aliasing artefacts due to the under sampling process. On the other hand, when applying a smooth interpolation filter capable of avoiding these aliasing artefacts, the reconstruction of small local tendencies within the transmission curve is no longer possible. This reflects the so-called Nyquist criterion for sample based reconstruction of signals. In this case the signal to be reconstructed is the measured LCD panel transmission or the corresponding luminosity as function of a linear drive grey level sweep.

By combining the grey levels in both equidistant series, it is possible to cancel out most of the aliasing artefacts associated with equidistant sub sampling. The aliasing artefacts of both equidistantly spread series can be considered as falsely introduced (local) tendencies within the transmission curve. For each of the sample series, these false tendencies can be decomposed into a number of spectral components. A frequency within the spectrum corresponds to the inverse of a certain grey level interval, such as the sampling frequencies 32 and 33 within the above example. Although the spectral aliasing components typically show very similar amplitudes for both series, they differ in phase due to the different placement of the samples.

The knowledge of how different the phases are per frequency per grey level enables to apply phase filtering to obtain each spectral component in counter phase for one series opposed to the other series. This explains why a color profile reconstruction based on this type of non-equidistantly spread sub sampling can provide superior results when compared to "conventional" reconstruction techniques. Therefore this sub sampling method (or another non-equidistantly spread sub sampling technique with the same or similar desirable properties) should preferably be used when possible, even during the calibration process which (eventually) involves a validation of the DICOM compliancy.

As the illustrated series of grey levels mentioned above contains the numbers 32 and 33, the non-linearity of relative luminosity increments (dL/L) should be below +−15% for this interval. In order to achieve DICOM compliancy for any arbitrary sub sampling distribution, the system ideally should be designed to guarantee a perceptual quantizing interval variation below +−15% for all intervals.

Another often used sub sampling distribution is the jittered sampling technique, which is equivalent to a perturbed equidistant sampling. Instead of sampling or measuring the luminosity for equidistantly spread grey levels 0, 17, 34, 51 . . . some type of noise (white noise, Gaussian noise, Brownian noise . . . ) is added to the series. Jittered sampling approximates the so-called Poisson distributed sampling, which has been proposed in multiple data acquisition systems as the most efficient sub sampling method to mask aliasing artefacts.

For efficient sub sampling in 2 dimensions, there is evidence that the sparse retinal photo receptor cells outside the foveal region of the human eye are distributed according to a so-called Poisson-disk distribution. According to Darwin's evolution theory, the human eye with the connected visual cortex inside our brains must be considered as an efficient image acquisition system and therefore this type of sampling distribution can be considered as part of a "natural" anti-aliasing technique. Obviously a real Poisson sampling technique can be used as well to stimulate the display in order to measure its electro-optical transfer function and thus eventually validate its DICOM compliancy.

Considering the above examples of DICOM compliancy validation techniques, the most important question is: which DICOM LUT read data width is required to enable a "pass" for each validation and hence is suitable for at least some or embodiments of the present invention? In order to obtain perceptually equal quantizing intervals within a tolerance of +−15% variation relative to the absolute luminosity for a display with 1000 nit light output and a contrast of 1600:1, assuming the earlier described cross-talk compensation with 16 anchor points stored per dimension in a 3D LUT per sub pixel addressed by a floating point representation of the linear luminosity having a 3 bit exponent, then 19 bits are required for the read data to represent the linear luminosity matching the addresses representing quantized J-index values, as illustrated in FIG. 27.

When comparing the read data in FIGS. 26 and 27, the difference in read data increment per address increment can be seen. While 17 bits of read data causes the increment steps to be 1 or 2 for the first 10 grey levels, a read data precision of 19 bits causes variations of 5 versus 6. In order to calculate this variation relatively to the absolute luminosity, two columns are added in FIG. 27 compared to FIG. 26. First the theoretical dL/L value is calculated, and then the dL/L is calculated based on the quantized image processing path. Note that for input equal to 0 there's no increment of L versus the previous address value, so these entries in the table are marked as "not applicable". By comparing both values, the relative error due to quantizing can be calculated in the right column as a percentage. Note that the highest absolute value which can be found equals 13.11%, which is below the threshold of 15%.

This leads to the conclusion that the above described image processing chain has the precision to be able to pass any DICOM compliancy test.

High Precision Required Because of Color Gamut Matching Using Linear Luminosities So far a white balance has been discussed as part of the modular image processing path and processing blocks such as in FIG. 15. However white is not the only color which might need to be mapped to a specific target. A display might need to match a complete color gamut, including the primary and secondary colors as illustrated in the scheme FIG. 28, which applies all the above discussed bus widths. This hardware implementation can be in the form of one or more processing blocks, this processing block or blocks comprising, for example one or more processing engines such as FPGA's or microprocessors adapted to run software, i.e. computer programs for carrying out the functions as well as associated memory both random access and non-volatile memory as well as addressing, coding and decoding devices, busses and input and output ports.

Referring to FIG. 28, the input of images or video stream is an N bit input signal e.g. a 10 bit input signal 31 of a panel 30 is processed by a 1D DICOM profile function 32 (LUT in memory and performed by a processing block). The processed output is an N+9 bit signal e.g. a 19 bit signal. This signal is then input for a color gamut mapping step 34 (processing block). The output is an N+10 bit, e.g. a 20 bit signal supplied for a multi-grey-level uniformity compensation in a further processing step 36 (processing block). The output of step 36 (processing block) is an N+11 bit, e.g. a 21 bit signal that is supplied to sub-pixel Cross-talk compensation step 37 (processing block). Output of this step is an N+12 bit e.g. a 22 bit signal which is processed in a further step 38 (processing block) with a LUT (in memory) with a PWLI LCD S-LUT storing (in memory) discrete values of a non-linear curve. The output 39 is an N+4 e.g. a 14 bit signal.

The high DICOM LUT read data precision of 19 bit is necessary in order to perform the color gamut mapping as this feature must be performed based on linear luminosity representations. As the DICOM transfer function (processing block 32) is highly non-linear and the variation of perceptual quantizing intervals is constraint by the DICOM specification, highly precise video data is required. A simple white balance (see further) does not require such a linear luminosity representation and therefore the image processing path can be implemented with much lower precision while still maintaining equally good DICOM compliant grey tracking.

Figure 29:
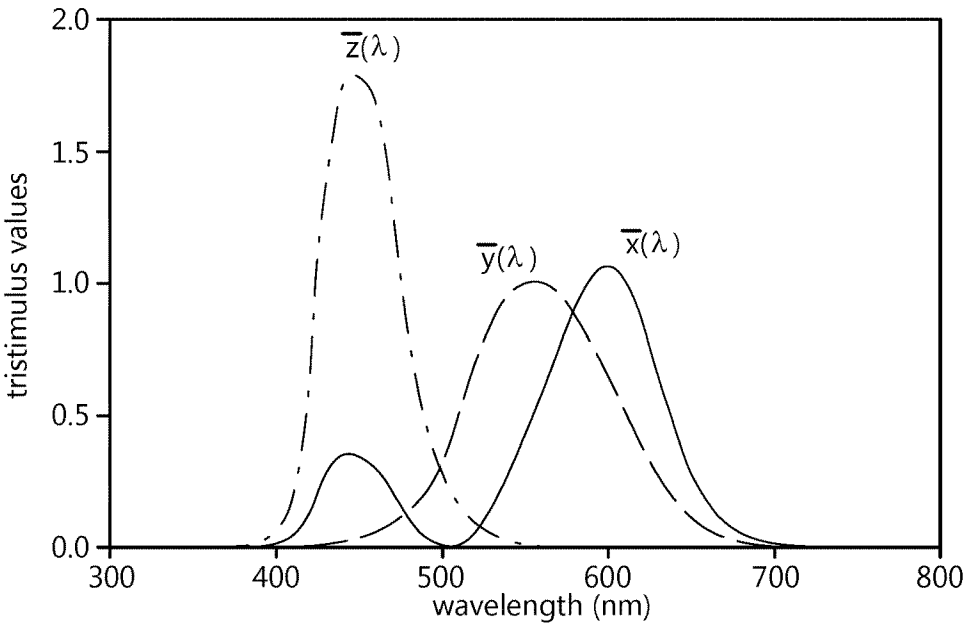
FIG. 29 shows spectral sensitivity functions as defined by the CIE1931 standard.

The human visual system (e.g. approximated by the Barten Model) has multiple types of photo receptors. When the signals received by the different types of receptors are combined, the human visual system (e.g. approximated by the Barten Model) matches a linear tristimuli system quite well. Therefore the CIE-1931 standard considers the spectral sensitivity functions for each stimulus as constant, as illustrated in FIG. 29.

Each of the tristimulus values X, Y and Z is obtained by a weighted sum of spectral energies and is mathematically calculated as an integral by integrating the energy over the wavelength (lambda A), as defined by Equation 11.

Conversion from power spectrum to $X$, $Y$ and $Z$ values

Equation 11

$$X = \int_{\lambda} x(\lambda)P(\lambda)\Delta\lambda$$
$$Y = \int_{\lambda} y(\lambda)P(\lambda)\Delta\lambda$$
$$Z = \int_{\lambda} z(\lambda)P(\lambda)\Delta\lambda$$

The power (P) as function of the wavelength (lambda λ) is multiplied by the spectral sensitivity functions (x, y and z) as defined by the CIE (Commission International de l'Eclairage) in 1931. The integrated results for the full (visible) spectrum result in the X, Y and Z values. The fundamental idea behind the XYZ tristimuli is that when 2 light spectra correspond to the same XYZ values, they appear equal to the human eye. While this is not entirely correct with peaked energy spectra, such as with narrow bandwidth LED light sources, it is accurate enough as the purpose of color gamut mapping is to calibrate a display to a certain fixed color gamut.

Equal XYZ stimuli representing the same colors to the human eye involves that 2 displays with different primary color spectra can represent the same color, as long as that color fits within both native color gamuts. Both displays might need a different mixture of red, green and blue primary luminosities to obtain the same color perceptually.

When calibrating displays in general, the choice of a target color gamut is critical. Obviously, one could prefer to use every individual display with its native color gamut as this maximizes color details without sacrificing any input colors. However this leads to inconsistent displays as every individual display can show a unique color with the same input stimuli. In most professional applications this is not acceptable.

When manufacturing a display series, it is possible to characterize the minimal color gamut displayable by all individual displays of a given type. While guaranteeing 100% color consistency, this reduces the color gamut of all displays, even the "worst" display with the least saturated colors.

Figure 30:
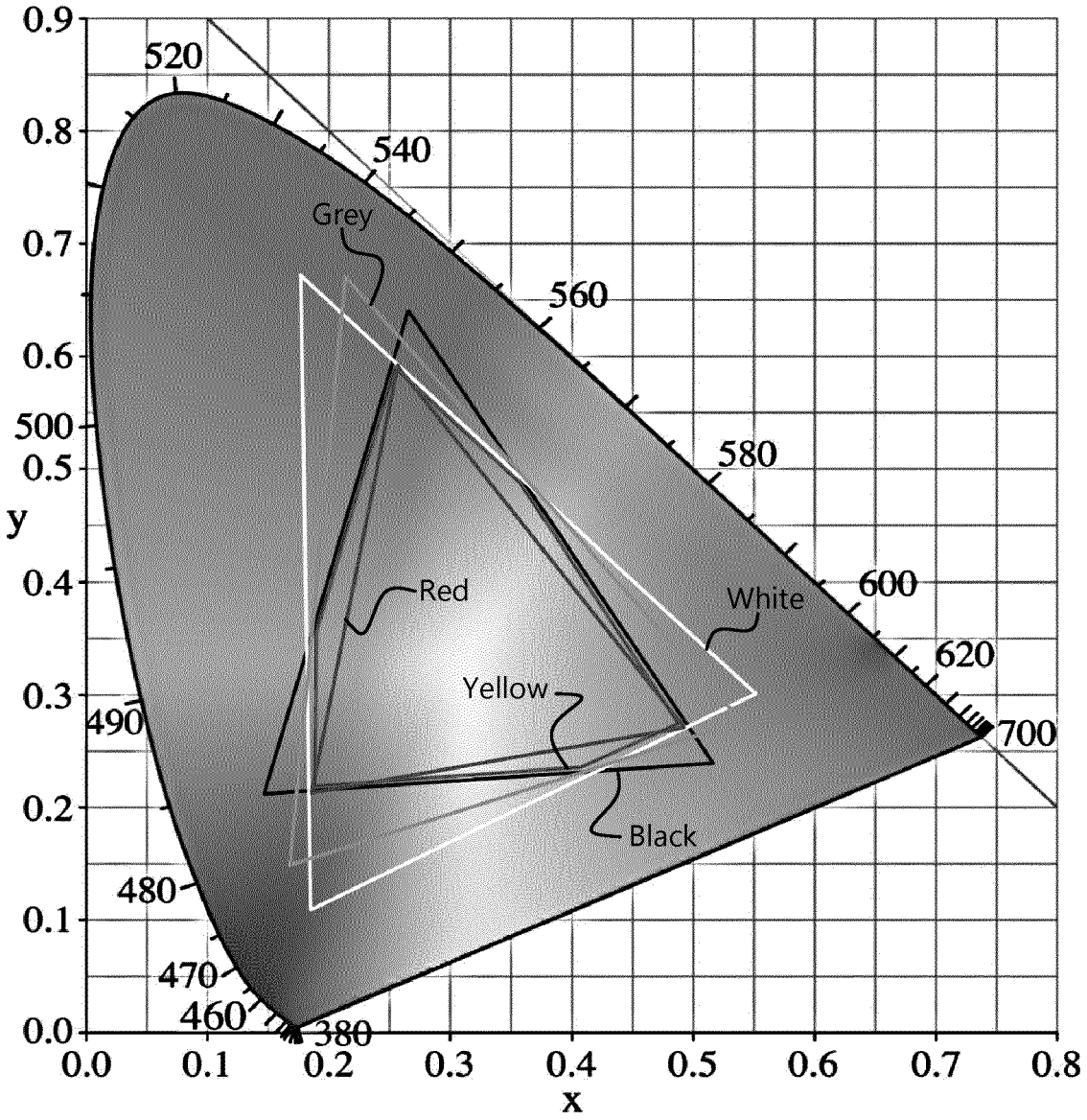
FIG. 30 shows common color gamut displayable by multiple monitors.
Figure 31:
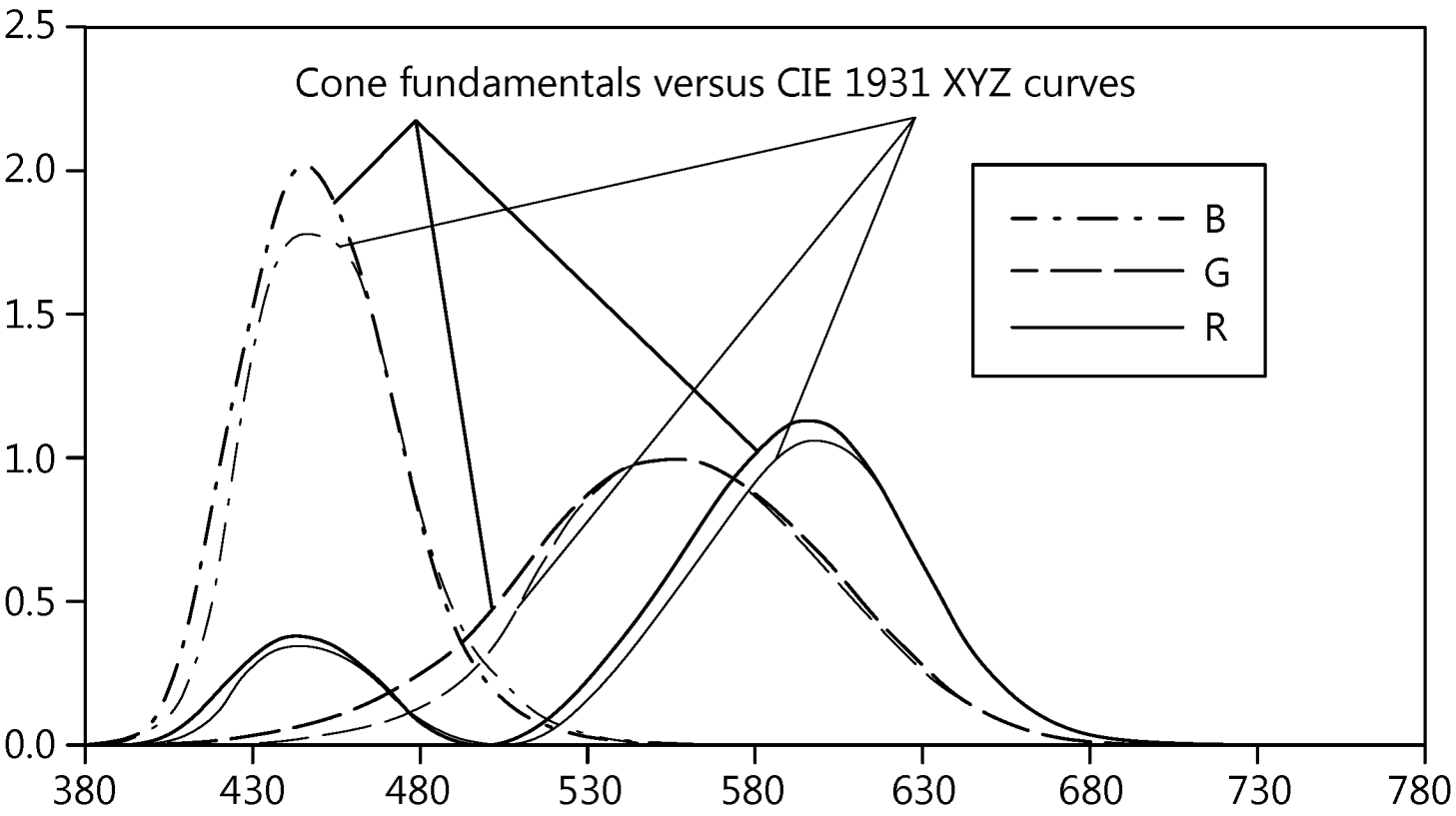
FIG. 31 shows CMF versus CIE 1931 chromaticity representation.

The black, grey and white triangles in FIG. 30 show the color gamut of 3 imaginary displays within the x, y chromaticity diagram. The red triangle shows a possible linear target color gamut achievable by the 3 individual displays. As can be clearly evaluated, this common color gamut is much smaller than each individual color gamut, which means this calibration method is not always preferable.

The yellow hexagon which starts from the almost horizontal line marked "yellow" and then rises to the right to meet with an apex (bottom right) of the red triangle, then rises steeply to the left parallel with a side of the black triangle until it meets a crossing point with sides of the white triangle and the black triangle after which it follows the white triangle until it reaches an apex (top) of the red triangle, after which it drops parallel with a side of the black triangle until it meets a crossing point with a side of the white triangle after which it follows the white triangle until it joins the beginning line marked yellow, shows another possible target color gamut achievable by all 3 individual displays. This hexagonal color gamut is still much smaller than each individual original display color gamut, but enables more colors to be represented accurately compared to the red triangle. As the secondary colors are no longer a linear combination of the primaries, a display with such a color gamut should be considered as colorimetrically non-linear. However, for a given color hue value, the display behaves linear for all values of tinting and shading.

A light source can be characterized by having a certain hue (reddish, yellowish, greenish, cyanish, bluish, and magentaish), certain colorfulness (similar to the saturation) and certain brightness or luminosity. When the color gamut is reduced, this impacts the colorfulness value as that value is 100% for colors at the boundaries of the displayable color gamut. However, a reduction of color gamut can preserve the hue and luminosity values.

After manufacturing a beta series of a certain display type, it is possible to characterize the minimal color gamut displayable by all displays within that series and even foresee some margin for the "common" gamut to fit within that of future individual displays. While guaranteeing color consistency for most displays manufactured in the future, the method is not perfect as it is preferred to preserve a color gamut as wide as possible. It is also impossible to guarantee a common color gamut in aged displays.

Another reason why out of gamut color handling is sometimes necessary is the fact that sometimes an XYZ tristimulus system different from the CIE 1931 is used, such as eye sensitivity cone fundamentals, also known as CMF or Color Matching Functions. These Eye sensitivity cone fundamentals were measured using narrow band spectra which were not yet available in 1931. These curves were recently accepted by the CIE, but not (yet) implemented in most standard measurement equipment.

These CMF curves provide a better match with human visual perception (approximated by the Barten model) and correspond to a different color gamut compared to CIE 1931. Therefore, a color inside the native color gamut represented in CIE 1931 coordinates is not necessarily located inside the native color gamut represented in CMF coordinates.

The different color gamuts associated with CMF and CIE chromaticity coordinates imply that a given target color gamut can fit perfectly within the display's native color gamut when measurement equipment is used based on the CIE 1931 standard, while one or more primaries can be out of gamut when measured by measurement equipment based on CMF chromaticity coordinates, or vice versa.

Figure 32:
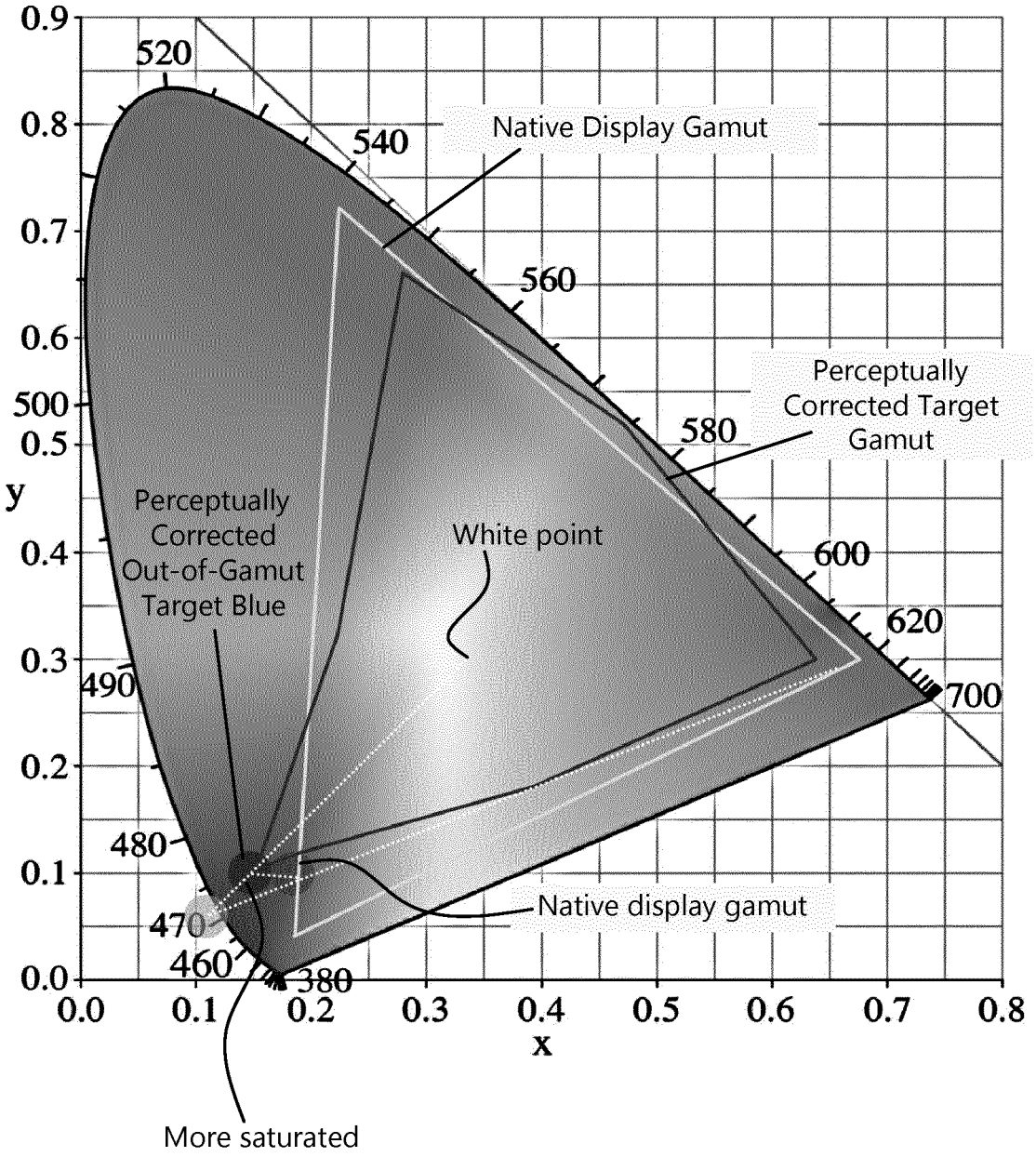
FIG. 32 shows clipping the colorfulness of colors which are out of native color gamut.

All this leads to the conclusion that for some individual displays at some point in time a solution must be implemented to represent colors which are (slightly) outside the native color gamut, whichever chromaticity coordinates are used. In other words: the target color gamut can have primaries outside the native color gamut. When this is the case, the so-called colorfulness should preferably be clipped as indicated in FIG. 32.

Ideally, out of gamut colors should be replaced by the closest possible displayable color. Consider the color gamut indicated by the yellow triangle in FIG. 32. Imagine the ideal target blue primary coordinate is represented by the dot indicated as the perceptually corrected out of gamut target blue dot. In order to represent the corresponding color, one would need to mix a positive amount of native green and native blue, but combined with a negative amount of native red. As the negative amount of red light is impossible to produce, this color is out of the displayable gamut.

By simply ignoring the negative contribution, the target point would move in the direction of the native red coordinate until the point where that line intersects with the native gamut (indicated in by the dot marked "native display gamut)). However, this is not the closest displayable match and therefore probably not the optimal solution.

A better approach to preserve out of gamut colors as far as possible is to project the out of gamut color coordinate orthogonally on the native display gamut. This closer displayable color can be obtained by increasing the saturation of the target color in a first step, rendering this new target color even further out of gamut. The perceptually corrected out of gamut dot position represents the original target color while the "more saturated" dot represents the more saturated version. The amount of extra saturation, which determines the position of the more saturated dot, is chosen so that this modified target primary color is located at the intersection of two straight lines:

- The line interconnecting the white point with the original perceptually corrected out of gamut target primary color dot.
- The line through the native red point and the orthogonally projected closest displayable representation of the native display gamut dot.

The color represented by the native display gamut dot is the point colorimetrically closest to the original target point that is physically possible and thus the point which most likely fits within the specified tolerances, such as the tolerance circles specified by the EBU (European Broadcast Union).

Until now, there's no standardized primary color tolerance specification for medical grade displays. However, the color gamut matching principle implemented inside a display will most likely prove to provide the optimal color rendering. This is motivated by the evidence that many artefacts in illuminated tissues are recognized by their different amount of reflection and/or absorption of the light. In post-production environments the color graders typically represent more reflection by blending a color with white, the so-called tinting process, while more absorption is obtained by blending a color with black, the so-called shading process.

The color coordinates located at the color gamut boundaries (such as the yellow hexagon in FIG. 30) can be considered as maximum colorful. All colors can be represented as an interpolation between a maximum colorful color, black and white. The color gamut mapping method described above corresponds to a normalizing step for the so-called colorfulness, while it preserves the linearity of shading and tinting.

Figure 33:
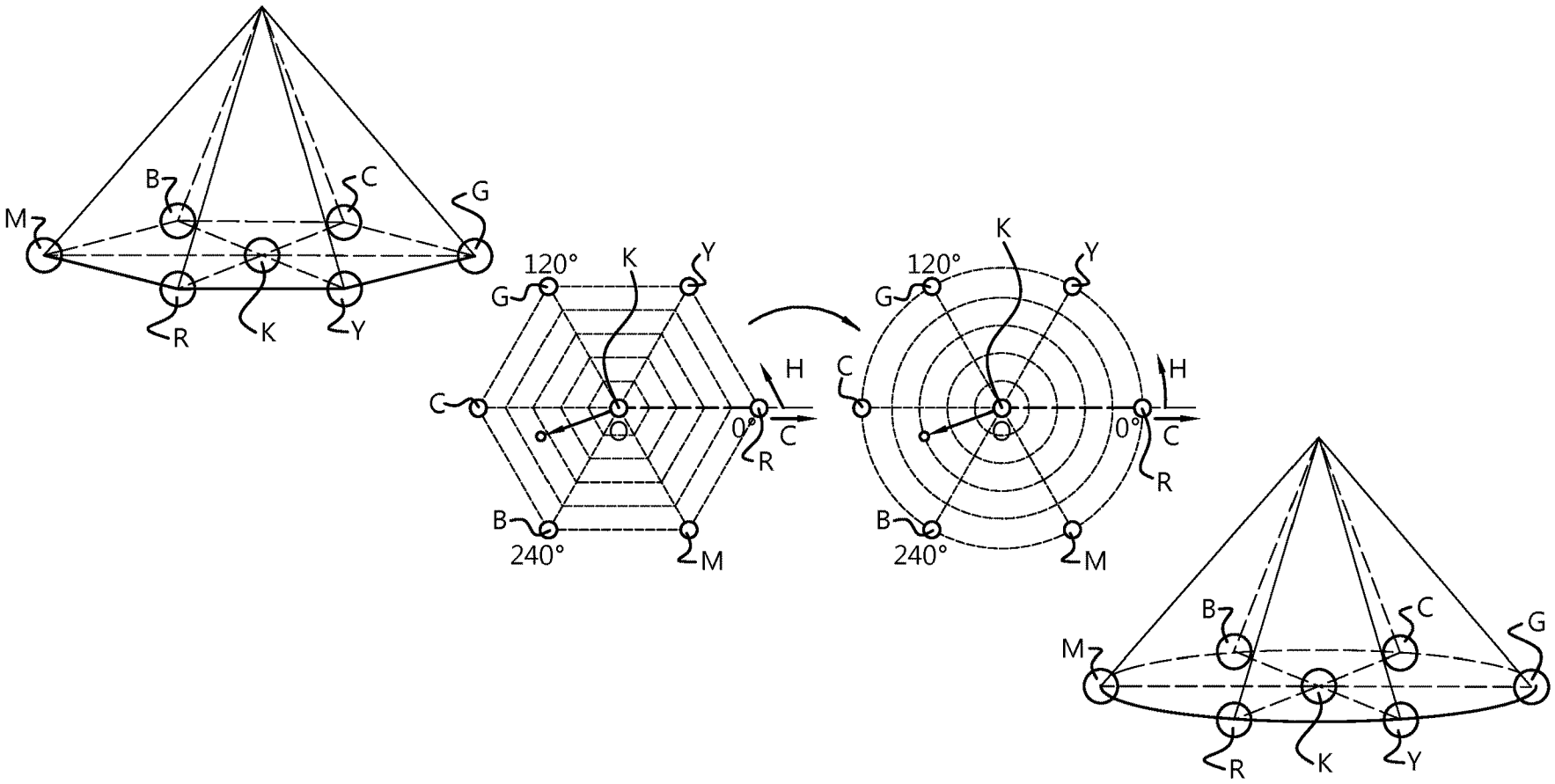
FIG. 33 shows a hexagonal pyramidal color space radial linearly converted into a cone.

By individually linearly transforming the 6 tetrahedrons of an RGB color cube, as illustrated in FIGS. 23 and 24, the cube can be transformed into a hexagonal pyramid and further radial linearly converted into a cone as illustrated in FIG. 33, in which K represent black, W white, B blue, R red, G green, C cyan, M, magenta, Y yellow.

The red contour which is between M, R, Y and G dots on the left image whereas it is the complete curve M, R, Y, G, C, B to M again in the right image corresponds to the line of maximal colorfulness. An ideal display with infinite contrast would have maximum colorful colors within the entire color plane, including the black point, as a mix with black (XYZ=0, 0, 0) would not change the colorfulness but simply attenuate the luminosity (Y) and preserve the color (x, y). Therefore, a transform which places the black point in the same plane as the primaries and secondaries makes sense as a mix with relatively small amounts of black, so-called shading, hardly affect the colorfulness, even with limited contrast. On the other hand a mix with relatively small amounts of white represented on top of the hexagonal pyramid and the cone, so-called tinting, significantly affects the colorfulness.

Sometimes the color space is visualized as a cone to represent colors with constant colorfulness as circles. This transform is a linear scaling within the planes of constant hue, but the scaling factor varies with the color hue.

As each point within the red contour of maximal colorfulness represents a mix of one primary and one secondary color, each point within the cone obtained by shading and tinting is a linear combination of four colors: one primary (P), one secondary (S), black (K) and white (W). The contributions (p, s, k and w) for each of these color points are given by Equation 12 based on the so-called Rhombic tetrahedron geometry, taking into account the normalization of the colorfulness.

The equation indicates that the contribution (p) of the selected primary color ($R_P$, $G_P$, $B_P$) depends on the difference between the maximum and the median value of $R_i$, $G_i$ and $B_i$. The primary color coordinate ($R_P$, $G_P$, $B_P$) corresponds to the color coordinate for the native red, green or blue primary color, depending on which input color stimulus $R_i$, $G_i$ or $B_i$ has the highest value. Similarly the contribution (s) of the selected secondary color (S) depends on the difference between the median and the minimum value of $R_i$, $G_i$ and $B_i$. The secondary color coordinate ($R_S$, $G_S$, $B_S$) corresponds to the color coordinate for the native yellow, cyan or magenta secondary color, depending on which input color stimulus $R_i$, $G_i$ or $B_i$ has the smallest value.

As the maximum value of $R_i$, $G_i$ and $B_i$ determines the primary point ($R_P$, $G_P$, $B_P$) to be selected and the minimum value determines the secondary point ($R_S$, $G_S$, $B_S$) to be selected, the sorting process of $R_i$, $G_i$ and $B_i$ values determines the selected tetrahedron within the hexagonal pyramid. There are only 6 outcomes possible (assuming for now that the Ri, Gi and Bi values are all unique) of this sorting operation, each leading to one unique corresponding tetrahedron as part of the hexagonal pyramid.

The 6 possible outcomes of the sorting process of the Ri, Gi and Bi values match the 6 tetrahedrons, each defined by 4 corner points: K+R+Y+W, K+G+Y+W, K+G+C+W, K+B+C+W, K+B+M+W and K+R+M+W (matching the order of the illustrations in Figure). Each corner point can be represented as a tristimulus value: black ($R_K$, $G_K$ or $B_K$), white ($R_W$, $G_W$ or $B_W$), red ($R_R$, $G_R$ or $B_R$), green ($R_G$, $G_G$ or $B_G$), blue ($R_B$, $G_B$ or $B_B$), yellow ($R_Y$, $G_Y$ or $B_Y$), cyan ($R_C$, $G_C$ or $B_C$) and magenta ($R_M$, $G_M$ or $B_M$).

The selected primary color is represented by the tristimulus value ($R_P$, $G_P$ or $B_P$) and the selected secondary color by ($R_S$, $G_S$ or $B_S$). Similarly the generated output tristimulus value is represented in Equation 12 as ($R_O$, $G_O$, $B_O$).

Color gamut mapping per sub-pixel based on normalized colorfulness in a hexagonal pyramidal color space -continued $$
\begin{aligned}
k &= 1 - \text{Maximum}(R_i, G_i, B_i) \\
p &= \text{Maximum}(R_i, G_i, B_i) - \text{Median}(R_i, G_i, B_i) \\
s &= \text{Median}(R_i, G_i, B_i) - \text{Minimum}(R_i, G_i, B_i) \\
w &= \text{Minimum}(R_i, G_i, B_i)
\end{aligned}
\qquad \text{Equation 12}
$$

$$
\begin{cases}
R_{Grey}(R_i, G_i, B_i) = \text{Median}(0, k \cdot R_K + w \cdot R_W, 1) \\
R_{Color}(R_i, G_i, B_i) = \text{Median}(0, p \cdot R_P + s \cdot R_S, 1) \\
R_o(R_i, G_i, B_i) = R_{Color}(R_i, G_i, B_i) + R_{Grey}(R_i, G_i, B_i)
\end{cases}
$$

$$
\begin{cases}
G_{Grey}(R_i, G_i, B_i) = \text{Median}(0, k \cdot G_K + w \cdot G_W, 1) \\
G_{Color}(R_i, G_i, B_i) = \text{Median}(0, p \cdot G_P + s \cdot G_S, 1) \\
G_o(R_i, G_i, B_i) = G_{Color}(R_i, G_i, B_i) + G_{Grey}(R_i, G_i, B_i)
\end{cases}
$$

$$
\begin{cases}
B_{Grey}(R_i, G_i, B_i) = \text{Median}(0, k \cdot B_K + w \cdot B_W, 1) \\
B_{Color}(R_i, G_i, B_i) = \text{Median}(0, p \cdot B_P + s \cdot B_S, 1) \\
B_o(R_i, G_i, B_i) = B_{Color}(R_i, G_i, B_i) + B_{Grey}(R_i, G_i, B_i)
\end{cases}
$$

Each output stimulus $R_O$, $G_O$ and $B_O$ is obtained by adding an amount of grey ($R_{Grey}$, $G_{Grey}$ and $B_{Grey}$) to an amount of a maximum colorful color ($R_{Color}$, $G_{Color}$ and $B_{Color}$). Each of these stimuli is clamped by the median function and constraint within the normalized range 0 to 1. This method guarantees that slightly shading or tinting a maximum colorful color, even when it's located out of the native color gamut, visibly affects the output result in a linear way. Adding even a small amount of grey will affect the output because the starting point is always inside the displayable gamut, regardless of the original color hue. Furthermore this also guarantees that the original color hue is colorimetrically preserved by the shading or tinting process.

The color gamut mapping equation can be rewritten by splitting the single equation in the 6 discrete cases corresponding to the 6 possible sorting process outcomes. As the sorting outcomes are noted as "greater than or equal to", the 6 cases overlap each other when multiple input stimuli (Ri, Gi and Bi) are equal.

As can be verified easily, when the input stimuli Ri, Gi are equal while both of them are larger than Bi, the first two partial interpolation equations indeed produce the same result ($R_O$, $G_O$, $B_O$). These two tetrahedrons share 3 corner points, but the native primary color point is different: red ($R_R$, $G_R$ or $B_R$) and green ($R_G$, $G_G$ or $B_G$) respectively. However the contribution of that primary point is zero as it is equal to the difference between two equal terms, when Ri, Gi input stimuli are equal.

In this color space transformed as a hexagonal pyramid, color coordinates which are located on the boundary surface separating two neighbouring tetrahedrons lead to a triangular interpolation between the native black corner point K ($R_K$, $G_K$ or $B_K$), the selected native secondary color corner point S($R_S$, $G_S$ or $B_S$) and the native white corner point W ($R_W$, $G_W$ or $B_W$). Regardless of the selected tetrahedron within the hexagonal pyramid, the output result will be the same, as the result is obtained in both cases by a triangular interpolation between the 3 common corner points.

Color gamut mapping equation split per terahedron

Equation 13

1) $\forall R_i \geq G_i \geq B_i \Rightarrow$ $$\begin{cases} R_o = \text{Median}(0, (1-R_i)\cdot R_K + B_i\cdot R_W, 1) + \text{Median}(0, (R_i - G_i)\cdot R_R + (G_i - B_i)\cdot R_Y, 1) \\ G_o = \text{Median}(0, (1-R_i)\cdot G_K + B_i\cdot G_W, 1) + \text{Median}(0, (R_i - G_i)\cdot G_R + (G_i - B_i)\cdot G_Y, 1) \\ B_o = \text{Median}(0, (1-R_i)\cdot B_K + B_i\cdot B_W, 1) + \text{Median}(0, (R_i - G_i)\cdot B_R + (G_i - B_i)\cdot B_Y, 1) \end{cases}$$

2) $\forall G_i \geq R_i \geq B_i \Rightarrow$ $$\begin{cases} R_o = \text{Median}(0, (1-G_i)\cdot R_K + B_i\cdot R_W, 1) + \text{Median}(0, (G_i - R_i)\cdot R_R + (R_i - B_i)\cdot R_Y, 1) \\ G_o = \text{Median}(0, (1-G_i)\cdot G_K + B_i\cdot G_W, 1) + \text{Median}(0, (G_i - R_i)\cdot G_R + (R_i - B_i)\cdot G_Y, 1) \\ B_o = \text{Median}(0, (1-G_i)\cdot B_K + B_i\cdot B_W, 1) + \text{Median}(0, (G_i - R_i)\cdot B_R + (R_i - B_i)\cdot B_Y, 1) \end{cases}$$

3) $\forall G_i \geq B_i \geq R_i \Rightarrow$ $$\begin{cases} R_o = \text{Median}(0, (1-G_i)\cdot R_K + R_i\cdot R_W, 1) + \text{Median}(0, (G_i - B_i)\cdot R_R + (B_i - R_i)\cdot R_C, 1) \\ G_o = \text{Median}(0, (1-G_i)\cdot G_K + R_i\cdot G_W, 1) + \text{Median}(0, (G_i - B_i)\cdot G_R + (B_i - R_i)\cdot G_C, 1) \\ B_o = \text{Median}(0, (1-G_i)\cdot B_K + R_i\cdot B_W, 1) + \text{Median}(0, (G_i - B_i)\cdot B_R + (B_i - R_i)\cdot B_C, 1) \end{cases}$$

4) $\forall B_i \geq G_i \geq R_i \Rightarrow$ $$\begin{cases} R_o = \text{Median}(0, (1-B_i)\cdot R_K + R_i\cdot R_W, 1) + \text{Median}(0, (B_i - G_i)\cdot R_R + (G_i - R_i)\cdot R_C, 1) \\ G_o = \text{Median}(0, (1-B_i)\cdot G_K + R_i\cdot G_W, 1) + \text{Median}(0, (B_i - G_i)\cdot G_R + (G_i - R_i)\cdot G_C, 1) \\ B_o = \text{Median}(0, (1-B_i)\cdot B_K + R_i\cdot B_W, 1) + \text{Median}(0, (B_i - G_i)\cdot B_R + (G_i - R_i)\cdot B_C, 1) \end{cases}$$

5) $\forall B_i \geq R_i \geq G_i \Rightarrow$ $$\begin{cases} R_o = \text{Median}(0, (1-B_i)\cdot R_K + G_i\cdot R_W, 1) + \text{Median}(0, (B_i - R_i)\cdot R_R + (R_i - G_i)\cdot R_M, 1) \\ G_o = \text{Median}(0, (1-B_i)\cdot G_K + G_i\cdot G_W, 1) + \text{Median}(0, (B_i - R_i)\cdot G_R + (R_i - G_i)\cdot G_M, 1) \\ B_o = \text{Median}(0, (1-B_i)\cdot B_K + G_i\cdot B_W, 1) + \text{Median}(0, (B_i - R_i)\cdot B_R + (R_i - G_i)\cdot B_M, 1) \end{cases}$$

6) $\forall R_i \geq B_i \geq G_i \Rightarrow$ $$\begin{cases} R_o = \text{Median}(0, (1-R_i)\cdot R_K + G_i\cdot R_W, 1) + \text{Median}(0, (R_i - B_i)\cdot R_R + (B_i - G_i)\cdot R_M, 1) \\ G_o = \text{Median}(0, (1-R_i)\cdot G_K + G_i\cdot G_W, 1) + \text{Median}(0, (R_i - B_i)\cdot G_R + (B_i - G_i)\cdot G_M, 1) \\ B_o = \text{Median}(0, (1-R_i)\cdot B_K + G_i\cdot B_W, 1) + \text{Median}(0, (R_i - B_i)\cdot B_R + (B_i - G_i)\cdot B_M, 1) \end{cases}$$

The 3 common triangular boundaries defined by two equal largest input stimuli are illustrated in Equation 14, which is a special case of the equation elaborated above.

Color gamut mapping by triangular interpolation with equal 2 largest input stimuli Equation 14

1) $\forall R_i =$ $$G_i > B_i \Rightarrow \begin{cases} R_o = \text{Median}(0, (1-R_i)\cdot R_K + B_i\cdot R_W, 1) + \text{Median}(0, (R_i - B_i)\cdot R_Y, 1) \\ G_o = \text{Median}(0, (1-R_i)\cdot G_K + B_i\cdot G_W, 1) + \text{Median}(0, (R_i - B_i)\cdot G_Y, 1) \\ B_o = \text{Median}(0, (1-R_i)\cdot B_K + B_i\cdot B_W, 1) + \text{Median}(0, (R_i - B_i)\cdot B_Y, 1) \end{cases}$$

2) $\forall G_i = B_i > R_i \Rightarrow$ $$\begin{cases} R_o = \text{Median}(0, (1-G_i)\cdot R_K + R_i\cdot R_W, 1) + \text{Median}(0, (G_i - R_i)\cdot R_C, 1) \\ G_o = \text{Median}(0, (1-G_i)\cdot G_K + R_i\cdot G_W, 1) + \text{Median}(0, (G_i - R_i)\cdot G_C, 1) \\ B_o = \text{Median}(0, (1-G_i)\cdot B_K + R_i\cdot B_W, 1) + \text{Median}(0, (G_i - R_i)\cdot B_C, 1) \end{cases}$$

3) $\forall B_i \geq R_i > G_i \Rightarrow$ $$\begin{cases} R_o = \text{Median}(0, (1-B_i)\cdot R_K + G_i\cdot R_W, 1) + \text{Median}(0, (B_i - G_i)\cdot R_M, 1) \\ G_o = \text{Median}(0, (1-B_i)\cdot G_K + G_i\cdot G_W, 1) + \text{Median}(0, +(B_i - G_i)\cdot G_M, 1) \\ B_o = \text{Median}(0, (1-B_i)\cdot B_K + G_i\cdot B_W, 1) + \text{Median}(0, +(B_i - G_i)\cdot B_M, 1) \end{cases}$$

When the input stimuli Ri and Gi are equal while both of them are smaller than Bi, the fourth and fifth partial interpolation equations in Equation 13 produce the same result. These two tetrahedrons share 3 corner points, but the selected secondary color is different: cyan ($R_C$, $G_C$ or $B_C$) and magenta ($R_M$, $G_M$ or $B_M$) respectively. However the contribution of the native secondary color is zero as it is equal to the difference between two equal terms, when input stimuli Ri and Gi are equal. This example leads to a triangular interpolation between the native black (K), the native primary color (P) and the native white (W). The 3 common triangular boundaries defined by two equal smallest input stimuli are illustrated in Equation 15.

Color gamut mapping by triangular interpolation with equal 2 smallest input stimuli Equation 15

$$1)\ \forall R_i > G_i = \quad B_i \Rightarrow \begin{cases} R_o = \text{Median}(0, (1-R_i)\cdot R_K + B_i\cdot R_W, 1) + \text{Median}(0, (R_i - B_i)\cdot R_R, 1) \\ G_o = \text{Median}(0, (1-R_i)\cdot G_K + B_i\cdot G_W, 1) + \text{Median}(0, (R_i - B_i)\cdot G_R, 1) \\ B_o = \text{Median}(0, (1-R_i)\cdot B_K + B_i\cdot B_W, 1) + \text{Median}(0, (R_i - B_i)\cdot B_R, 1) \end{cases}$$

$$2)\ \forall G_i > B_i = \quad R_i \Rightarrow \begin{cases} R_o = \text{Median}(0, (1-G_i)\cdot R_K + R_i\cdot R_W, 1) + \text{Median}(0, (G_i - R_i)\cdot R_G, 1) \\ G_o = \text{Median}(0, (1-G_i)\cdot G_K + R_i\cdot G_W, 1) + \text{Median}(0, (G_i - R_i)\cdot G_G, 1) \\ B_o = \text{Median}(0, (1-G_i)\cdot B_K + R_i\cdot B_W, 1) + \text{Median}(0, (G_i - R_i)\cdot B_G, 1) \end{cases}$$

$$3)\ \forall B_i > R_i = \quad G_i \Rightarrow \begin{cases} R_o = \text{Median}(0, (1-B_i)\cdot R_K + G_i\cdot R_W, 1) + \text{Median}(0, (B_i - G_i)\cdot R_B, 1) \\ G_o = \text{Median}(0, (1-B_i)\cdot G_K + G_i\cdot G_W, 1) + \text{Median}(0, +(B_i - G_i)\cdot G_B, 1) \\ B_o = \text{Median}(0, (1-B_i)\cdot B_K + G_i\cdot B_W, 1) + \text{Median}(0, +(B_i - G_i)\cdot B_B, 1) \end{cases}$$

Similarly when Ri=Gi=Bi, all 6 partial equations of Equation 13 produce the same result. There is no contribution of the native secondary and the native primary colors. The obtained result corresponds to a linear interpolation between the native black point (K) and native white point (W). All triangles and their corresponding equations lead to the same equation when Ri, Gi and Bi are equal. The line connecting the native black point (K) and native white point (W) is the unique line shared by the 3 triangles and the corresponding interpolation is given by Equation 16.

Equation 16

Color gamut mapping of grey input levels $$\forall R_i = G_i = B_i \Rightarrow \begin{cases} R_o = \text{Median}(0, (1-G_i)\cdot R_K + G_i\cdot R_W, 1) \\ G_o = \text{Median}(0, (1-G_i)\cdot G_K + G_i\cdot G_W, 1) \\ B_o = \text{Median}(0, (1-G_i)\cdot B_K + G_i\cdot B_W, 1) \end{cases}$$

As the native grey levels located on the line interconnecting the native black and white points are already precisely calibrated by the S-LUT, the interpolation process within the color gamut mapping should not affect any native grey levels located on this line, even when corrections are necessary for the native primary and secondary colors. Equation 16 illustrates that splitting a hexagonal pyramid into 6 tetrahedrons leads to a common equation for all: a linear interpolation between the native black and white points. This method of color gamut mapping does not disturb the earlier calibrated panel non-linearity leading to the S-LUT and is this is an important reason to select an interpolation method based on tetrahedrons for matching the native color gamut to aa target color gamut.

The different cases defined by equations 13 to 16 produce a continuous function for the output stimulus per sub-pixel ($R_O$, $G_O$, $B_O$). In other words slight changes in input stimuli which can lead to a different selected tetrahedron inside the hexagonal pyramid can't introduce discontinuities in color reproduction, which means the decision process of selecting the right tetrahedron for color gamut mapping is insensitive to image noise.

Precision Required when Matching White Point Only

Gammatizing the DICOM LUT Data

In case an absolute colorimetric color gamut calibration is not required for a certain use case or when a display does not need to support any use cases requiring colorimetric gamut control, it is possible to reduce the implementation costs of embodiments of the present invention by gammatizing the intermediate image processing format.

Linear colorimetric color gamut matching can be represented by a 3×3 matrix operating on a set of $R_i$, $G_i$, $B_i$ input values resulting in a set of $R_O$, $G_O$, $B_O$ output values. In case only a white balance adjustment is performed, only the elements located on the main diagonal of the matrix differ from zero, as illustrated in Equation 17 where the gamma exponent on the right indicates the gamut converted values.

Equation 17

Color gamut convertor performing white balance compensation $$\begin{bmatrix} R_o \\ G_o \\ B_o \end{bmatrix} = \begin{bmatrix} R_W & 0 & 0 \\ 0 & G_W & 0 \\ 0 & 0 & B_W \end{bmatrix} \cdot \begin{bmatrix} R_i \\ G_i \\ B_i \end{bmatrix} \Leftrightarrow$$

$$\begin{cases} R_o = R_W \cdot R_i \\ G_o = G_W \cdot G_i \\ B_o = B_W \cdot B_i \end{cases} \Leftrightarrow \begin{cases} R_o^\gamma = R_W^\gamma \cdot R_i^\gamma \\ G_o^\gamma = G_W^\gamma \cdot G_i^\gamma \\ B_o^\gamma = B_W^\gamma \cdot B_i^\gamma \end{cases}$$

The values $R_W$, $G_W$ and $B_W$ represent the weights for each individual primary color contributing to the white point. As illustrated the matrix can be replaced by 3 individual equations in the particular case of white point correction uniquely. Therefore the operation can be performed using gammatized primary stimuli encoding as the gammatizing (or pure power) function of the output ($R_O$, $G_O$, $B_O$) can be distributed across the video stimulus ($R_i$, $G_i$, $B_i$) and its weight ($R_W$, $G_W$, $B_W$), as illustrated in the last equivalent representation in Equation 17.

The amount of bits which must be added by the 1D DICOM profile described in embodiments of the present invention caused by the small steepness in some parts of the transfer function can be reduced dramatically as illustrated Equation 18 as the content of the DICOM LUT is now calculated based on the 4 conversion steps:

Step 1: First the normalized integer 10-bit input is converted (process block) to a real (non-integer) J-index value by taking into account the J-index values for the black and white levels: a de-normalizing process.

Step 2: Secondly the DICOM transfer function converts (process block) J-index values into linear luminosity values.

Step 3: Thirdly the luminosity value is normalized (process block) to $L_n$ by considering the luminosity levels for the black and white levels.

Step 4: Finally the real (non-integer) gammatized luminosity is converted (process block) to a normalized N-bit integer value (the read data value).

In Equation 18 the gamma γ is the gamma value.

Equation 18

Gammatized 1D *DICOM* Transfer function illustrated for a 10-bit input and *N* bit output.

$$J = JfromI\ (\text{Input}) = J_{black} + (J_{white} - J_{black}) \cdot \frac{\text{Input}}{2^{10} - 1}$$

$$L = LfromJ\ (J)$$

$$L_n = \frac{L - L_{black}}{L_{white} - L_{black}}$$

$$\text{Output} = OfromL(L) = L_n^{1/\gamma} \cdot O_{white}(N)$$

As the read data values are gammatized prior to a normalized integer quantization, the value of gamma can be chosen for best quality/resources ratio. The smoothest grey tracking, especially within the dark grey levels, is obtained when the minimal steepness of the overall transfer function is maximized.

Figure 34:
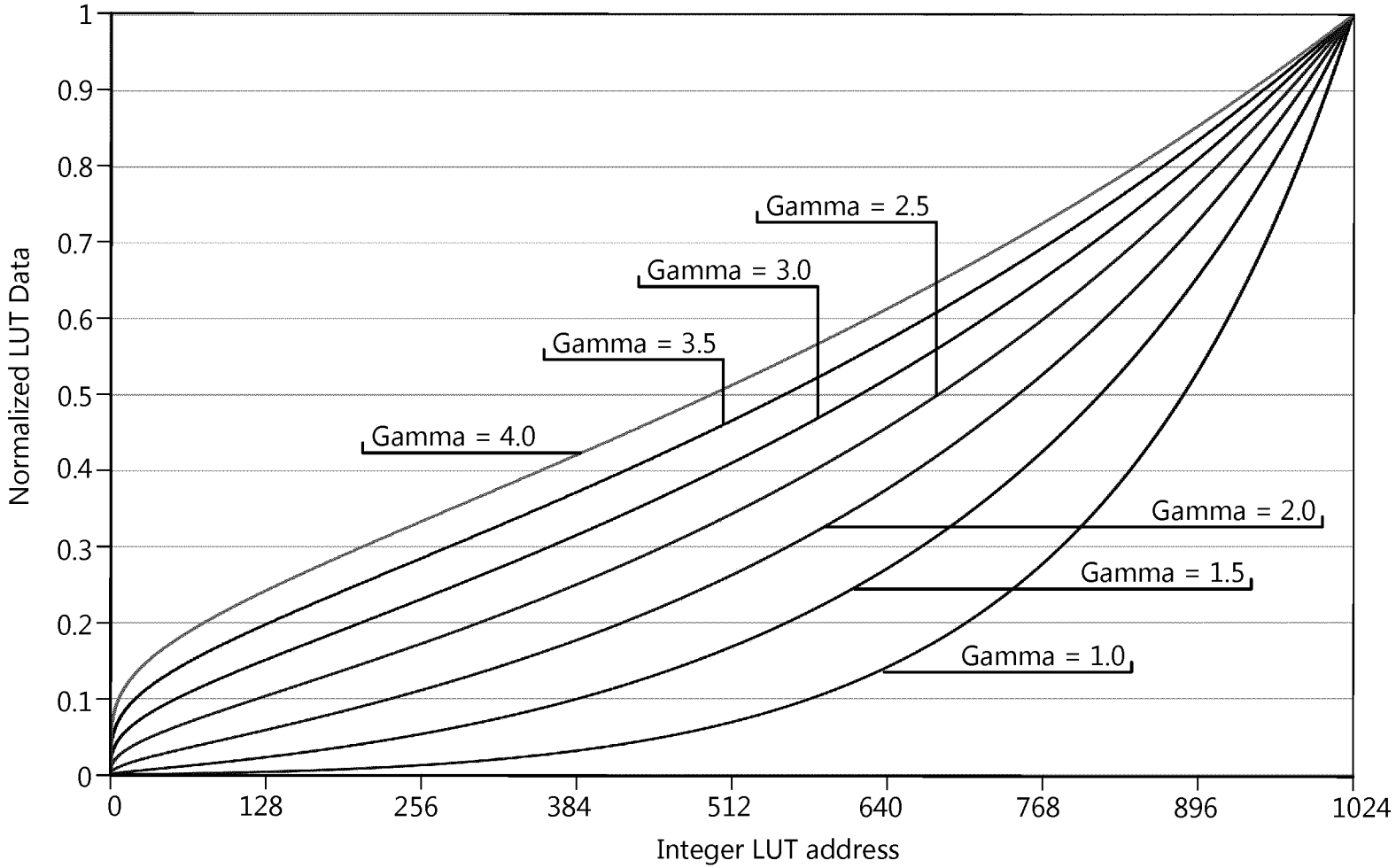
FIG. 34 shows a normalized DICOM LUT Data (in floating point) as function of the integer LUT address for multiple values of gamma.

FIG. 34 shows the normalised DICOM LUT data 'stored in memory) per LUT address for multiple gramatizations (at different gamma values). As FIG. 34 illustrates, the steepness of the transfer curves in the dark grey levels increases with the value of gamma, while the steepness near the white level decreases with augmenting gamma values.

The bottom curve in FIG. 34 represents the DICOM transfer function for a display with a contrast of 1600:1 and a brightness of 1000 Nit. As described earlier, the LUT data precision requires a minimum of 17 bits in order not to lose any grey levels because of the very small steepness in the dark grey levels. The more the LUT data is gammatized, the steeper the transfer curve starts in the origin (the black point) and thus the less precision is required to avoid color loss.

The upper curve in FIG. 34 represents a gammatization with a value of 4. As can be noticed the combined transfer function (DICOM+gammatization) is fairly linear for the upper 95% of the transfer function. This partially indicates that a minimum amount of bits is required for the DICOM LUT data. As the LUT address has a precision of 10 bits, the absolute minimum data width is 11 bits as any non-linear transform requires at least 1 bit extra precision in case all input values are valid and distinguishable.

Figure 35:
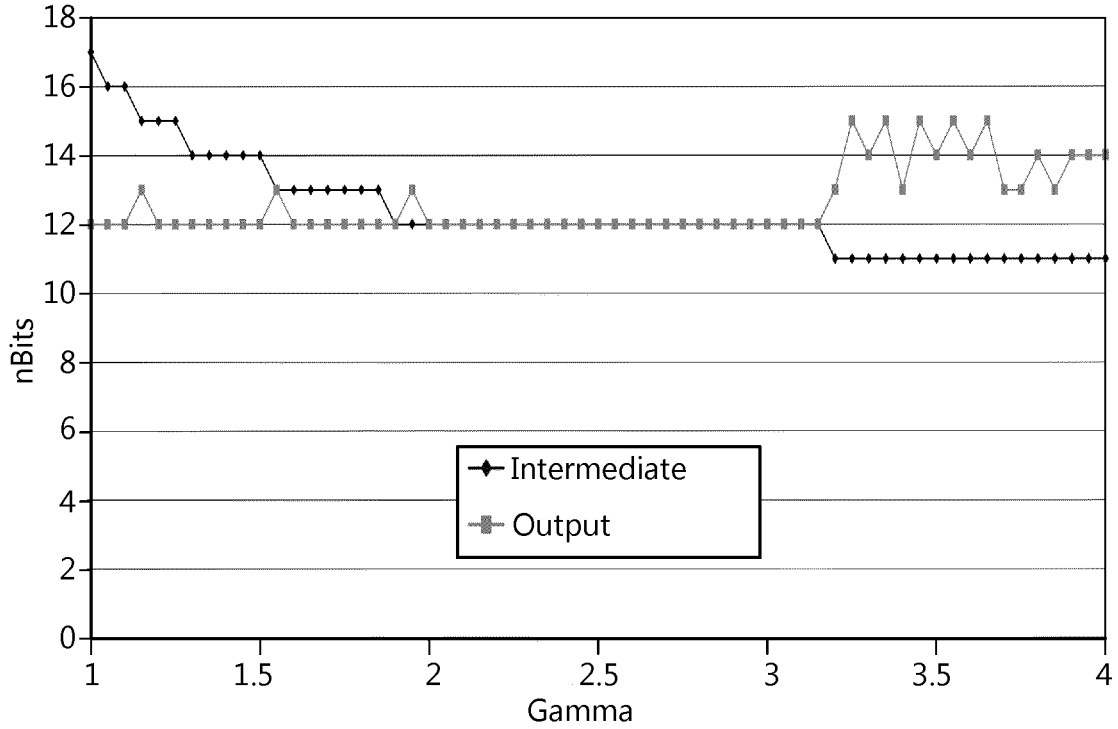
FIG. 35 shows minimal video data width required to represent the DICOM LUT data and the output gammatization LUT data as function of the gamma value in order to avoid color detail loss.

The evolution of the amount of bits required to represent the DICOM LUT data in order not to lose any color details or grey levels when changing the value of gamma is illustrated in FIG. 35 which shows the minimum DICOM LUT data width and output LUT data width to avoid color loss as function of gammatization.

A curve in FIG. 35 represents the intermediate video data width which is required to represent the DICOM LUT data for a given gammatization. Without gammatization, when the value of gamma equals 1, 17 bit precision is required to avoid loss of colors of grey levels. When gamma is 1.9 the required precision is reduced to 12 bit LUT read data. For gamma values above 3.1 the absolute minimum reachable video data width is achieved.

The Best Value of Gamma for Gammatizing Luminosity

So far one could argue, the higher the value of gamma, the better. A gammatization applied to the DICOM transfer function with a gamma value of 4 indeed results in a smooth overall transfer curve, as illustrated by the upper curve in FIG. 34. However, in case the intermediate image processing gammatization value is higher than the gamma value used at the output to drive the display, the precision of the output LUT read data needs to increase caused by a number of reasons.

A first reason for the extra required output gammatization LUT data precision is the reduced minimal steepness in that transfer function. For intermediate gammatization values higher than the output gammatization, the minimal steepness moves to the dark grey levels, making the quantization artefacts relatively larger and thus more critical.

A second reason is that a too high gamma value introduces interpolation errors between successive output LUT data values, especially in the medium dark grey levels. When the output gamma value (the display being calibrated at 2.4 for example) is smaller than the intermediate gamma value, the interpolation errors are amplified by the steeper curve near the white point.

A third less obvious reason is due to the floating point encoding. As described before, the output gammatization LUT is implemented by floating point addressing as a floating point representation of video data representing linear luminosities is extremely efficient when taking into account visual perception. However, as gammatization can also be considered as an efficient form of entropy coding for linear luminosities, at least for human visual perception (e.g. approximated by the Barten Model), there's less of a benefit from an additional floating point representation. That said, the optimal floating point exponent changes with the gamma value, which impacts the earlier described 2 effects affecting the LUT data width.

The combination and interaction between the above described 3 effects leads to the counter-intuitive changes of the number of bits required by the output gammatization LUT data. For gamma values between 2 and 3.2 the intermediate video width equals the output video width. For higher gamma values the required output precision varies quite unpredictably, but the precision is always higher than the minimum precision of 12 bits.

Figure 36:
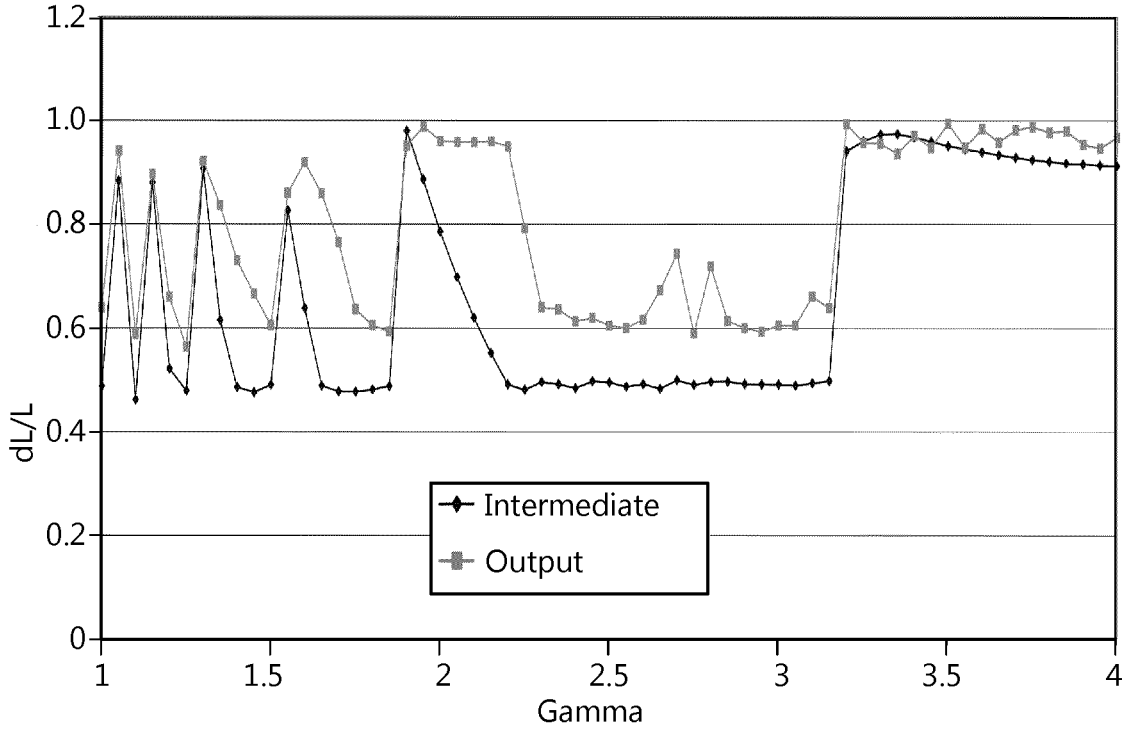
FIG. 36 shows worst case relative dL/L ratio error as function of the gamma value when all video widths are minimized while preserving all input grey levels.

While FIG. 35 illustrates the minimal video data width required to represent the DICOM LUT data as well as the output gammatization LUT data as function of the gamma value, in order not to lose any grey levels, it does not reflect the evolution of the true precision of the video processing. This precision can be expressed as a worst case relative dL/L ratio error. In case this error is higher than 1, the quantizing interval tolerance is more than 100% (equivalent to more than doubling some of the quantizing intervals), causing a certain grey level loss. FIG. 36 illustrates the evolution of this dL/L quality metric when minimizing video widths per gammatization. The figure shows the dl/L metric in function of intermediate gammatization with minimal videowidths to avoid color loss.

The best precisions are obtained for gamma values somewhere between 2.3 and 2.55 for both the DICOM transfer function apart and the total video path which cascades both LUTs. As we expected these curves lie between the values of 0.5 and 1. A ratio higher than 1 would indicate color loss while a value below 0.5 would indicate the potential for an additional bit reduction. The upper curve represents the quantizing interval precision obtained by the complete video path. The global tolerance curve is situated mainly above the tolerance associated with the DICOM transfer LUT, with a few exceptions which can be explained by 2 successive quantizing processes (by the 2 LUTs) coincidently compensating each other a bit for the worst case grey level.

The quantized relative dL/L error can be considered as a common quality metric for image processing paths, which reveals the smoothness of the grey tracking. The lower the number, the smoother the grey levels are transferred to perceived luminosities. In accordance with an embodiment of the present invention the relative dL/L metric is calculated by Equation 19.a.

Equation 19a

Relative dL/L metric validating the *DICOM* compliant grey tracking transfer function $$J(i) = JfromI(i) = J_{black} + (J_{white} - J_{black}) \cdot \frac{i}{2^{10} - 1}$$

$$L(i) = LfromJ(J(i))$$

$$L_n(i) = \frac{L(i) - L_{black}}{L_{white} - L_{black}}$$

$$\frac{\Delta L_n(i)}{L_n(i)} = 2 \cdot \frac{L_n(i) - L_n(i-1)}{L_n(i) + L_n(i-1)}$$

The first step in equation 19a calculates the J index from the 10 bit quantized input video level i. The second step applies the DICOM transfer function to convert the J index to an absolute luminosity value L(i), representing a linear amount of photons. The luminosity is then converted to a normalized value $L_n$ where black is represented by zero and white is represented by one. Finally the dL/L metric is calculated as the ratio of the difference of any 2 successive normalized luminosity values and their average value.

The relative quantized dL/L metric is calculated by Equation 19.b.

Equation 19b

Relative quantized dL/L metric representing the relative steepness variations of the *DICOM* compliant grey tracking $$D(i) = I[L_n(i)^{1/\gamma} \cdot O_{white}(N)]$$

$$I[L_n(i)] = \left(\frac{D(i)}{O_{white}(N)}\right)^{\gamma}$$

$$\frac{\Delta I[L_n(i)]}{I[L_n(i)]} = 2 \cdot \frac{I[L_n(i)] - I[L_n(i-1)]}{I[L_n(i)] + I[L_n(i-1)]}$$

The first step in equation 19b calculates the integer data value D(i) stored in the DICOM LUT by gammatizing the normalized luminosity $L_n$ before truncating the result to an integer value, indicated by the I[ . . . ] operator. The second step converts the integer LUT data value back to a quantized version of the normalized luminosity $L_n$. The third and final step calculates the quantized dL/L metric as the ratio of the difference of any 2 successive quantized normalized luminosity values and their corresponding average value. Note that the value of gamma defines the quantizing intervals of the LUT data and thus its value affects the quantized dL/L metric.

The relative quantized dL/L error metric can be calculated by Equation 19c.

Equation 19c

Relative dL/L quantizing error metric representing the smoothness of *DICOM* compliant grey tracking $$\varepsilon\left(\frac{\Delta L(i)}{L(i)}\right) = \frac{\left|\frac{\Delta I[L_n(i)]}{I[L_n(i)]} - \frac{\Delta L_n(i)}{L_n(i)}\right|}{\frac{\Delta L_n(i)}{L_n(i)}}$$

The relative difference between the results of equations 19a and 19b is represented by equations 19c. As the result of the second equation is affected by the value of gamma and the number of read data bits N, so is the final error metric. This dependency was illustrated in FIG. 36.

In order to avoid any loss of color detail, it is sufficient to constrain the relative dL/L quantizing error metric (in equation 19c) below 1. However in order to pass any possible implementation of a DICOM compliancy test, the value of the error (dL/L) should be constrained to a maximum relative error of 15%. As expected, the amount of bits required to guarantee this precision compared to FIG. 35, where gamma values in the range between 1.9 and 3.1 required only 12 bit LUT data precision for the error (dL/L)<1.

Figure 37:
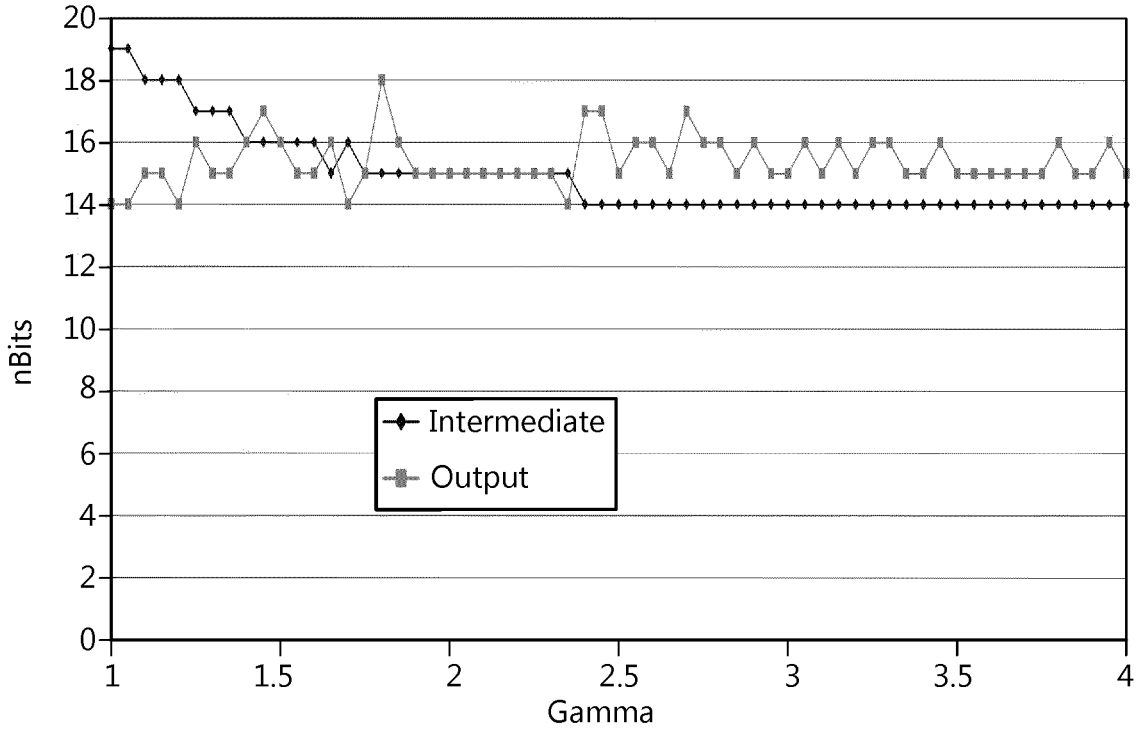
FIG. 37 shows minimal video data width required to represent the DICOM LUT data and the output gammatization LUT data as function of the gamma value in order to achieve DICOM compliancy.

In case the relative dL/L quantizing error metric being the error (dL/L)<0.15 to satisfy the DICOM grey tracking for all possible validation methods a higher precision is required in an optimal range for gamma values between 1.9 and 2.3, as illustrated in FIG. 37 which shows minimum video data width (DICOM LUT data width) required to represent the DICOM LUT data and the output gammatization LUT data as function of the gamma value in order to achieve dL/L tolerance as a function of the intermediate gammatization.

Figure 38:
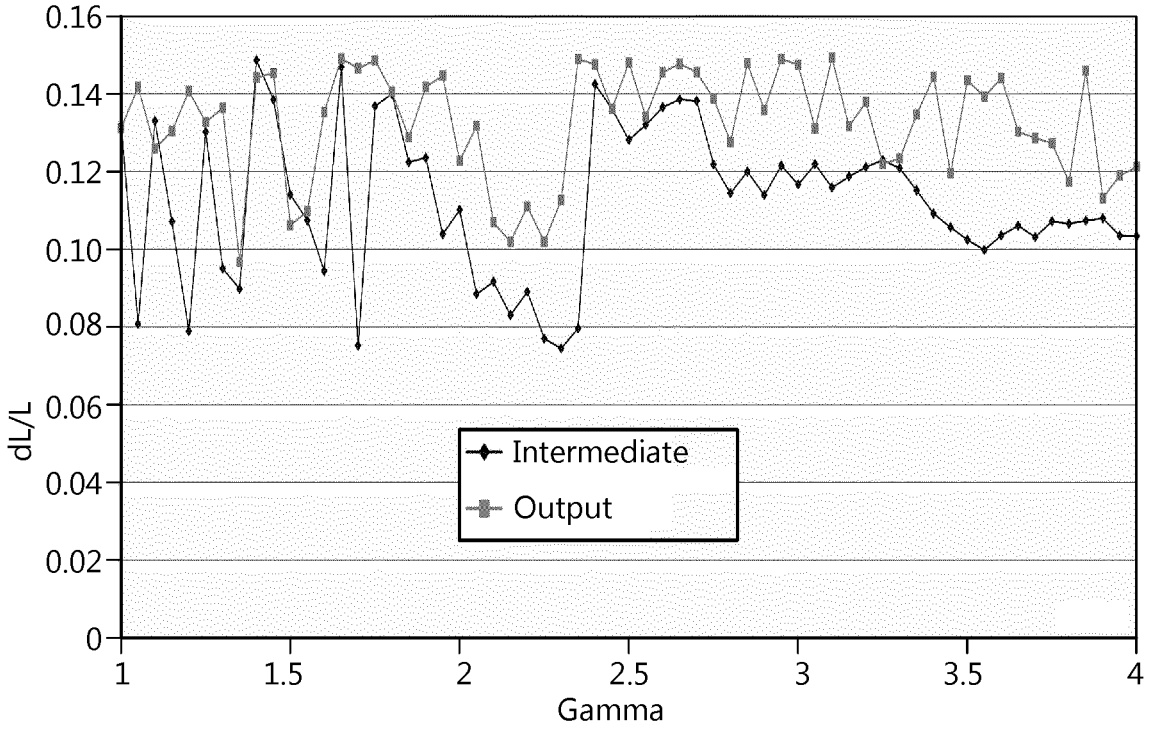
FIG. 38 shows worst case relative dL/L ratio error as function of the gamma value when all video widths are minimized to achieve full DICOM compliancy.

The constraint applied to the relative dL/L quantizing error metric E(dL/L) is verified in FIG. 38 which shows the dL/L metric as a function of the intermediate gammatization with minimized video widths in order to achieve full DICOM compliancy. The E(dL/L) metric indeed never exceeds the value of 15%.

The Best Floating Point Representation of Linear Luminosity

One important aspect which contributes to this metric has not been taken into account yet: the floating point encoding precisions of mantissa and exponent. As the transfer function example in FIG. 9 already indicated when a floating point number with 8 bit mantissa and a 3 bit exponent is converted to an to integer value: this conversion process is a piece wise linear interpolated approximation of a pure exponential function.

Regardless of the precision used to represent the mantissa and the exponent, the linear value extracted from any normalized floating point number is always a piece wise linear approximation of a pure exponential function which can be represented by equation 20.

Equation 20

Pure exponential function approximating linear extraction from normalized floating point value $$i = \frac{c^f - 1}{c - 1}$$

An arbitrary floating point value combines an exponent (as most significant bits) with a mantissa (as least significant bits) and forms a single integer value, which can be normalized to a standard floating point number f, having an independent arbitrary precision where 1 represents the maximal original number. This value of f represents the power of a constant in equation 20, where the black level is normalized to 0 by subtracting 1 and where the white level is normalized to 1 by the denominator in the equation, in order to obtain the integer value i.

The value of the constant c is a function of the display's contrast. To be precise: it is equivalent to the finite contrast used within the gamma transfer function for an infinite value of gamma. The notation of 'c' can be used as well to denote contrast. This can be derived from the gamma transfer function in Equation 21.

$$L=v^{\gamma}$$

Equation 21—Pure gammatized video function

When the normalized video level v (or represented by v) is purely gammatized, the luminosity L is also gammatized. In that case the luminosity corresponding to the black level is 0, which corresponds to an infinite contrast. In order to take into account the contrast during the gamma transfer function, an offset can be applied to the video level, while at the same time attenuating the video level accordingly, in order to leave the white level unaffected. This contrast compensation is illustrated in Equation 22.

$$L=[K+(1-K)\cdot v]^{\gamma}$$

Equation22—Gammatized function of video with offset K

The black level offset value K applies a scaling of the video level to preserve the white level. Equation 22 does not preserve a normalized output L for a black level video input (when v=0 (or represented by v)). In order to obtain a fully normalized LUT output representing the luminosity L, the black offset must be subtracted from Equation 22. As this affects the white level output, the result must be scaled using the white level output.

Equation 23

Fully normalized gammatizing function of video with offset $K$ $$L=\frac{[K+(1-K)\cdot v]^{\gamma}-K^{\gamma}}{1-K^{\gamma}}$$

The denominator in Equation 23 performs the scaling needed to normalize the white level. It represents the normalized white luminosity minus the normalized black luminosity. The display contrast can be expressed as a function of this video offset value.

Equation 24

Contrast as function of video offset $K$ with fully normalized gammatization $$c=\frac{1}{K^{1/\gamma}}\Rightarrow K=\frac{1}{c^{1/\gamma}}$$

The higher the contrast, the smaller the video offset level K as illustrated in Equation 24. The offset value increases with the value of gamma. The result for the video offset level K obtained in Equation 24 can substitute the value of K in Equation 24, which provides Equation 25.

Equation 25

Fully normalized gammatizing function for a given contrast $$L=\frac{\left[\frac{1}{c^{1/\gamma}}+\left(1-\frac{1}{c^{1/\gamma}}\right)\cdot v\right]^{\gamma}-\frac{1}{c}}{1-\frac{1}{c}}$$

The transfer function in Equation 25 from video level v (or as represented by v) to normalized luminosity L has 2 parameters: the value of gamma and the contrast. Interestingly, the ideal value of gamma does not converge to an expected value in a range between 2 and 3, but the best value of the dL/L metric is obtained for a gamma value of infinity, while the contrast value c is somewhere in an expected range between 100:1 and 1000:1. This unexpected result can be explained by evaluating the mathematical limit for L for an infinite value of gamma, as illustrated in Equation 26.

[Equation 26]

The equivalence of normalized contrast compensated gammatization and pure exponential normalized video coding $$\lim_{\gamma\to\infty}\left[\frac{\left[\frac{1}{c^{1/\gamma}}+\left(1-\frac{1}{c^{1/\gamma}}\right)\cdot v\right]^{\gamma}-\frac{1}{c}}{1-\frac{1}{c}}\right]=\frac{c^{v}-1}{c-1}$$

This equality leads to an important conclusion: as it is possible to adjust the white balance for a gammatized video signal, regardless of the value of gamma, an exponential coding as described for embodiments of the present invention is suited as well for such a processing step. As intermediate video processing steps such as the white balance adjustment also affect the black level (defined by the contrast), the processed black level should be removed (subtracted) from the signal after the initial processing step.

The normalized contrast compensated gamma transfer function can be considered as a universal video level coding to represent linear luminosity as it is not only capable of accommodating a pure gamma transfer function but also a pure exponential transfer function, depending on the choice of the parameter values for gamma and contrast.

This equality in Equation 26 can be easily verified by evaluating the deviation in Equation 27 in a few steps.

[Equation 27]

Proof of the equivalence of a normalized contrast compensated gammatization and a pure exponential normalized video coding $$\lim_{\gamma\to\infty}\left[\frac{\left[\frac{1}{c^{1/\gamma}}+\left(1-\frac{1}{c^{1/\gamma}}\right)\cdot v\right]^{\gamma}-\frac{1}{c}}{1-\frac{1}{c}}\right]=\lim_{\gamma\to\infty}\left[\frac{c\cdot\left[\frac{1}{c^{1/\gamma}}+\left(1-\frac{1}{c^{1/\gamma}}\right)\cdot v\right]^{\gamma}-1}{c-1}\right]=$$

$$\frac{\lim_{\gamma\to\infty}\left[c\cdot\left[\frac{1}{c^{1/\gamma}}+\left(1-\frac{1}{c^{1/\gamma}}\right)\cdot v\right]^{\gamma}\right]-1}{c-1}=$$

$$\frac{\lim_{\gamma\to\infty}\left[\frac{c^{1/\gamma}}{c^{1/\gamma}}+\left(c^{1/\gamma}-\frac{c^{1/\gamma}}{c^{1/\gamma}}\right)\cdot v\right]^{\gamma}-1}{c-1}=$$

-continued $$\frac{\lim_{\gamma\to\infty}[1+(c^{1/\gamma}-1)\cdot v]^{\gamma}-1}{c-1} \Big\Downarrow e^{1/\gamma} =$$

$$1+\frac{1}{\gamma}+\frac{1}{\gamma^2}+\frac{1}{\gamma^3}+\ldots \Rightarrow c^{1/\gamma}=1+\ln(c)\cdot\left(\frac{1}{\gamma}+\frac{1}{\gamma^2}+\frac{1}{\gamma^3}+\ldots\right)=$$

$$\frac{\lim_{\gamma\to\infty}\left[1+\left(1+\ln(c)\cdot\left(\frac{1}{\gamma}+\frac{1}{\gamma^2}+\frac{1}{\gamma^3}+\ldots\right)-1\right)\cdot v\right]^{\gamma}-1}{c-1}=$$

$$\frac{\lim_{\gamma\to\infty}\left[1+\left(1+\ln(c)\cdot\frac{1}{\gamma}-1\right)\cdot v\right]^{\gamma}-1}{c-1}=$$

$$\frac{\lim_{\gamma\to\infty}\left[1+\frac{\ln(c)\cdot v}{\gamma}\right]^{\gamma}-1}{c-1} \Big\Downarrow \forall n\to 0:(1+n)^{\gamma}=1+n\cdot\gamma=$$

$$\frac{\lim_{\gamma\to\infty}\left[1+\frac{1}{\gamma}\right]^{\gamma\cdot\ln(c)\cdot v}-1}{c-1}=\frac{\left[\lim_{\gamma\to\infty}\left[1+\frac{1}{\gamma}\right]^{\gamma}\right]^{\ln(c)\cdot v}-1}{c-1}=$$

$$\frac{e^{\ln(c)\cdot v}-1}{c-1}=\frac{[e^{\ln(c)}]^{v}-1}{c-1}=\frac{c^{v}-1}{c-1}$$

Pure exponential video coding is equivalent to having a fixed relative increment of the luminosity per quantized video level, in other words every quantizing level has the same proportional luminosity variation. Therefore exponential video coding can be considered as a good way of perceptually optimizing the entropy per bit for a digital video signal, a property which is the essence of the DICOM transfer function, as illustrated in Equation 1.

While the DICOM representation of the quantized J-index values does not allow performing certain steps of image processing, such as the white balance control, the exponential video coding can be used for such a task, as it is equivalent to a contrast compensated form of gammatization. Therefore it makes sense to compare both transfer functions more in detail, as illustrated in FIG. 39 which shows the DICOm transfer function compared to exponential video coding.

Figure 39:
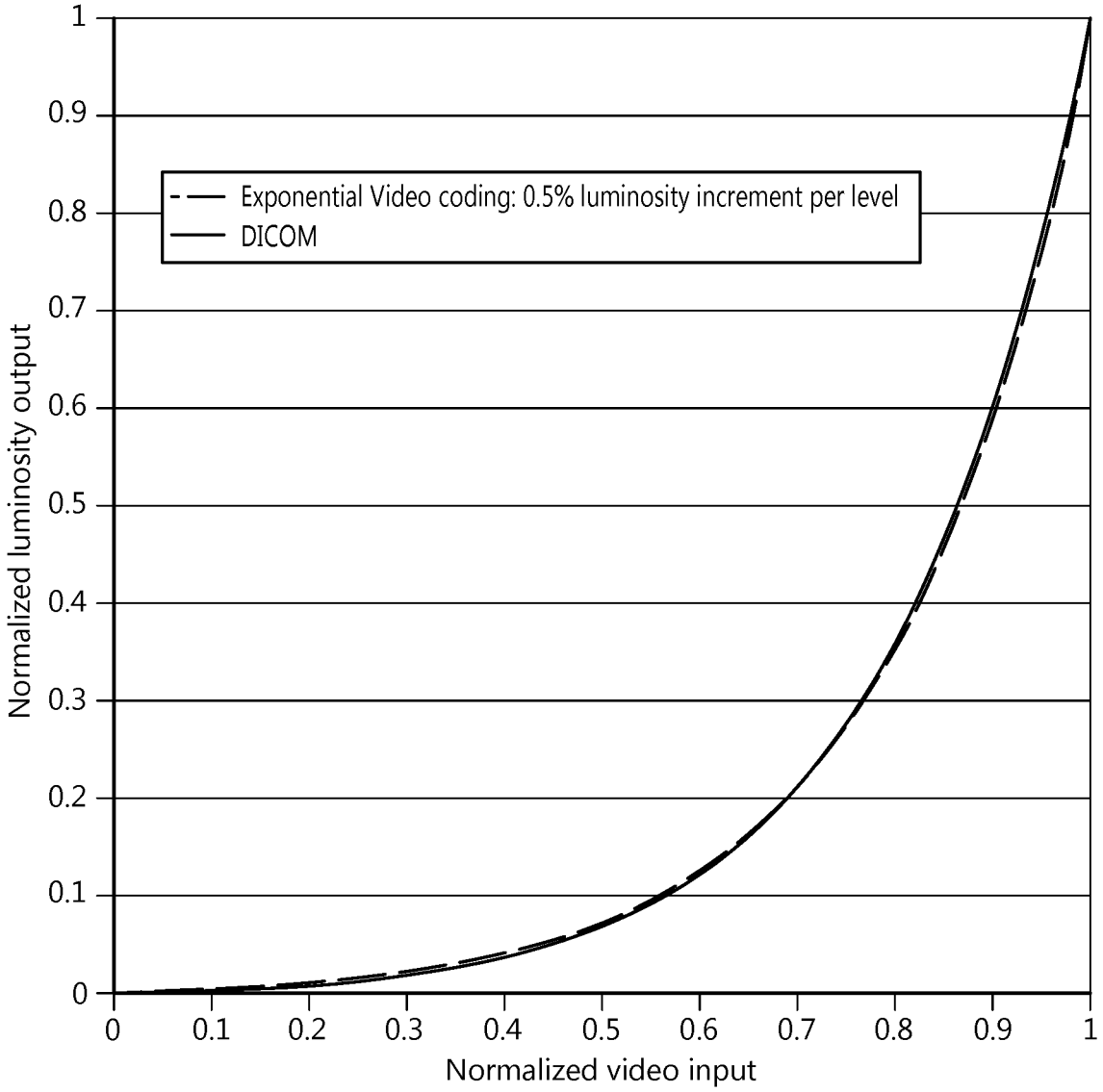
FIG. 39 shows a comparison of the DICOM transfer function with exponential video coding corresponding to a contrast of 162.

In FIG. 39 the contrast value within the exponential video coding formula (see Equation 26) is solved to a value of 162:1 in order to minimize the RMS error between both transfer functions. In that case the luminosity increases by almost exactly 0.5% for each quantized video level. Note that the compared DICOM transfer function corresponds to a white luminosity of 1000 Nit and a contrast of 1600:1.

When the contrast value within the exponential video coding formula (see Equation 26) is set to a value around 250:1 the DICOM curve is best approximated for the dark grey levels. In that case, the luminosity increases by about 0.54% per quantizing level. In other words this DICOM transfer function evolves from an exponential function with relative increments of 0.54% in the dark levels to 0.50% in the bright levels. By keeping the relative increment value constant at 0.50% per quantizing interval a very good approximation of the DICOM transfer function is obtained, but unlike the DICOM representation, enabling corrections such as white balance control or color temperature.

As exponential video coding proves to be a very useful approximation of the DICOM transfer function, applying its inverse function to the DICOM transfer function should result in a nearly straight function with limited variations of the curve steepness. The inverse exponential video coding transfer function is derived in equation 28 starting from the data representation D that was used in the comparison above. The extracted video level v represents the exponentially encoded luminosity corresponding to the intermediate LUT data output which represents linear normalized luminosities.

Equation 28

Inverse pure exponential normalized video coding $$D=\frac{c^{v}-1}{c-1} \Rightarrow D\cdot(c-1)+1=$$

$$c^{v} \Rightarrow \ln[D\cdot(c-1)+1]=\ln[c^{v}] \Rightarrow v=\frac{\ln[D\cdot(c-1)+1]}{\ln[c]}$$

In case of a 10 bit video input corresponding to the DICOM standard, the LUT data output can be calculated as by combining equations 19a and 28 whereby in equation 29 $L_{white}$ represents the luminosity for the maximum video level (1023 in case of 10-bit video encoding) and $L_{black}$ represents the luminosity for the minimum video level (0).

[Equation 29]

Exponential coding on normalized *DICOM* transfer function $$J(i)=JfromI(i)=J_{black}+(J_{white}-J_{black})\cdot\frac{i}{2^{10}-1}$$

$$L(i)=LfromJ(J(i))$$

$$L_n(i)=\frac{L(i)-L_{black}}{L_{white}-L_{black}}$$

$$L_e(i)=\frac{\ln\left[L_n(i)\cdot\left(\frac{L_{white}}{L_{black}}-1\right)+1\right]}{\ln\left[\frac{L_{white}}{L_{black}}\right]}$$

Figure 40:
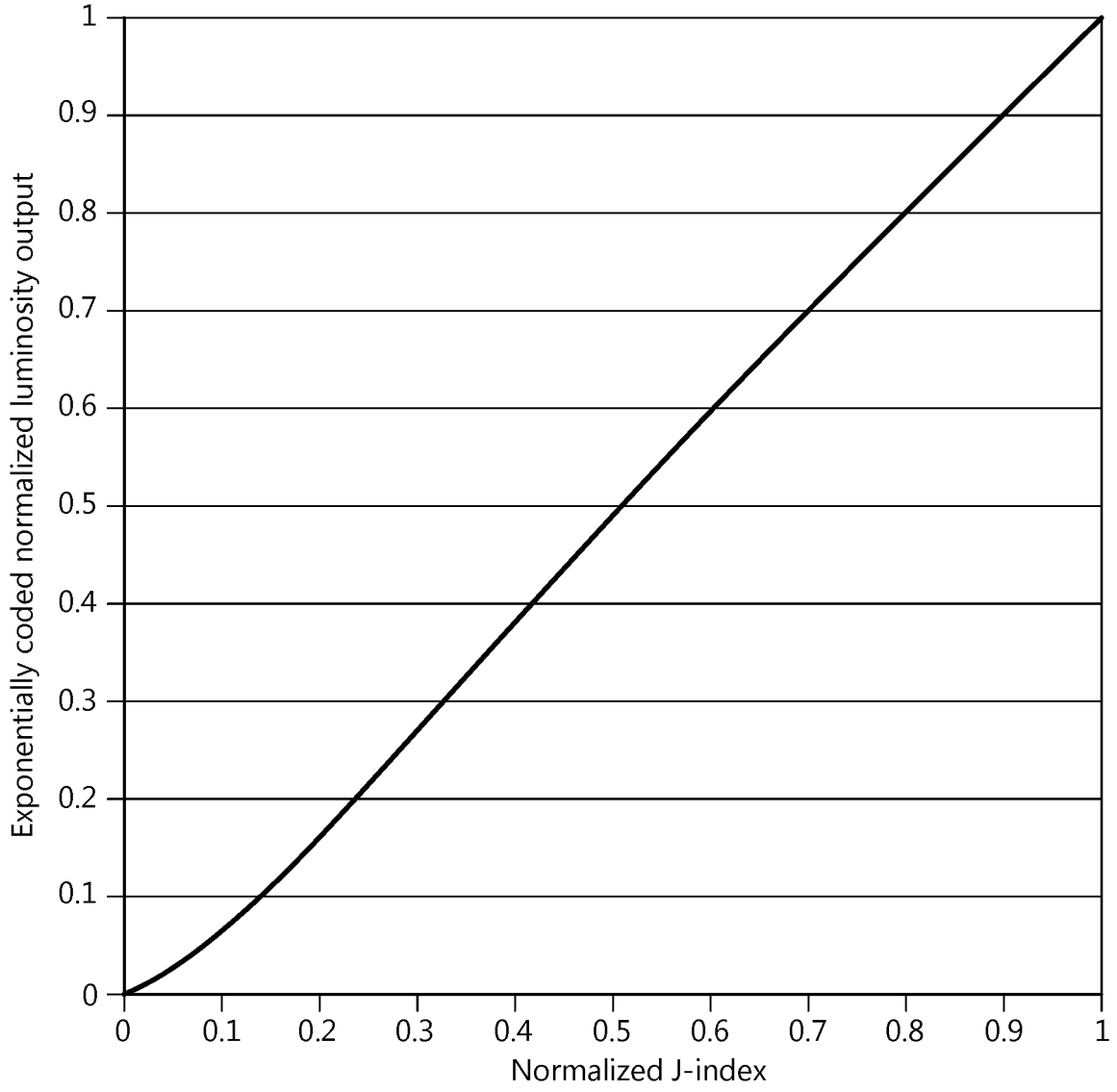
FIG. 40 shows exponentially coded DICOM transfer function.

The exponential representation of the luminosity $L_e$ has a near linear relation to the normalized J-index applied as the 10-bit video input, as illustrated in FIG. 40 which shows exponentially coded normalized DICOM transfer function as obtained by this embodiment of the present invention.

The embodiment provides a very good representation of the DICOM transfer function by exponential video encoding. A floating point representation of linear luminosities in accordance with embodiments of the present invention is well suited for video. A transfer function example of floating point numbers with 8 bit mantissa and a 3 bit exponent converted to integer numbers was illustrated in FIG. 8. When both the input- and output-values are normalized (instead of using absolute integer values as in FIG. 11) the transfer function can be compared to a pure exponential coding function as given by equation 26.

FIG. 41, shows a comparison of floating point number transfer function (according to embodiments of the present invention) with best matching exponential video coding corresponding per exponent width. Equation 27 includes a contrast variable c, hence the embodiments of the present invention provide in one aspect a perceptual quantizer for providing a linear perceptual quantizing process of an Electro-Optical Transfer Function (EOTF) for converting received digital code words of a video signal into visible light having a luminosity emitted by a display, whereby the perceptual quantizer is target contrast dependent. It provides an exponential video coder comprising means for providing quantized video levels, with which there is a fixed relative increment of luminosity per quantized video level, so that every quantized video level visibly has the same proportional luminosity variation.

With reference to the feature "visibly has the same proportional luminosity variation" "visibly" can be understood from the Barten human vision model.

In FIG. 41 the dotted line curves represented here are normalized versions of the transfer function, for different values of this contrast parameter c. The horizontal axis represents the normalized perceptually encoded video value, while the vertical axis represents the corresponding normalized linear encoded luminosity value, where the black level is normalized to 0 and the white luminosity level is normalized to 1.

The solid line curves represent the transfer function from a linear number to a floating point number in accordance with some embodiments of the present invention. The horizontal axis represents the normalized floating point encoded video value for a given exponential width, while the vertical axis represents the corresponding normalized linearized value, where the smallest value is normalized to 0 and the highest value is normalized to 1, for matching the scales of solid and dotted lines.

This reveals that, when applying a normalizing step to both conversion processes, the overall shape of an exponential function can be approximated very well, especially for higher exponential widths. As higher exponential widths allow for handling a higher dynamic range more appropriately, this approximation performs better for higher dynamic ranges. This indicates that for practical purposes, the exponential function can be approximated by a more cost-effective floating point conversion. It provides the advantage to further reduce the amount of resources, while maintaining high pixel value precision. A more cost effective embodiment can use an arbitrary precision floating point conversion in which the exponential width is chosen based on the desired dynamic range to be represented.

As can be evaluated form FIG. 41 the floating point number representations match the exponential video coding transfer functions very well for exponent width values above 2. The floating point value representations with exponents having a precision of 3 bit or higher can be considered as a piece wise linear approximation of the exponential video coding given by equation 26 which represents a contrast compensated gamma transfer function.

The invention claimed is:

1. A perceptual quantizer for providing a linear perceptual quantizing process of an Electro-Optical Transfer Function (EOTF) for converting received digital code words of a video signal into visible light having a luminosity emitted by a display, the perceptual quantizer comprising: a target contrast dependent exponential video coder comprising means for providing quantized video levels, with which there is a fixed relative increment of luminosity per quantized video level, so that every quantized video level visibly has the same proportional luminosity variation, wherein the linear perceptual quantizing process comprises processing $L=(c^v-1)*K$ based on $c^v$ being implemented in a single DSP block inside a processing engine, wherein c is perpetual contrast, which is a measure for a target dynamic range, v is normalized video (0=black, 1=white), the constant $K=1/(c-1)$ and $L=(c^v-1)*K$ represents the linear luminosity derived with linear operators from $c^v$.

2. The perceptual quantizer according to claim 1, wherein visibly has the same proportional luminosity variation is referred to the Barten human vision model.

3. The perceptual quantizer according claim 1, wherein the EOTF is a limit based transform of a gamma function in which gamma goes to infinity.

4. The perceptual quantizer according to claim 1, wherein the EOTF is implemented as a processing pipeline from input to output, whereby the pipeline comprises a series of image processing blocks.

5. The perceptual quantizer according to claim 1, implemented in a processing engine executing a software algorithm.

6. The perceptual quantizer according to claim 5, wherein the processing engine is an FPGA.

7. The perceptual quantizer according to claim 1, wherein the EOTF of a complete display system is applied to signals received at a display port as input and determines the corresponding light output.

8. The perceptual quantizer according to claim 1, further comprising means for using floating point address encoding for grey tracking, optionally of video data representing linear luminosities.

9. The perceptual quantizer according to claim 8, further comprising means for piece wise linear data interpolation.

10. The perceptual quantizer according to claim 9, wherein interpolation is performed by linear interpolation for 1-dimensional transfer functions.

11. The perceptual quantizer according to claim 1, further comprising means for one or more or any combination of cross talk compensation, uniformity correction, white balance.

12. A display including the perceptual quantizer according to claim 1.

13. The perceptual quantizer according to claim 1, wherein the EOTF is described by the formula:

$$\lim_{\gamma\to\infty}\left[\frac{\left[\frac{1}{c^{1/\gamma}}+\left(1-\frac{1}{c^{1/\gamma}}\right)\cdot v\right]^{\gamma}-\frac{1}{c}}{1-\frac{1}{c}}\right]=\lim_{\gamma\to\infty}\left[\frac{c\cdot\left[\frac{1}{c^{1/\gamma}}+\left(1-\frac{1}{c^{1/\gamma}}\right)\cdot v\right]^{\gamma}-1}{c-1}\right]=$$

$$\frac{\lim_{\gamma\to\infty}\left[c\cdot\left[\frac{1}{c^{1/\gamma}}+\left(1-\frac{1}{c^{1/\gamma}}\right)\cdot v\right]^{\gamma}\right]-1}{c-1}=$$

$$\frac{\lim_{\gamma\to\infty}\left[\frac{c^{1/\gamma}}{c^{1/\gamma}}+\left(c^{1/\gamma}-\frac{c^{1/\gamma}}{c^{1/\gamma}}\right)\cdot v\right]^{\gamma}-1}{c-1}=$$

$$\frac{\lim_{\gamma\to\infty}[1+(c^{1/\gamma}-1)\cdot v]^{\gamma}-1}{c-1}\Big\Downarrow e^{1/\gamma}=$$

$$1+\frac{1}{\gamma}+\frac{1}{\gamma^2}+\frac{1}{\gamma^3}+\ldots\Rightarrow c^{1/\gamma}=1+\ln(c)\cdot\left(\frac{1}{\gamma}+\frac{1}{\gamma^2}+\frac{1}{\gamma^3}+\ldots\right)=$$

$$\frac{\lim_{\gamma\to\infty}\left[1+\left(1+\ln(c)\cdot\left(\frac{1}{\gamma}+\frac{1}{\gamma^2}+\frac{1}{\gamma^3}+\ldots\right)-1\right)\cdot v\right]^{\gamma}-1}{c-1}=$$

$$\frac{\lim_{\gamma\to\infty}\left[1+\left(1+\ln(c)\cdot\frac{1}{\gamma}-1\right)\cdot v\right]^{\gamma}-1}{c-1}=$$

$$\frac{\lim_{\gamma\to\infty}\left[1+\frac{\ln(c)\cdot v}{\gamma}\right]^{\gamma}-1}{c-1}\Big\Downarrow\forall n\to 0:(1+n)^{\gamma}=1+n\cdot\gamma=$$

$$\frac{\lim_{\gamma\to\infty}\left[1+\frac{1}{\gamma}\right]^{\gamma\cdot\ln(c)\cdot v}-1}{c-1}=\frac{\left[\lim_{\gamma\to\infty}\left[1+\frac{1}{\gamma}\right]^{\gamma}\right]^{\ln(c)\cdot v}-1}{c-1}=$$

$$\frac{e^{\ln(c)\cdot v}-1}{c-1}=\frac{[e^{\ln(c)}]^{v}-1}{c-1}=\frac{c^{v}-1}{c-1}.$$

14. A perceptual quantizer for providing a linear perceptual quantizing process of an Electro-Optical Transfer Function (EOTF) for converting received digital code words of a video signal into visible light having a luminosity emitted by a display, the perceptual quantizer comprising:

a target contrast dependent exponential video coder comprising means for providing quantized video levels, with which there is a fixed relative increment of luminosity per quantized video level, so that every quantized video level visibly has the same proportional luminosity variation, wherein cross-talk between pixels or sub-pixels is compensated, and further comprising means for correcting a value for each output sub-pixel based on its original floating point encoded value combined with the original floating point encoded values of a number of its neighbours.

15. A perceptual quantizer for providing a linear perceptual quantizing process of an Electro-Optical Transfer Function (EOTF) for converting received digital code words of a video signal into visible light having a luminosity emitted by a display, the perceptual quantizer comprising:

a target contrast dependent exponential video coder comprising means for providing quantized video levels, with which there is a fixed relative increment of luminosity per quantized video level, so that every quantized video level visibly has the same proportional luminosity variation, wherein an output gammatization LUT is implemented with floating point addressing as a floating point representation of video data representing linear luminosities.

16. A method of perceptual quantization for providing a linear perceptual quantizing process of an Electro-Optical Transfer Function (EOTF) for converting received digital code words of a video signal into visible light having a luminosity emitted by a display, the method comprising: generating a target contrast dependent exponential video coding providing quantized video levels, with which there is a fixed relative increment of luminosity per quantized video level, so that every quantized video level visibly has the same proportional luminosity variation, and wherein the linear perceptual quantizing is processed such that $L=(c^v-1)*K$ based on $c^v$ being implemented in a single DSP block inside a processing engine, wherein c is perpetual contrast, which is a measure for a target dynamic range, v is normalized video (0=black, 1=white), the constant $K=1/(c-1)$ and $L=(c^v-1)*K$ represents the linear luminosity derived with linear operators from $c^v$.

17. A non-transitory computer program product comprising software code which when executed on a processing engine executes the method of claim 16.

* * * * *